US008402779B2

(12) United States Patent
Nishimura et al.

(10) Patent No.: US 8,402,779 B2
(45) Date of Patent: Mar. 26, 2013

(54) AIR CONDITIONER

(75) Inventors: Tadafumi Nishimura, Sakai (JP); Takahiro Yamaguchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1058 days.

(21) Appl. No.: 12/439,820

(22) PCT Filed: Aug. 29, 2007

(86) PCT No.: PCT/JP2007/066714

§ 371 (c)(1),
(2), (4) Date: Mar. 3, 2009

(87) PCT Pub. No.: WO2008/029678

PCT Pub. Date: Mar. 13, 2008

(65) Prior Publication Data

US 2009/0272135 A1 Nov. 5, 2009

(30) Foreign Application Priority Data

Sep. 7, 2006 (JP) ..... 2006-242627
Oct. 30, 2006 (JP) ..... 2006-294485

(51) Int. Cl.
*F25B 45/00* (2006.01)

(52) U.S. Cl. ..... 62/149; 62/77; 62/292

(58) Field of Classification Search ..... 62/77, 149, 62/292

See application file for complete search history.

(56) References Cited

U.S. PATENT DOCUMENTS 6,298,683 B1 * 10/2001 Kondo et al. ..... 62/335
2006/0059926 A1 * 3/2006 McCormick et al. ..... 62/129
2007/0017240 A1 * 1/2007 Shapiro ..... 62/228.1

FOREIGN PATENT DOCUMENTS

JP 55-162563 A 12/1980

(Continued)

OTHER PUBLICATIONS

Korean Office Action of corresponding Korean Patent Application No. 10-2009-7006723 dated Oct. 20, 2011.

(Continued)

*Primary Examiner* — Cheryl J Tyler
*Assistant Examiner* — Jonathan Bradford
(74) *Attorney, Agent, or Firm* — Global IP Counselors

(57) ABSTRACT

An air conditioner refrigerant circuit performs a cooling operation in which an outdoor heat exchanger functions as a condenser of the refrigerant compressed in a compressor and an indoor heat exchanger functions as an evaporator of the refrigerant condensed in the outdoor heat exchanger. Further, an outdoor expansion valve is disposed at a position that is at once downstream of the outdoor heat exchanger and upstream of a liquid refrigerant communication pipe in the refrigerant flow direction in the refrigerant circuit in the cooling operation, and shuts off the refrigerant flow. A refrigerant detection unit is disposed upstream of the outdoor expansion valve and detects the amount or the amount-related value of refrigerant accumulated upstream of the outdoor expansion valve.

10 Claims, 20 Drawing Sheets

FOREIGN PATENT DOCUMENTS

| | | | |
|---|---|---|---|
| JP | H07-218058 | A | 8/1995 |
| JP | 9-79711 | A | 3/1997 |
| JP | 10-103820 | A | 4/1998 |
| JP | H10-281599 | A | 10/1998 |
| JP | 11-182990 | A | 7/1999 |
| JP | 2002-286333 | A | 10/2002 |
| JP | 2003-161535 | A | 6/2003 |
| JP | 2005-282885 | A | 10/2005 |
| JP | 2005-308393 | A | 11/2005 |
| JP | 2006-023072 | A | 1/2006 |
| JP | 2006-038453 | A | 2/2006 |
| JP | 2006-170489 | A | 6/2006 |

OTHER PUBLICATIONS

Korean Office Action of corresponding Korean Patent Application No. 10-2009-7006723 dated Feb. 18, 2011.

Japanese Notice of Allowance of corresponding Japanese Application No. 2006-294485 dated Apr. 23, 2012.

* cited by examiner

AIR CONDITIONER

CROSS-REFERENCE TO RELATED APPLICATIONS

This U.S. National stage application claims priority under 35 U.S.C. §119(a) to Japanese Patent Application No. 2006-242627, filed in Japan on Sep. 7, 2006 and Japanese Patent Application No. 2006-294485, filed in Japan on Oct. 30, 2006, the entire contents of which are hereby incorporated herein by reference.

TECHNICAL FIELD

The present invention relates to an air conditioner that makes a judgment as to whether or not the amount of refrigerant in a refrigerant circuit is adequate.

BACKGROUND ART

Conventionally, as for the amount of refrigerant in a refrigerant circuit of an air conditioner, the air conditioner is operated under specific conditions in order to judge whether or not an adequate amount of refrigerant is charged which is in accordance with the size of the air conditioner, length of a communication pipe of the refrigerant circuit, and the like. In the operation of the air conditioner under such specific conditions, a judgment is made as to whether or not an adequate amount of refrigerant is charged by, for example, detecting the subcooling degree of the refrigerant condensed in a condenser while performing an operation in which control is carried out such that the superheating degree of the refrigerant evaporated in an evaporator reaches a predetermined value.

However, in such an operation, even it a predetermined superheating degree was attained, the pressure in each portion in the refrigerant circuit changes depending on factors such as the temperature of the indoor air that exchanges heat with the refrigerant in a utilization side heat exchanger, the temperature of the outdoor air as a heat source that exchanges heat with the refrigerant in a heat source side heat exchanger, and the like, which consequently changes the target value of the subcooling degree at the time of judging whether or not the amount of refrigerant is adequate. Consequently, it is difficult to improve the judgment accuracy at the time of judging whether or not the amount of refrigerant is adequate.

With respect to this problem, according to JP Pat. Appln. No. 2004-173839 below, the judgment accuracy for the amount of refrigerant charged in a refrigerant circuit is improved by performing a superheating degree control by a utilization side expansion mechanism and an evaporation pressure control by a compressor and detecting the subcooling degree of the refrigerant at the outlet of a heat source side heat exchanger.

SUMMARY OF THE INVENTION

<Technical Problem>

However, judging the amount of refrigerant according to the above described JP Pat. Appln. No. 2004-173839 requires the superheating degree control by the utilization side expansion mechanism and the evaporation pressure control by the compressor as the operational conditions for judging the amount of refrigerant, and thus it is complicated. In addition, error may become large because of factors such as a change in the pressure on the condenser side due to a change in the condition of the outside air temperature, and it is difficult to stably maintain a constant operation state at all times which is required as the operational conditions for appropriately judging the amount of refrigerant.

The present invention is made in light of the above described problems, and it is an object of the present invention to provide an air conditioner capable of simplifying conditions required for judging whether or not the amount of refrigerant is adequate.

<Solution to Problem>

An air conditioner according to a first aspect of the present invention includes a refrigerant circuit, a shutoff valve, and a refrigerant detection unit.

The refrigerant circuit includes a heat source unit having a compressor and a heat source side heat exchanger; a utilization unit having a utilization side expansion mechanism and a utilization side heat exchanger; and a liquid refrigerant communication pipe and a gaseous refrigerant communication pipe which connect a heat source unit to a utilization unit. Further, this refrigerant circuit is configured such that at least a cooling operation can be performed in which the heat source side heat exchanger is caused to function as a condenser of the refrigerant compressed in the compressor and the utilization side heat exchanger is caused to function as an evaporator of the refrigerant condensed in the heat source side heat exchanger. Here, as a matter of course, the refrigerant circuit may have a configuration capable of performing different operations other than the cooling operation such as a heating operation and the like. Further, the shutoff valve is disposed at a position that is downstream of the heat source side heat exchanger and upstream of the liquid refrigerant communication pipe in the refrigerant flow direction in the refrigerant circuit in the cooling operation, and is configured so as to be able to shut off the refrigerant flow. In addition, the refrigerant detection unit is disposed upstream of the shutoff valve in the refrigerant flow direction in the refrigerant circuit in the cooling operation, and is configured to perform detection for the amount or the amount-related value of refrigerant that exists upstream of the shutoff valve. The "detection for the amount or the amount-related value of refrigerant" here includes detection of the amount of refrigerant itself, detection to determine whether or not the amount of refrigerant is adequate, and the like. Note that, the heat source side heat exchanger used here which functions as a condenser of the refrigerant is not limited to the type that causes the refrigerant to undergo a phase change from gas to liquid, but it also includes a type that does not cause a phase change but causes change such as an increase in the refrigerant density as a result of heat exchange such as in the case where carbon dioxide is used as the refrigerant, for example. In addition, the utilization side heat exchanger used here which functions as an evaporator of the refrigerant is not limited to the type that causes the refrigerant to undergo a phase change from liquid to gas, but it also includes a type that does not cause a phase change but causes change such as a decrease in the refrigerant density as a result of heat exchange such as in the case where carbon dioxide is used as the refrigerant, for example.

Here, during the cooling operation by the refrigerant circuit, when the shutoff valve disposed downstream of the heat source side heat exchanger is closed and the refrigerant flow is shut off, the liquid refrigerant, for example, that is condensed in the heat source side heat exchanger that functions as a condenser will accumulate in the heat source side heat exchanger upstream of the shutoff valve mainly because the refrigerant circulation is stopped. At the same time, as the refrigeration operation is performed and the compressor is driven, a portion downstream of the shutoff valve and upstream of the compressor in the refrigerant circuit, which includes components such as the utilization side heat exchanger, the gaseous refrigerant communication pipe, and the like, is depressurized, and consequently there will be hardly any refrigerant in that portion. Consequently, the refrigerant in the refrigerant circuit is intensively collected upstream of the shutoff valve, and the refrigerant detection unit performs detection for the amount of refrigerant that is intensively collected.

Accordingly, it is possible to simplify conditions for making a judgment as to the amount of refrigerant and judge whether or not the amount of refrigerant is adequate.

An air conditioner according to a second aspect of the present invention is the air conditioner according to the first aspect of the present invention, further including a memory and a control unit. The memory stores, in advance, data on the required amount of refrigerant that is required for appropriately performing an air conditioning operation using the refrigerant circuit. In addition, the control unit performs the cooling operation with the shutoff valve closed based on a detection result of the refrigerant detection unit and the required amount of refrigerant.

Here, while performing the cooling operation with the shutoff valve closed, the control unit compares the data on the required amount of refrigerant which is stored in the memory with the information regarding the amount of refrigerant accumulated upstream of the shutoff valve which is judged by a refrigerant judging unit and thereby can automatically determine a surplus or shortage of the refrigerant existing in the refrigerant circuit.

An air conditioner according to a third aspect of the present invention is the air conditioner according to the second aspect of the present invention, wherein the shutoff valve is located at one end of the liquid refrigerant communication pipe and the utilization side expansion mechanism is located at the other end of the liquid refrigerant communication pipe. The control unit performs control such that the temperature of the refrigerant flowing through the liquid refrigerant communication pipe reaches a constant value in the cooling operation, and then closes the utilization side expansion mechanism and the shutoff valve.

Here, the control unit performs control such that the temperature of the refrigerant existing in the liquid refrigerant communication pipe reaches a constant value, and then closes one end and the other end of the liquid refrigerant communication pipe to hermetically seal the liquid refrigerant communication pipe. Consequently, it is possible to accurately quantify the amount of refrigerant existing in the liquid refrigerant communication pipe. Then, as the control unit performs the cooling operation and drives the compressor, a portion from downstream of the compressor to the utilization side expansion mechanism in the refrigerant circuit will be depressurized and thus there will be hardly any refrigerant in that portion, causing the refrigerant to accumulate upstream of the shutoff valve.

Accordingly, an accurate amount of refrigerant is hermetically sealed in the liquid refrigerant communication pipe, and thereby it is possible to reduce the number of portions in the refrigerant circuit where there is hardly any refrigerant due to depressurization (portion where judgment error occurs) and to improve the judgment accuracy.

In addition, for example, when the accurate amount of refrigerant is hermetically sealed in the liquid refrigerant communication pipe and thereby the amount of refrigerant to be accumulated upstream of the shutoff valve can be reduced by the amount in the liquid refrigerant communication pipe, it is possible to reduce the number of portions to be detected by the refrigerant judging unit.

Further, for example, when arranging the refrigerant circuit in a building, even if the amount of refrigerant in the refrigerant circuit largely changes due to arrangement of a very long liquid refrigerant communication pipe, it is possible to hermetically seal the accurate amount of refrigerant in the liquid refrigerant communication pipe. Thus, when the refrigerant detection unit performs detection for the amount of refrigerant upstream of the shutoff valve, the influence on the detection due to the change can be reduced, enabling a stable detection.

An air conditioner according to a fourth aspect of the present invention is the air conditioner according to the second or third aspect of the present invention, wherein the heat source unit includes a first heat source unit having a first compressor and a first heat source heat exchanger, and a second heat source unit having a second compressor and a second heat source heat exchanger. In addition, the shutoff valve includes a first shutoff valve disposed downstream of the first heat source side heat exchanger in the refrigerant flow direction and capable of shutting off the refrigerant flow, and a second shutoff valve disposed downstream of the second heat source side heat exchanger in the refrigerant flow and capable of shutting off the refrigerant flow. The refrigerant detection unit includes a first refrigerant detection unit disposed upstream of the first shutoff valve in the refrigerant flow direction and configured to perform detection for the amount of refrigerant existing upstream of the first shutoff valve in the refrigerant flow direction, and a second refrigerant detection unit disposed upstream of the second shutoff valve in the refrigerant flow direction and configured to perform detection for the amount of refrigerant existing upstream of the second shutoff valve in the refrigerant flow direction. Further, the memory stores in advance data on a first required amount of refrigerant for the first heat source unit, and data on second required amount of refrigerant for the second heat source unit. The control unit controls the operation of the first compressor based on the first required amount of refrigerant and controls the operation of the second compressor based on the second required amount of refrigerant.

Here, when the refrigerant circuit is provided with a plurality of heat source units, the control unit can control driving of the compressor of each heat source unit according to the amount of refrigerant required in the heat source heat exchanger of each heat source unit. Consequently, the control unit can stop driving of the first compressor at a time point when the first required amount of refrigerant has accumulated in the first heat source unit, and can stop driving of the second compressor at a time point when the second required amount of refrigerant has accumulated in the second heat source unit.

Accordingly, it is possible to control the operation of the compressor to adjust the amount of refrigerant such that a specified amount of refrigerant accumulates in each heat source unit.

An air conditioner according to a fifth aspect of the present invention is the air conditioner according to the fourth aspect of the present invention, wherein the first heat source unit includes a first check valve disposed between the first compressor and the first heat source heat exchanger and configured to stop the refrigerant flow toward the first compressor. In addition, the second heat source unit includes a second check valve disposed between the second compressor and the second heat source heat exchanger and configured to stop the refrigerant flow toward the second compressor.

Here, when the refrigerant circuit is provided with a plurality of heat source units, if, for example, the second compressor continues to be driven in a state in which the second required amount of refrigerant is not yet reached in the second heat source unit after the first required amount of refrigerant has accumulated in the first heat source unit, there is a risk that the refrigerant accumulated in the first heat source unit may flow back.

With respect to this risk, here, a check valve is arranged between the compressor and the heat source heat exchanger in each heat source unit.

Accordingly, it is possible to prevent the refrigerant temporarily accumulated in the heat source unit from flowing back.

An air conditioner according to a sixth aspect of the present invention includes: a heat source side heat exchanger; a first utilization side expansion mechanism connected to the heat source side heat exchanger via a first liquid refrigerant communication pipe; a first utilization side heat exchanger connected to the first utilization side expansion mechanism via a first utilization side refrigerant pipe; a second utilization side expansion mechanism connected to the heat source side heat exchanger via a second liquid refrigerant communication pipe; a second utilization side heat exchanger connected to the second utilization side expansion mechanism via a second utilization side refrigerant pipe; a compressor in which either the discharge side or suction side thereof is connected to the heat source side heat exchanger via a heat source side refrigerant pipe; a first switching means; a second switching means; a bypass mechanism; a discharge communication switching mean; a shutoff valve, and a refrigerant detection unit. Here, the first switching means can switch the connection state such that either one of a discharged gaseous refrigerant communication pipe extending from the discharge side of the compressor or a sucked gaseous refrigerant communication pipe extending from the suction side of the compressor is connected to the first utilization side heat exchanger. The second switching means can switch the connection state such that either one of the discharged gaseous refrigerant communication pipe or the sucked gaseous refrigerant communication pipe is connected to the second utilization side heat exchanger. The bypass mechanism connects a part of the sucked gaseous refrigerant communication pipe to a part of the discharged gaseous refrigerant communication pipe, and includes bypass communication switching means that switches between a state in which a part of the sucked gaseous refrigerant communication pipe and a part of the discharged gaseous refrigerant communication pipe communicate with each other and a state in which they do not communicate with each other. The discharge communication switching means can switch between a state in which the compressor and the discharged gaseous refrigerant communication pipe communicate with each other and a state in which they do not communicate with each other. The shutoff valve is disposed downstream of the heat source side heat exchanger in the refrigerant flow direction when the heat source side heat exchanger is connected to the discharge side of the compressor and operated as a condenser of the refrigerant. The shutoff valve is capable of shutting off the flow of the condensed liquid refrigerant. The refrigerant detection unit is disposed upstream of the shutoff valve in the refrigerant flow direction, and performs detection for the amount or the amount-related value of liquid refrigerant existing upstream of the shutoff valve.

Here, four patterns of operation state can be achieved by a combination of the switching states of the first switching mechanism and the switching states of the second switching mechanism. Specifically, first, when the discharged gaseous refrigerant communication pipe is connected to both the first utilization side heat exchanger and the second utilization side heat exchanger, both of them function as condensers and both of them perform a heating operation. Second, when the sucked gaseous refrigerant communication pipe is connected to both of the first utilization side heat exchanger and the second utilization side heat exchanger, both of them function as evaporators and both of them perform a cooling operation. Third, when the discharged gaseous refrigerant communication pipe is connected to the first utilization side heat exchanger and the sucked gaseous refrigerant communication pipe is connected to the second utilization side heat exchanger, the first utilization side heat exchanger that functions as a condenser performs the heating operation and the second utilization side heat exchanger that functions as an evaporator performs the cooling operation. Fourth, when the sucked gaseous refrigerant communication pipe is connected to the first utilization side heat exchanger and the discharged gaseous refrigerant communication pipe is connected to the second utilization side heat exchanger, the first utilization side heat exchanger that functions as an evaporator performs the cooling operation and the second utilization side heat exchanger that functions as a condenser performs the heating operation. In the third and fourth cases, cooling and heating are simultaneously performed, thus achieving air conditioning required in the space where each utilization side heat exchanger is disposed.

In order to judge the amount of refrigerant existing in the refrigerant circuit capable of performing such a simultaneous cooling and heating operation, an operation in which the heat source side heat exchanger is caused to function as a condenser is performed by changing a setting from the switching state that allows the above described simultaneous cooling and heating operation to the following state. First, the discharge communication switching means is set to a non-communication state. Next, the bypass mechanism is set such that a part of the sucked gaseous refrigerant communication pipe and a part of the discharged gaseous refrigerant communication pipe communicate with each other. Further, the refrigerant flow is shut off by the shutoff valve. When the compressor is driven in the state as described above, the discharged gaseous refrigerant is condensed in the heat source side heat exchanger and the liquid refrigerant accumulates upstream of the shutoff valve. Other portions in the refrigerant circuit communicate with the suction side of the compressor and become depressurized, and thereby the amount of refrigerant is reduced. Thus, judgment error can be reduced. The liquid refrigerant can be collected upstream of the shutoff valve simply through the operation of the compressor, and portions other than upstream of the shutoff valve will be in a state communicating with the suction side of the compressor. Thus, a judgment as to the amount of liquid refrigerant can be made by the refrigerant detection unit, and the amount of refrigerant can be judged.

Accordingly, even in the case of an air conditioner provided with a refrigerant circuit capable of the simultaneous cooling and heating operation, it is possible to judge the amount of refrigerant with high judgment accuracy under simple operational conditions, by detecting the amount of liquid refrigerant accumulated upstream of the shutoff valve.

An air conditioner according to a seventh aspect of the present invention is the air conditioner according to the sixth aspect of the present invention, further including a receiving unit and a control unit. The receiving unit receives a predetermined signal for detection for the amount of refrigerant. When the receiving unit receives a predetermined signal, the control unit switches the bypass communication switching means of the bypass mechanism such that a part of the sucked gaseous refrigerant communication pipe and a part of the discharged gaseous refrigerant communication pipe communicate with each other, and switches the discharge communication switching means such that the compressor and the discharged gaseous refrigerant communication pipe do not communicate with each other. Then, in such a state, the control unit performs control to establish a state in which the heat source side heat exchanger is connected to the discharge side of the compressor and caused to function as a condenser of the refrigerant.

Here, when the receiving unit receives a predetermined signal, the control unit controls switching of the connection state such that the heat source side heat exchanger is connected to the discharge side of the compressor and caused to function as a condenser of the refrigerant. Further, the control unit controls switching of the connection state such that both the sucked gaseous refrigerant communication pipe and the discharged gaseous refrigerant communication pipe are connected to the suction side of the compressor.

Accordingly, when the receiving unit receives a predetermined signal, the connection state of the refrigerant circuit for performing an automatic cooling and heating operation can be automatically switched to the connection state of the refrigerant circuit for making a judgment as to the amount of refrigerant.

An air conditioner according to an eighth aspect of the present invention is the air conditioner according to the seventh aspect of the present invention, wherein the heat source side heat exchanger includes a first heat source side heat exchanger, and a second heat source side heat exchanger connected in parallel to the first heat source side heat exchanger. The shutoff valve includes a first shutoff valve disposed downstream of the first heat source side heat exchanger and a second shutoff valve disposed downstream of the second heat source side heat exchanger in the refrigerant flow direction when the heat source side heat exchanger is operated as a condenser of the refrigerant. The refrigerant detection unit includes a first refrigerant detection unit that performs detection for the amount of refrigerant accumulated upstream of the first shutoff valve in the refrigerant flow direction, and a second refrigerant detection unit that performs detection for the amount of refrigerant accumulated upstream of the second shutoff valve. The air conditioner further includes valves including a first valve disposed upstream of the first heat source side heat exchanger in the refrigerant flow direction and a second valve disposed upstream of the second heat source side heat exchanger in the refrigerant flow direction. The control unit performs control such that one of the valves, whichever is arranged for a portion where the accumulation of refrigerant is detected at an earlier timing, is closed first, based on a comparison between the timing when it is detected by the first refrigerant detection unit that a first specified amount of refrigerant has accumulated and the timing when it is detected by the second refrigerant detection unit that a second specified amount of refrigerant has accumulated.

Here, in the operation for judging the amount of refrigerant when a plurality of heat source side heat exchangers are juxtaposed in parallel, the control unit performs control to close the valves in a sequence corresponding to the sequence in which a specified amount of refrigerant is detected in each heat source side heat exchanger. Consequently, the liquid refrigerant accumulated in each heat source side heat exchanger does not exceed a specified amount of refrigerant.

Accordingly, even if the speed of accumulation of the liquid refrigerant may be different in each of the plurality of heat source side heat exchangers, it is possible to accumulate a specified amount of refrigerant in each heat source side heat exchanger.

An air conditioner according to a ninth aspect of the present invention is the air conditioner according to the seventh aspect of the present invention, wherein the heat source side heat exchanger includes a first heat source side heat exchanger, and a second heat source side heat exchanger connected in parallel to the first heat source side heat exchanger. The shutoff valve includes a first shutoff valve disposed downstream of the first heat source side heat exchanger and a second shutoff valve disposed downstream of the second heat source side heat exchanger in the refrigerant flow direction when the heat source side heat exchanger is operated as a condenser of the refrigerant. The refrigerant detection unit includes a first refrigerant detection unit that performs detection for the amount of refrigerant accumulated upstream of the first shutoff valve in the refrigerant flow direction, and a second refrigerant detection unit that performs detection for the amount of refrigerant accumulated upstream of the second shutoff valve. The air conditioner further includes valves including a first valve disposed upstream of the first heat source side heat exchanger in the refrigerant flow direction, and a second valve disposed upstream of the second heat source side heat exchanger. The control unit performs control to adjust an opening degree ratio between the first valve and the second valve such that the timing when it is detected by the first detection unit that a first specified amount of refrigerant has accumulated substantially coincides with the timing when it is detected by the second detection unit that a second specified amount of refrigerant has accumulated.

Here, in the operation for judging the amount of refrigerant when a plurality of heat source side heat exchangers are juxtaposed in parallel, the control units performs control to adjust an opening degree ratio between the first valve and the second valve such that the accumulation of a specified amount of refrigerant is performed and detected simultaneously in all the heat source side heat exchangers. Consequently, the refrigerant whose amount corresponds to a ratio of a specified amount of refrigerant is supplied to each heat source side heat exchanger.

Accordingly, even if the speed of accumulation of the liquid refrigerant may be different in each of the plurality of heat source side heat exchangers, it is possible to accumulate a specified amount of refrigerant in each heat source side heat exchanger.

An air conditioner according to a tenth aspect of the present invention is the air conditioner according to any one of sixth through ninth aspects of the present invention, further including a hot gas bypass circuit that connects the discharge side of the compressor to the suction side of the compressor and that includes an opening/closing mechanism.

When performing the operation for judging the amount of refrigerant, there is a risk that the speed of refrigerant supply from the compressor to the heat source side heat exchanger may exceed the speed of condensation of the gaseous refrigerant in the heat source side heat exchanger.

With respect to this risk, here, the hot gas bypass circuit is disposed, and by so doing, even if the gaseous refrigerant whose amount is too much to be completely condensed in the heat source side heat exchanger is supplied to the heat source side heat exchanger, it is possible to guide uncondensed refrigerant to the suction side of the compressor and cause the refrigerant to circulate again by opening the opening/closing mechanism of the hot gas bypass circuit.

Accordingly, it is possible to adjust the balance between the speed of condensation in the heat source side heat exchanger and the speed of gaseous refrigerant supply.

Note that, for example, even if the pipe on the discharge side of the compressor is an inexpensive pipe having an insufficient pressure-resistant strength, a high pressure state where the pressure on the discharge side abnormally rises can be avoided by the hot gas bypass circuit, and thus it is possible to improve the reliability.

An air conditioner according to an eleventh aspect of the present invention is the air conditioner according to the tenth aspect of the present invention, wherein the compressor includes a first compressor and a second compressor connected in parallel to the first compressor and whose operation is separately controllable. The hot gas bypass circuit connects between the discharge side of the first compressor and the discharge side of the second compressor, and between the suction side of the first compressor and the suction side of the second compressor.

Here, the discharge side and the suction side of the first compressor and the discharge side and the suction side of the second compressor all communicate with the hot gas bypass circuit, and thus a change in the capacities of the first compressor and the second compressor can be handled, such as in the case where failure can be avoided even if the circulation flow rate is increased. Consequently, it is possible to judge the amount of refrigerant while maintaining the working conditions of both the first compressor and the second compressor as they are. Therefore, even when a plurality of compressors are used, by making sure that there will be no non-operating compressor during judgment of the amount of refrigerant, it is possible to reduce a judgment error caused by the difference between the solubility of the refrigerant in high-temperature and high-pressure refrigerant oil in the operating compressor and the solubility of the refrigerant in low-temperature and low-pressure refrigerant oil in the non-operating compressor.

Accordingly, it is possible to control a change in the amount of refrigerant dissolved in the refrigerant oil and to improve the judgment accuracy for the amount of refrigerant.

<Effects Of The Present Invention>

With the air conditioner according to the first aspect of the present invention, it is possible to simplify conditions for making a judgment as to the amount of refrigerant and judge whether or not the amount of refrigerant is adequate.

With the air conditioner according to the second aspect of the present invention, it is possible to automatically determine a surplus or shortage of the refrigerant existing in the refrigerant circuit.

With the air conditioner according to the third aspect of the present invention, an accurate amount of refrigerant is hermetically sealed in the liquid refrigerant communication pipe, and thereby it is possible to reduce the number of portions in the refrigerant circuit where there is hardly any refrigerant due to depressurization (portion where judgment error occurs) and to improve the judgment accuracy.

With the air conditioner according to the fourth aspect of the present invention, it is possible to control the operation of each compressor to adjust the amount of refrigerant such that a specified amount of refrigerant accumulates in each heat source unit, when a plurality of heat source units are connected to the refrigerant circuit.

With the air conditioner according to the fifth aspect of the present invention, it is possible to prevent the refrigerant temporarily accumulated in the heat source unit from flowing back after at least one of the plurality of connected heat source units is stopped.

With the air conditioner according to the sixth aspect of the present invention, even in the case of an air conditioner provided with a refrigerant circuit capable of the simultaneous cooling and heating operation, it is possible to judge the amount of refrigerant with high judgment accuracy under simple operational conditions, by detecting the amount of liquid refrigerant accumulated upstream of the shutoff valve.

With the air conditioner according to the seventh aspect of the present invention, when the receiving unit receives a predetermined signal, the connection state of the refrigerant circuit for performing an automatic cooling and heating operation can be automatically switched to the connection state of the refrigerant circuit for making a judgment as to the amount of refrigerant.

With the air conditioner according to the eighth aspect of the present invention, even if the speed of accumulation of the liquid refrigerant may be different in each of the plurality of heat source side heat exchangers, it is possible to accumulate a specified amount of refrigerant in each heat source side heat exchanger.

With the air conditioner according to the ninth aspect of the present invention, even if the speed of accumulation of the liquid refrigerant may be different in each of the plurality of heat source side heat exchangers, it is possible to accumulate a specified amount of refrigerant in each heat source side heat exchanger.

With the air conditioner according to the tenth aspect of the present invention, it is possible to adjust the balance between the speed of condensation in the heat source side heat exchanger and the speed of gaseous refrigerant supply.

With the air conditioner according to the eleventh aspect of the present invention, it is possible to control a change in the amount of refrigerant dissolved in the refrigerant oil and to improve the judgment accuracy for the amount of refrigerant

DETAILED DECRIPTION OF THE PREFERRED EMODIMENTS

Hereinbelow, embodiments of an air conditioner according to the present invention are described based on the drawings.

(1) Configuration of the Air Conditioner

Figure 1:
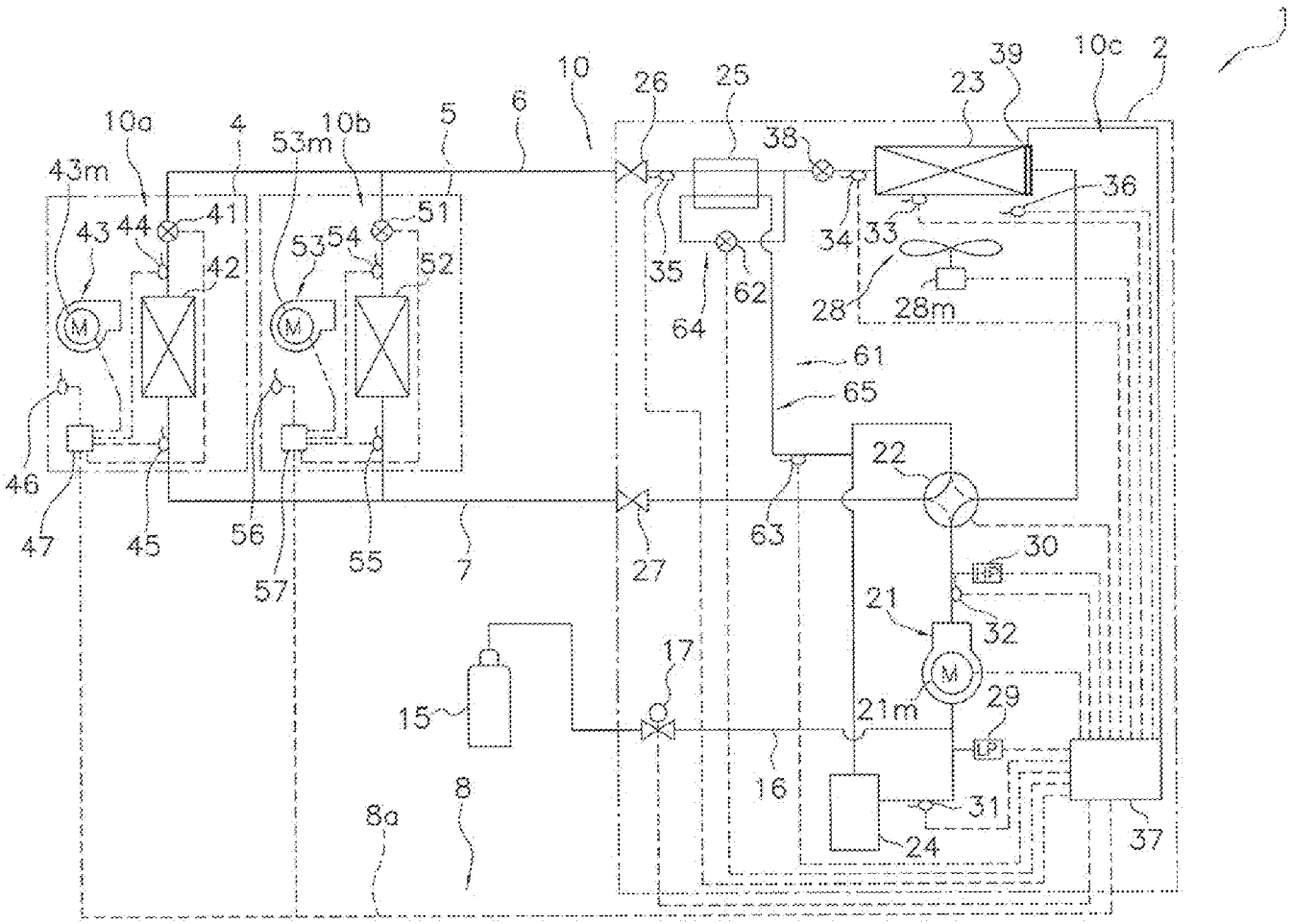
FIG. 1 is a schematic configuration diagram of an air conditioner according to an embodiment of the present invention.

FIG. 1 is a schematic configuration view of an air conditioner 1 according to an embodiment of the present invention. The air conditioner 1 is a device that is used to cool and heat a room in a building and the like by performing a vapor compression-type refrigeration cycle operation. The air conditioner 1 mainly includes one outdoor unit 2 as a heat source unit, indoor units 4 and 5 as a plurality (two in the present embodiment) of utilization units connected in parallel to the outdoor unit 2, and a liquid refrigerant communication pipe 6 and a gaseous refrigerant communication pipe 7 as refrigerant communication pipes which connect the outdoor unit 2 to the indoor units 4 and 5. In other words, a vapor compression-type refrigerant circuit 10 of the air conditioner 1 in the present embodiment is formed by the interconnection of the outdoor unit 2, the indoor units 4 and 5, and the liquid refrigerant communication pipe 6 and the gaseous refrigerant communication pipe 7.

<Indoor Unit>

The indoor units 4 and 5 are installed by being embedded in or hung from a ceiling of a room in a building and the like or by being mounted or the like on a wall surface of a room. The indoor units 4 and 5 are connected to the outdoor unit 2 via the liquid refrigerant communication pipe 6 and the gaseous refrigerant communication pipe 7, and form a part of the refrigerant circuit 10.

Next, the configurations of the indoor units 4 and 5 are described. Note that, because the indoor units 4 and 5 have the same configuration, only the configuration of the indoor unit 4 is described here, and in regard to the configuration of the indoor unit 5, reference numerals in the 50s are used instead of reference numerals in the 40s representing the respective portions of the indoor unit 4, and descriptions of those respective portions are omitted.

The indoor unit 4 mainly includes an indoor side refrigerant circuit 10*a* (an indoor side refrigerant circuit 10*b* in the case of the indoor unit 5) that forms a part of the refrigerant circuit 10. The indoor side refrigerant circuit 10*a* mainly includes an indoor expansion valve 41 as an expansion mechanism and an indoor heat exchanger 42 as a utilization side heat exchanger.

In the present embodiment, the indoor expansion valve 41 is an electric expansion valve connected to the liquid side of the indoor heat exchanger 42 in order to adjust the flow rate or the like of the refrigerant flowing in the indoor side refrigerant circuit 10*a*.

In the present embodiment, the indoor heat exchanger 42 is a cross fin-type fin-and-tube type heat exchanger formed by a heat transfer tube and numerous fins, and is a heat exchanger that functions as an evaporator of the refrigerant during a cooling operation to cool the room air and functions as a condenser of the refrigerant during a heating operation to heat the room air.

In the present embodiment, the indoor unit 4 includes an indoor fan 43 as a ventilation fan for taking in the room air into the unit, causing the air to heat exchange with the refrigerant in the indoor heat exchanger 42, and then supplying the air to the room as the supply air. The indoor fan 43 is a fan capable of varying the flow rate of the air which is supplied to the indoor heat exchanger 42, and in the present embodiment, is a centrifugal fan, multi-blade fan, or the like, which is driven by a motor 43*m* comprising a DC fan motor.

In addition, various types of sensors are disposed in the indoor unit 4. A liquid side temperature sensor 44 that detects the temperature of the refrigerant (i.e., the refrigerant temperature corresponding to the condensation temperature during the heating operation or the evaporation temperature during the cooling operation) is disposed at the liquid side of the indoor heat exchanger 42. A gas side temperature sensor 45 that detects the temperature of the refrigerant is disposed at the gas side of the indoor heat exchanger 42. A room temperature sensor 46 that detects the temperature of the room air that flows into the unit (i.e., room temperature) is disposed at the room air intake side of the indoor unit 4. In the present embodiment, the liquid side temperature sensor 44, the gas side temperature sensor 45, and the room temperature sensor 46 comprise thermistors. In addition, the indoor unit 4 includes an indoor side control unit 47 that controls the operation of each portion forming the indoor unit 4. Additionally, the indoor side control unit 47 includes a microcomputer for controlling the indoor unit 4, a memory and the like, and is configured such that it can exchange control signals and the like with a remote controller (not shown) for individually operating the indoor unit 4 and can exchange control signals and the like with the outdoor unit 2 via a transmission line 8*a*.

<Outdoor Unit>

The outdoor unit 2 is installed outside a room of a building and the like, and connected to the indoor units 4 and 5 via the liquid refrigerant communication pipe 6 and the gaseous refrigerant communication pipe 7, forming the refrigerant circuit 10 with the indoor units 4 and 5.

Next, the configuration of the outdoor unit 2 is described. The outdoor unit 2 mainly includes an outdoor side refrigerant circuit 10*c* that forms a part of the refrigerant circuit 10. This outdoor side refrigerant circuit 10*c* mainly includes a compressor 21, a four-way switching valve 22, an outdoor heat exchanger 23 as a heat source side heat exchanger, an outdoor expansion valve 38 as an expansion mechanism, an accumulator 24, a subcooler 25 as a temperature adjustment mechanism, a liquid side shut-off valve 26, and a gas side shut-off valve 27.

The compressor 21 is a compressor whose operation capacity can be varied, and in the present embodiment, is a positive displacement-type compressor driven by a motor 21*m* whose rotation speed is controlled by an inverter.

The four-way switching valve 22 is a valve for switching the direction of the refrigerant flow such that, during the cooling operation, the four-way switching valve 22 is capable of connecting the discharge side of the compressor 21 to the gas side of the outdoor heat exchanger 23 and connecting the suction side of the compressor 21 (specifically, the accumulator 24) to the gaseous refrigerant communication pipe 7 (see the solid lines of the four-way switching valve 22 in FIG. 1) to cause the outdoor heat exchanger 23 to function as a condenser of the refrigerant compressed in the compressor 21 and to cause the indoor heat exchangers 42 and 52 to function as evaporators of the refrigerant condensed in the outdoor heat exchanger 23; and such that, during the heating operation, the four-way switching valve 22 is capable of connecting the discharge side of the compressor 21 to the gaseous refrigerant communication pipe 7 and connecting the suction side of the compressor 21 to the gas side of the outdoor heat exchanger 23 (see the dotted lines of the four-way switching valve 22 in FIG. 1) to cause the indoor heat exchangers 42 and 52 to function as condensers of the refrigerant compressed in the compressor 21 and to cause the outdoor heat exchanger 23 to function as an evaporator of the refrigerant condensed in the indoor heat exchangers 42 and 52.

Figure 2:
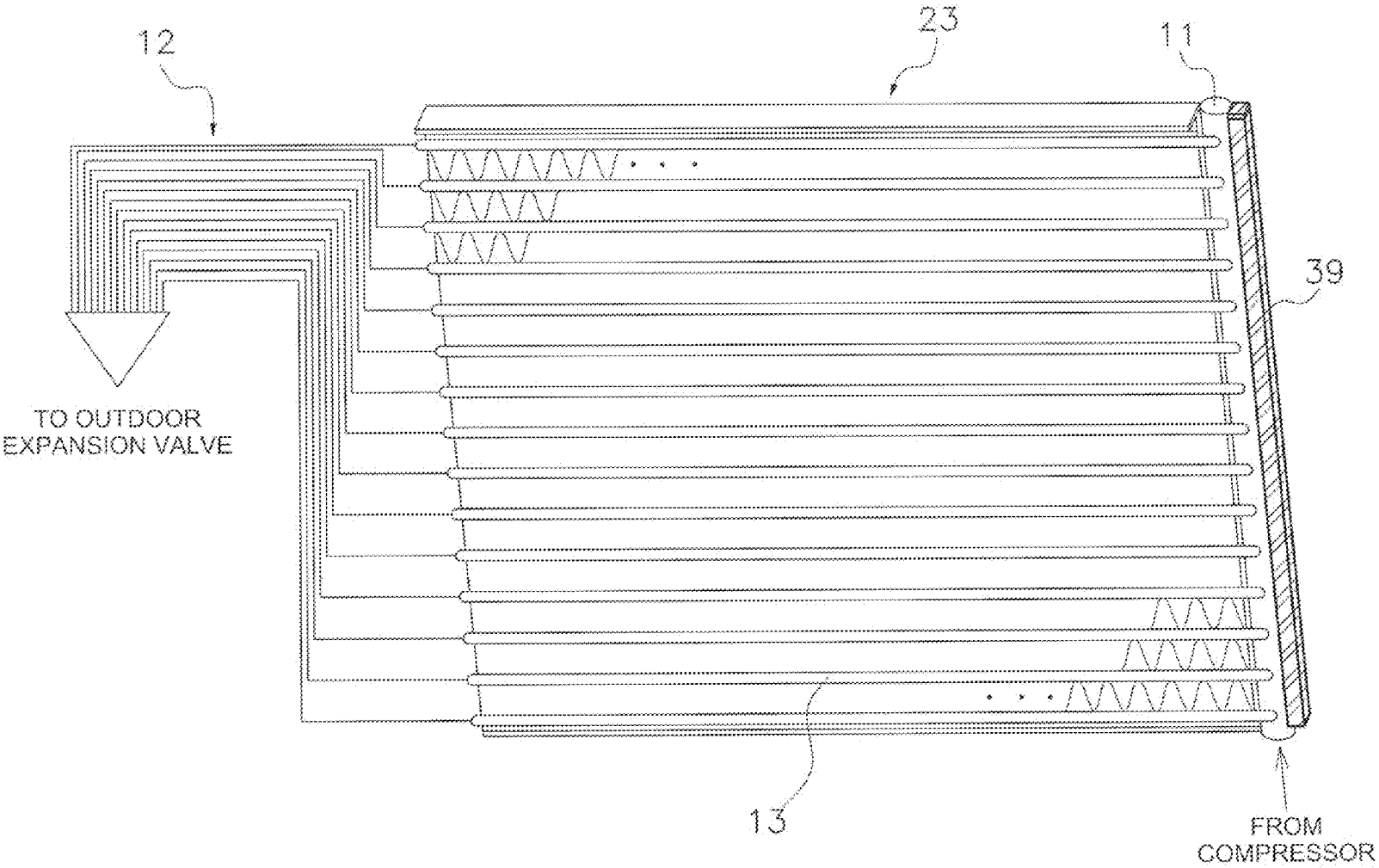
FIG. 2 is a schematic view of an outdoor heat exchanger.
Figure 9:
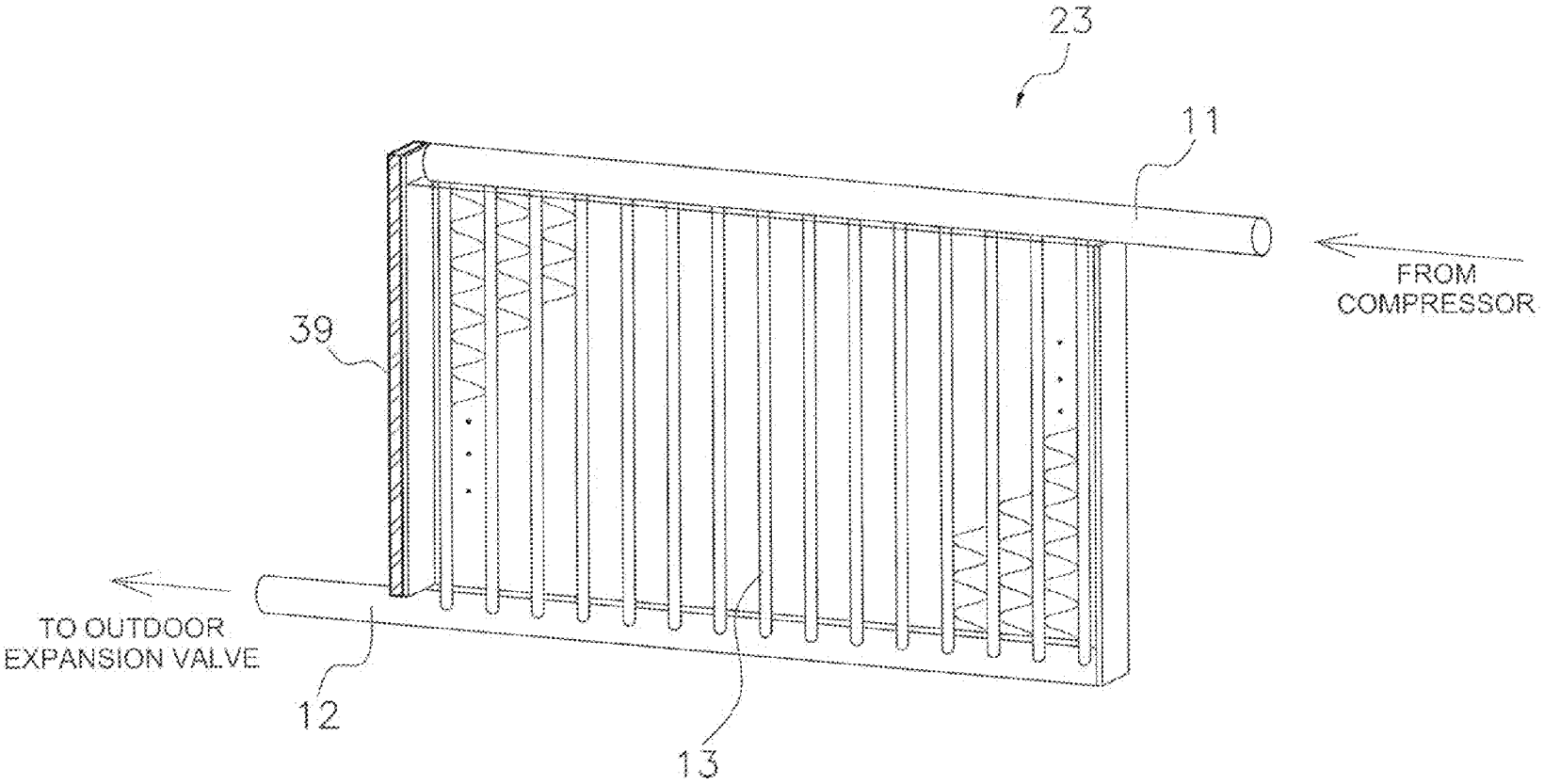
FIG. 9 is a view showing another example of the outdoor heat exchanger.

In this embodiment, as shown in FIG. 2, the outdoor heat exchanger 23 is a so-called fin and tube type heat exchanger having a header 11, branching capillaries 12, and a plurality of flat pipes 13 that connect the header 11 to the branching capillaries 12 such that the branching capillaries 12 are arranged in a spaced-apart and substantially parallel manner. Note that, as a heat exchanger in a refrigerant circuit to which the present invention is applied, it is not limited to such a fin and tube type heat exchanger. For example, it can be a plate type heat exchanger, or the like (for example, see FIG. 9). The outdoor heat exchanger 23 is a heat exchanger that functions as a condenser that liquefies the gaseous refrigerant that flows thereinto from the header 11 during the cooling operation and functions as an evaporator that vaporizes the liquid refrigerant that flows thereinto from the branching capillaries 12 during the heating operation, by performing heat exchange with the air supplied by an outdoor fan 28. The gas side of the outdoor heat exchanger 23 is connected to the compressor 21 and the four-way switching valve 22, and the liquid side of the outdoor heat exchanger 23 is connected to the outdoor expansion valve 38 and the liquid refrigerant communication pipe 6.

Figure 3:
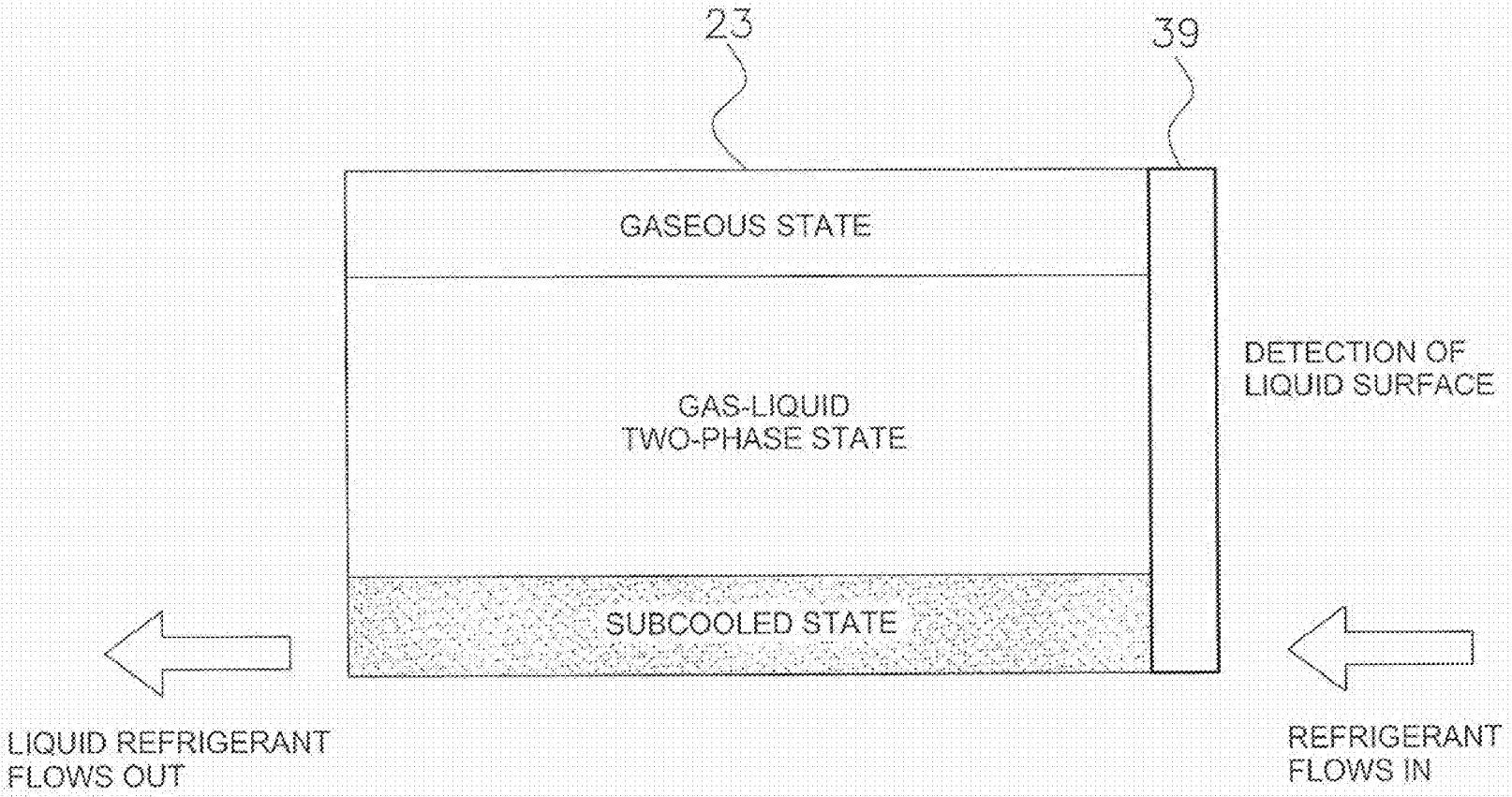
FIG. 3 is a conceptual view showing the refrigerant accumulated in the outdoor heat exchanger.

In addition, as shown in FIG. 2 and FIG. 3, a liquid surface detection sensor 39 that detects the amount of condensed liquid refrigerant is provided to a lateral side of the outdoor heat exchanger 23. The liquid surface detection sensor 39 is a sensor for detecting the amount of liquid refrigerant accumulated in the outdoor heat exchanger 23, and is formed by a tubular detection member. Here, for example, as shown in FIG. 3, in the case of the cooling operation, in the outdoor heat exchanger 23, a high temperature gaseous refrigerant flowing thereinto from the compressor 21 exchanges heat with the air supplied by the outdoor fan 28, and consequently sensible heat transfer occurs. As a result, the high temperature gaseous refrigerant is cooled to about the outside air temperature while maintaining its gaseous state. Then, the gaseous refrigerant exchanges more heat with the air supplied by the outdoor fan 28, and consequently latent heat transfer occurs. As a result, the gaseous refrigerant is condensed, while maintaining its temperature constant, into a liquid refrigerant after passing through a gas-liquid two-phase state. The liquid surface detection sensor 39 detects the liquid surface, taking a boundary between the area where the refrigerant exists in a gaseous state and the area where the refrigerant exists in a liquid state as the liquid surface. Note that, here, the liquid surface detection sensor 39 is not limited to the above described tubular detection member. For example, it may be a sensor that detects the amount of liquid refrigerant accumulated in the outdoor heat exchanger 23 in which the sensor includes thermistors disposed at a plurality of locations along the height direction of the outdoor heat exchanger 23, and detects the liquid surface, taking a boundary between a superheated portion of the gaseous refrigerant whose temperature is higher than the outside air temperature and a portion of the liquid refrigerant whose temperature is substantially equal to the outside air temperature as the liquid surface, as described above.

In the present embodiment, the outdoor expansion valve 38 is an electric expansion valve connected to the liquid side of the outdoor heat exchanger 23 in order to adjust the pressure, flow rate, or the like of the refrigerant flowing in the outdoor side refrigerant circuit 10*c*, and the outdoor expansion valve 38 can be brought to a completely closed state.

In the present embodiment, the outdoor unit 2 includes the outdoor fan 28 as a ventilation fan for taking in the outdoor air into the unit, causing the air to exchange heat with the refrigerant in the outdoor heat exchanger 23, and then exhausting the air to the outside of the room. The outdoor fan 28 is a fan capable of varying the flow rate of the air which is supplied to the outdoor heat exchanger 23, and in the present embodiment, is a propeller fan or the like driven by a motor 28*m* comprising a DC fan motor.

The accumulator 24 is connected between the four-way switching valve 22 and the compressor 21 and is a container capable of accumulating excess refrigerant generated in the refrigerant circuit 10 in accordance with the change in the operation load of the indoor units 4 and 5 and the like.

In the present embodiment, the subcooler 25 is a double tube heat exchanger, and is disposed to cool the refrigerant to be sent to the indoor expansion valves 41 and 51 after the refrigerant is condensed in the outdoor heat exchanger 23. In the present embodiment, the subcooler 25 is connected between the outdoor expansion valve 38 and the liquid side shut-off valve 26.

In the present embodiment, a bypass refrigerant circuit 61 as a cooling source of the subcooler 25 is disposed. Note that, in the description below, a portion corresponding to the refrigerant circuit 10 excluding the bypass refrigerant circuit 61 is referred to as a main refrigerant circuit for convenience sake.

The bypass refrigerant circuit 61 is connected to the main refrigerant circuit so as to cause a portion of the refrigerant sent from the outdoor heat exchanger 23 to the indoor expansion valves 41 and 51 to branch from the main refrigerant circuit and return to the suction side of the compressor 21. Specifically, the bypass refrigerant circuit 61 includes a branch circuit 64 connected so as to branch a portion of the refrigerant sent from the outdoor expansion valve 38 to the indoor expansion valves 41 and 51 at a position between the outdoor heat exchanger 23 and the subcooler 25, and a merge circuit 65 connected to the suction side of the compressor 21 so as to return a portion of the refrigerant from the outlet on the bypass refrigerant circuit side of the subcooler 25 to the suction side of the compressor 21. Further, the branch circuit 64 is disposed with a bypass expansion valve 62 for adjusting the flow rate of the refrigerant flowing in the bypass refrigerant circuit 61. Here, the bypass expansion valve 62 comprises an electrically operated expansion valve. Accordingly, the refrigerant sent from the outdoor heat exchanger 23 to the indoor expansion valves 41 and 51 is cooled in the subcooler 25 by the refrigerant flowing in the bypass refrigerant circuit 61 which has been depressurized by the bypass expansion valve 62. In other words, the performance of the subcooler 25 is controlled by adjusting the opening degree of the bypass expansion valve 62.

The liquid side shut-off valve 26 and the gas side shut-off valve 27 are valves disposed at connection ports to the external equipment and pipes (specifically, the liquid refrigerant communication pipe 6 and the gaseous refrigerant communication pipe 7). The liquid side shut-off valve 26 is connected to the outdoor heat exchanger 23. The gas side shut-off valve 27 is connected to the four-way switching valve 22.

In addition, various sensors other than the above described the liquid surface detection sensor 39 are provided to the outdoor unit 2. Specifically, disposed in the outdoor unit 2 are an suction pressure sensor 29 that detects the suction pressure of the compressor 21, a discharge pressure sensor 30 that detects the discharge pressure of the compressor 21, a suction temperature sensor 31 that detects the suction temperature of the compressor 21, and a discharge temperature sensor 32 that detects the discharge temperature of the compressor 21. The suction temperature sensor 31 is disposed at a position between the accumulator 24 and the compressor 21. A heat exchanger temperature sensor 33 that detects the temperature of the refrigerant flowing through the outdoor heat exchanger 23 (i.e., the refrigerant temperature corresponding to the condensation temperature during the cooling operation or the evaporation temperature during the heating operation) is disposed in the outdoor heat exchanger 23. A liquid side temperature sensor 34 that detects a refrigerant temperature Tco is disposed at the liquid side of the outdoor heat exchanger 23. A liquid pipe temperature sensor 35 that detects the temperature of the refrigerant (i.e., liquid pipe temperature) is disposed at the outlet on the main refrigerant circuit side of the subcooler 25. The merge circuit 65 of the bypass refrigerant circuit 61 is disposed with a bypass temperature sensor 63 for detecting the temperature of the refrigerant flowing from the outlet on the bypass refrigerant circuit side of the subcooler 25. An outdoor temperature sensor 36 that detects the temperature of the outdoor air that flows into the unit (i.e., outdoor temperature) is disposed at the outdoor air intake side of the outdoor unit 2. In the present embodiment, the suction temperature sensor 31, the discharge temperature sensor 32, the heat exchanger temperature sensor 33, the liquid side temperature sensor 34, the liquid pipe temperature sensor 35, the outdoor temperature sensor 36, and the bypass temperature sensor 63 comprise thermistors. In addition, the outdoor unit 2 includes an outdoor side control unit 37 that controls the operation of each portion forming the outdoor unit 2. Additionally, the outdoor side control unit 37 includes a microcomputer for controlling the outdoor unit 2, a memory, an inverter circuit that controls the motor 21*m*, and the like, and is configured such that it can exchange control signals and the like with the indoor side control units 47 and 57 of the indoor units 4 and 5 via the transmission line 8*a*. In other words, a control unit 8 that performs the operation control of the entire air conditioner 1 is formed by the indoor side control units 47 and 57, the outdoor side control unit 37, and the transmission line 8*a* that interconnects the control units 37, 47, and 57.

Figure 4:
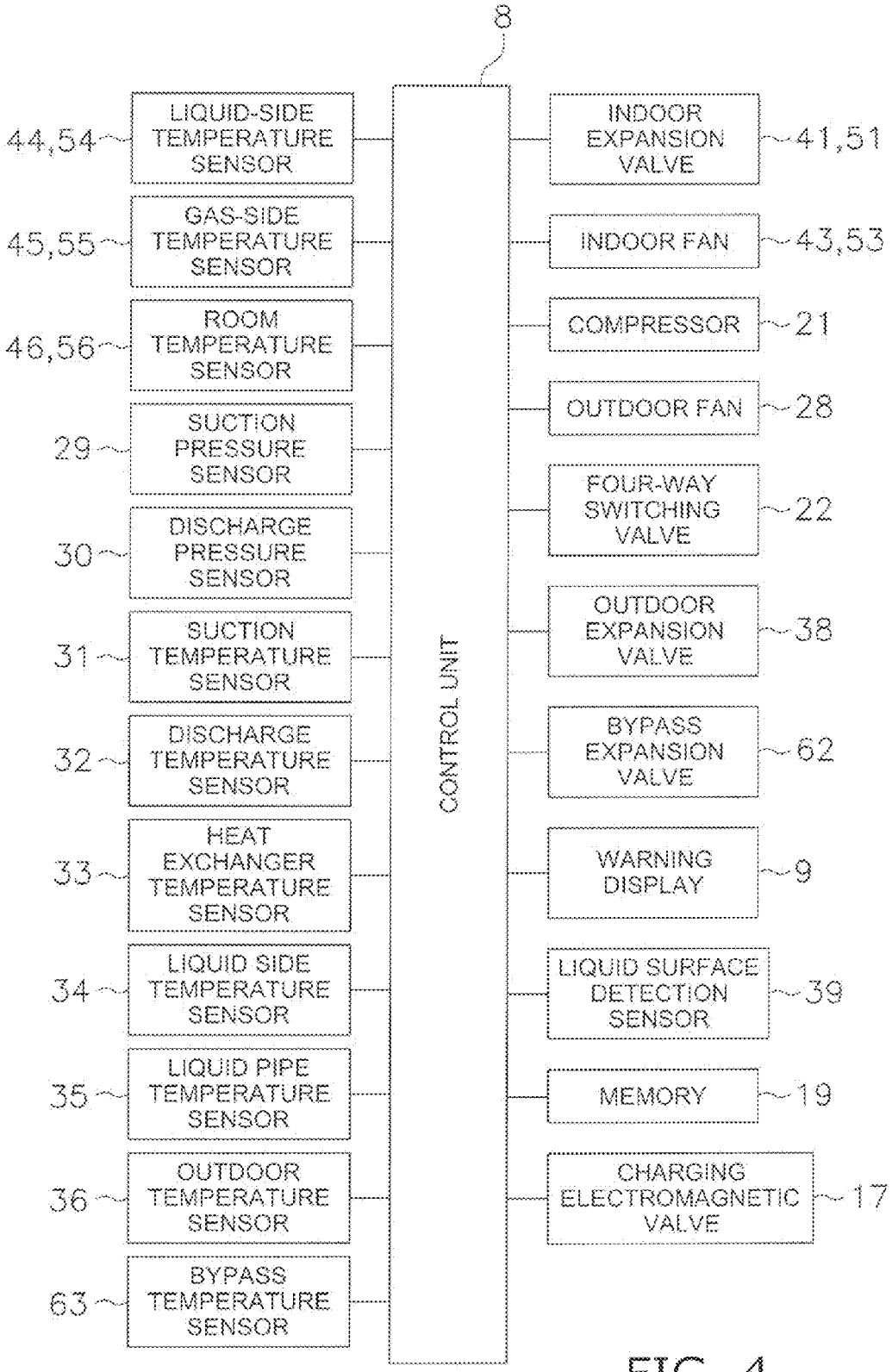
FIG. 4 is a control block diagram of the air conditioner.

As shown in FIG. 4, the control unit 8 is connected so as to be able to receive detection signals of sensors 29 to 36, 39, 44 to 46, 54 to 56, and 63 and also to be able to control various equipment and valves 21, 22, 24, 28*m*, 38, 41, 43*m*, 51, 53*m*, and 62 based on these detection signals and the like. Note that, as shown in FIG. 4, the control unit 8 has a memory 19 connected thereto, and reads out data stored in the memory 19 when performing various controls. Here, the data stored in the memory 19 includes, for example, data on the adequate amount of refrigerant in the refrigerant circuit 10 of the air conditioner 1 in each building, which is determined by taking into account the pipe length and the like after the air conditioner 1 is installed in the building. As described below, the control unit 8 reads out the date when performing a refrigerant automatic charging operation and a refrigerant leak detection operation to charge only an adequate amount of refrigerant to the refrigerant circuit 10. In addition, the memory 19 stores data on the determined amount of refrigerant in the liquid pipe (liquid pipe determined refrigerant amount Y) and data on the amount of refrigerant collected in the outdoor heat exchanger (outdoor heat exchange collected refrigerant amount X) besides the data on the adequate amount of refrigerant (adequate refrigerant amount Z), and the following relationship is satisfied: Z=X+Y. Here, the liquid pipe determined refrigerant amount Y is the amount of refrigerant kept in a portion from a downstream part of the outdoor heat exchanger 23 to the indoor expansion valves 41 and 51 via the outdoor expansion valve 38, the subcooler 25, and the liquid refrigerant communication pipe 6 and a portion from a branch portion downstream of the outdoor expansion valve 38 to the bypass expansion valve 62 when these portions are sealed in the below described operation by the liquid refrigerant whose temperature is constant (note that the refrigerant circuit 10 is designed such that the capacity of a portion from the outdoor expansion valve 38 to the subcooler 25 decreases, thus reducing the influence on judgment error). In addition, the outdoor heat exchange collected refrigerant amount X is the amount of refrigerant that is obtained by subtracting the liquid pipe determined refrigerant amount Y from the adequate refrigerant amount Z. Further, the memory 19 stores an expression from which the amount of refrigerant accumulated in a portion from the outdoor expansion valve 38 to the outdoor heat exchanger 23 can be calculated based on data on the liquid surface of the outdoor heat exchanger 23.

In addition, the control unit 8 has a warning display 9 connected thereto, which is formed by LEDs and the like and which indicates that a refrigerant leak is detected in the refrigerant leak detection operation (described below). Here, FIG. 4 is a control block diagram of the air conditioner 1.

<Refrigerant Communication Pipe>

The refrigerant communication pipes 6 and 7 are refrigerant pipes that are arranged on site when installing the air conditioner 1 at an installation site such as a building. As the refrigerant communication pipes 6 and 7, pipes having various lengths and diameters are used according to the installation conditions such as an installation site, combination of an outdoor unit and an indoor unit, and the like. Consequently, for example, when newly installing an air conditioner, it is necessary to charge an adequate amount of refrigerant to the air conditioner 1 according to the installation conditions such as the lengths, diameters, and the like of the refrigerant communication pipes 6 and 7.

As described above, the refrigerant circuit 10 of the air conditioner 1 is formed by the interconnection of the indoor side refrigerant circuits 10*a* and 10*b*, the outdoor side refrigerant circuit 10*c*, and the refrigerant communication pipes 6 and 7. Additionally, the control unit 8 formed by the indoor side control units 47 and 57 and the outdoor side control unit 37 allows the air conditioner 1 in the present embodiment to switch and operate between the cooling operation and the heating operation by the four-way switching valve 22 and to control each equipment of the outdoor unit 2 and the indoor units 4 and 5 according to the operation load of each of the indoor units 4 and 5.

(2) Operation of the Air Conditioner

Next, the operation of the air conditioner 1 in the present embodiment is described.

The operation modes of the air conditioner 1 in the present embodiment include: a normal operation mode where control of constituent equipment of the outdoor unit 2 and the indoor units 4 and 5 is performed according to the operation load of each of the indoor units 4 and 5; an adequate refrigerant amount automatic charging operation mode where an adequate amount of refrigerant is charged to the refrigerant circuit 10 when performing a test operation after installation or the like of constituent equipment of the air conditioner 1; and a refrigerant leak detection operation mode where the presence of a refrigerant leak from the refrigerant circuit 10 is judged after such a test operation is finished and the normal operation has started.

Operation in each operation mode of the air conditioner 1 is described below.

<Normal Operation Mode>

(Cooling Operation)

First, the cooling operation in the normal operation mode is described with reference to FIGS. 1 and 3.

During the cooling operation, the four-way switching valve 22 is in the state represented by the solid lines in FIG. 1, i.e., a state where the discharge side of the compressor 21 is connected to the gas side of the outdoor heat exchanger 23 and also the suction side of the compressor 21 is connected to the gas sides of the indoor heat exchangers 42 and 52 via the gas side shut-off valve 27 and the gaseous refrigerant communication pipe 7. Here, the outdoor expansion valve 38 and the bypass expansion valve 62 are in a fully opened state, and the liquid side shut-off valve 26 and the gas side shut-off valve 27 are also in an opened state.

When the compressor 21, the outdoor fan 28, the indoor fans 43 and 53 are started in this state of the refrigerant circuit 10, a low-pressure gaseous refrigerant is sucked into the compressor 21 and compressed into a high-pressure gaseous refrigerant. Subsequently, the high-pressure gaseous refrigerant is sent to the outdoor heat exchanger 23 via the four-way switching valve 22, exchanges heat with the outdoor air supplied by the outdoor fan 28, and is condensed into a high-pressure liquid refrigerant. Then, this high-pressure liquid refrigerant passes through the outdoor expansion valve 38, flows into the subcooler 25, exchanges heat with the refrigerant flowing in the bypass refrigerant circuit 61, is further cooled, and becomes subcooled. At this time, a portion of the high-pressure liquid refrigerant condensed in the outdoor heat exchanger 23 is branched into the bypass refrigerant circuit 61 and is depressurized by the bypass expansion valve 62. Subsequently, it is returned to the suction side of the compressor 21. Here, the refrigerant that passes through the bypass expansion valve 62 is depressurized close to the suction pressure of the compressor 21 and thereby a portion of the refrigerant evaporates. Then, the refrigerant flowing from the outlet of the bypass expansion valve 62 of the bypass refrigerant circuit 61 toward the suction side of the compressor 21 passes through the subcooler 25 and exchanges heat with the high-pressure liquid refrigerant sent from the outdoor heat exchanger 23 on the main refrigerant circuit side to the indoor units 4 and 5.

Then, the high-pressure liquid refrigerant that has become subcooled is sent to the indoor units 4 and 5 via the liquid side shut-off valve 26 and the liquid refrigerant communication pipe 6.

The high-pressure liquid refrigerant sent to the indoor units 4 and 5 is depressurized close to the suction pressure of the compressor 21 by the indoor expansion valves 41 and 51, becomes refrigerant in a low-pressure gas-liquid two-phase state, is sent to the indoor heat exchangers 42 and 52, exchanges heat with the room air in the indoor heat exchangers 42 and 52, and evaporates into a low-pressure gaseous refrigerant.

This low-pressure gaseous refrigerant is sent to the outdoor unit 2 via the gaseous refrigerant communication pipe 7, and flows into the accumulator 24 via the gas side shut-off valve 27 and the four-way switching valve 22. Then, the low-pressure gaseous refrigerant that flowed into the accumulator 24 is again sucked into the compressor 21.

Figure 5:
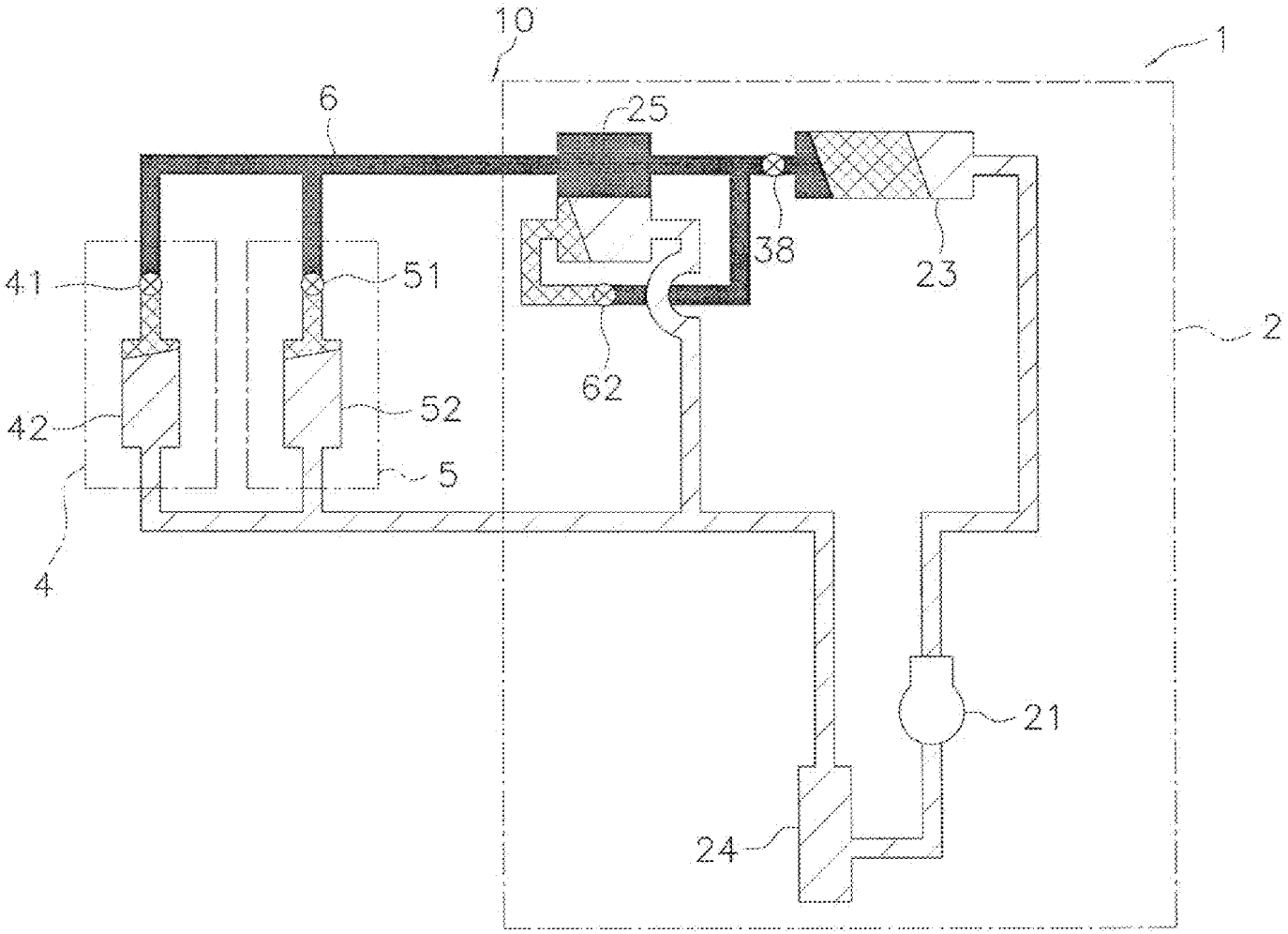
FIG. 5 is a schematic view showing a state of the refrigerant flowing in a refrigerant circuit.

Here, as for the distribution state of the refrigerant in the refrigerant circuit 10 during the cooling operation, the refrigerant in each of the liquid state, gas-liquid two-phase state, and gaseous state is distributed as shown in FIG. 5. Specifically, provided that an area between a portion upstream of the outdoor expansion valve 38 and a downstream part of the outdoor heat exchanger 23 is taken as a base point, a portion from the base point to upstream of the indoor expansion valves 41 and 51 including the subcooler 25 and the liquid refrigerant communication pipe 6 of the main refrigerant circuit, and a portion from the base point to upstream of the bypass expansion valve 62 are filled with the liquid state refrigerant. A portion from the indoor expansion valves 41 and 51 to a mid part of the indoor heat exchangers 42 and 52, a portion from the bypass expansion valve 62 to downstream of the bypass refrigerant circuit 61 connected to the subcooler 25, and a portion corresponding to a middle part (upstream of the liquid portion) of the outdoor heat exchanger 23 are filled with the gas-liquid two-phase state refrigerant. Further, other portions in the refrigerant circuit 10 are filled with the gaseous refrigerant. Specifically, provided that an upstream part of each of the indoor heat exchangers 42 and 52 is taken as a base point and that an upstream part of the subcooler 25 to which the bypass refrigerant circuit 61 is connected is taken as another base point, a portion from these base points to an upstream part of the outdoor heat exchanger 23 including the gaseous refrigerant communication pipe 7 in the main refrigerant circuit, a downstream part of the bypass refrigerant circuit 61, the accumulator 24, and the compressor 21 is filled with the gaseous refrigerant.

Note that, although the refrigerant is distributed in the refrigerant circuit 10 in the above described manner during a normal cooling operation, the refrigerant is distributed in a manner such that the liquid refrigerant is collected in the liquid refrigerant communication pipe 6 and the outdoor heat exchanger 23 during a cooling operation in the adequate amount automatic charging operation and the refrigerant leak detection operation (described below).

(Heating Operation)

Next, the heating operation in the normal operation mode is described.

During the heating operation, the four-way switching valve 22 is in a state represented by the dotted lines in FIG. 1, i.e., a state where the discharge side of the compressor 21 is connected to the gas sides of the indoor heat exchangers 42 and 52 via the gas side shut-off valve 27 and the gaseous refrigerant communication pipe 7 and also the suction side of the compressor 21 is connected to the gas side of the outdoor heat exchanger 23. The opening degree of the outdoor expansion valve 38 is adjusted so as to be able to depressurize the refrigerant that flows into the outdoor heat exchanger 23 to a pressure where the refrigerant can evaporate (i.e., evaporation pressure) in the outdoor heat exchanger 23. In addition, the liquid side shut-off valve 26 and the gas side shut-off valve 27 are in an opened state. The opening degree of each of the indoor expansion valves 41 and 51 is adjusted such that the subcooling degree of the refrigerant at the outlet of each or the indoor heat exchangers 42 and 52 becomes constant. In the present embodiment, the subcooling degree of the refrigerant at the outlet of each of the indoor heat exchangers 42 and 52 is detected by converting the discharge pressure of the compressor 21 detected by the discharge pressure sensor 30 to the saturated temperature corresponding to the condensation temperature, and subtracting the refrigerant temperature detected by the respective liquid side temperature sensors 44 and 54 from this saturated temperature of the refrigerant. In addition, the bypass expansion valve 62 is closed.

When the compressor 21, the outdoor fan 28, the indoor fans 43 and 53 are started in this state of the refrigerant circuit 10, the low-pressure gaseous refrigerant is sucked into the compressor 21, compressed into a high-pressure gaseous refrigerant, and sent to the indoor units 4 and 5 via the four-way switching valve 22, the gas side shut-off valve 27, and the gaseous refrigerant communication pipe 7.

Then, the high-pressure gaseous refrigerant sent to the indoor units 4 and 5 exchanges heat with the room air in the respective indoor heat exchangers 42 and 52 and is condensed into a high-pressure liquid refrigerant. Subsequently, the high-pressure gaseous refrigerant is depressurized according to the opening degree of the indoor expansion valves 41 and 51 when passing through the respective indoor expansion valves 41 and 51.

The refrigerant that passed through the indoor expansion valves 41 and 51 is sent to the outdoor unit 2 via the liquid refrigerant communication pipe 6, is further depressurized via the liquid side shut-off valve 26, the subcooler 25, and the outdoor expansion valve 38, and then flows into the outdoor heat exchanger 23. Then, the refrigerant in a low-pressure gas-liquid two-phase state that flowed into the outdoor heat exchanger 23 exchanges heat with the outdoor air supplied by the outdoor fan 28, evaporates into a low-pressure gaseous refrigerant, and flows into the accumulator 24 via the four-way switching valve 22. Then, the low-pressure gaseous refrigerant that flowed into the accumulator 24 is again sucked into the compressor 21.

Such operation control as described above in the normal operation mode is performed by the control unit 8 (more specifically, the indoor side control units 47 and 57, the outdoor side control unit 37, and the transmission line 8*a* that connects between the control units 37, 47 and 57) that functions as normal operation controlling means to perform the normal operation that includes the cooling operation and the heating operation.

<Adequate Refrigerant Amount Automatic Charging Operation Mode>

Here, the adequate refrigerant amount automatic charging operation mode is described.

The adequate refrigerant amount automatic charging operation mode is an operation mode that is performed at the time of the test operation after installation or the like of constituent equipment of the air conditioner 1. In this mode, an adequate amount of refrigerant according to the capacities of the liquid refrigerant communication pipe 6 and the gaseous refrigerant communication pipe 7 is automatically charged to the refrigerant circuit 10.

First, the liquid side shut-off valve 26 and the gas side shut-off valve 27 of the outdoor unit 2 are opened and the refrigerant circuit 10 is filled with the refrigerant that is charged in the outdoor unit 2 in advance.

Next, a worker performing the adequate refrigerant amount automatic charging operation connects a refrigerant cylinder 15 for additional charging to a charging electromagnetic valve 17 of the refrigerant circuit 10. Thereby, the refrigerant cylinder 15 is set to a state communicating with the suction side of the compressor 21 via a charging pipe 16, and consequently a state is reached where the refrigerant can be charged to the refrigerant circuit 10. The charging electromagnetic valve 17 is configured capable of controlling the charging amount from the refrigerant cylinder 15 as the charging electromagnetic valve 17 is connected to the outdoor side control unit 37 and the opening degree of the valve thereof is controlled. At the step of connecting the refrigerant cylinder 15 to the charging electromagnetic valve 17, the charging electromagnetic valve 17 is in a closed state.

Note that a charging point in the refrigerant circuit is not limited to the above. For example, a service port capable of charging refrigerant from the vicinity of the gas side shut-off valve 27 may be disposed at the time of charging. In addition, the charging electromagnetic valve 17 used here may be configured in either ways: to be only capable of being opened and closed as an electromagnetic valve or to be also capable of adjusting the flow rate as an electromagnetic valve.

Figure 6:
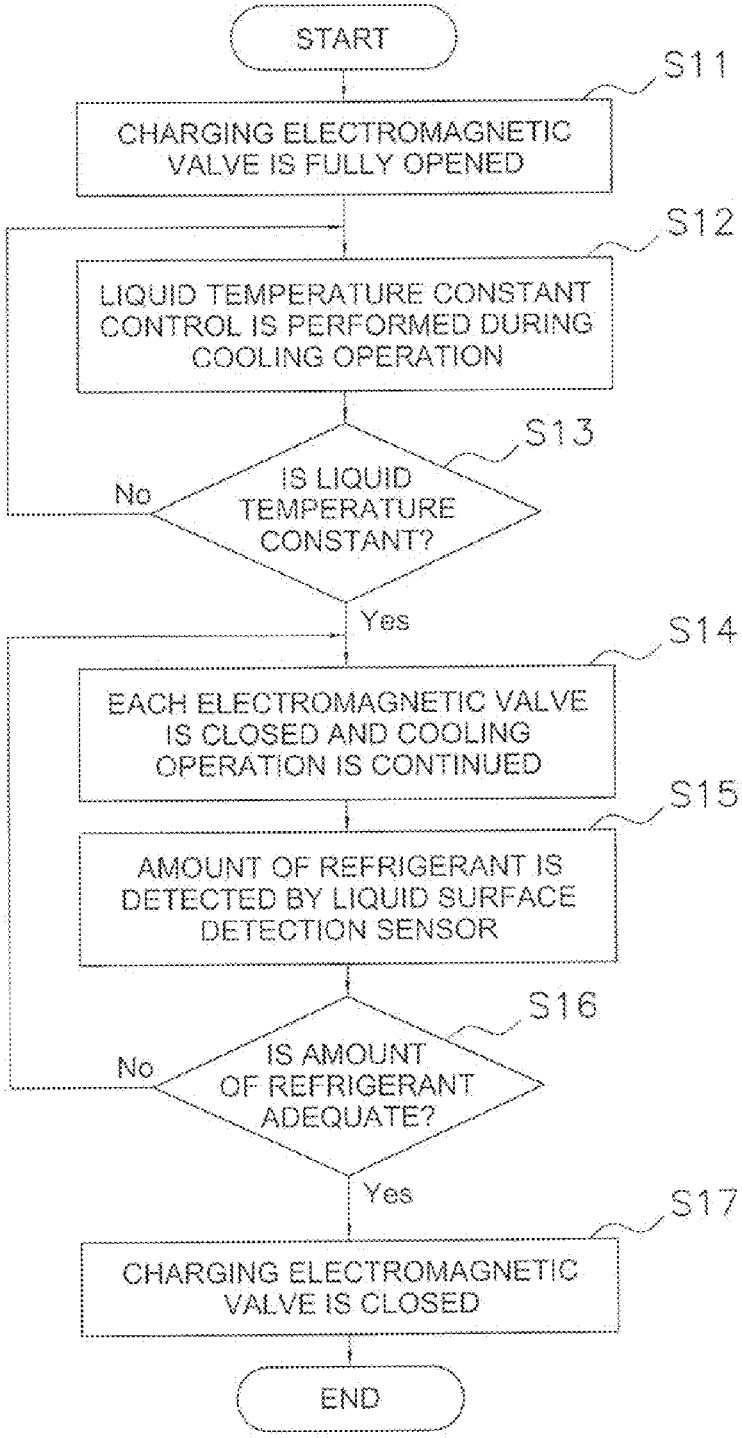
FIG. 6 is a flow chart of an adequate refrigerant amount charging operation.

Then, when a worker issues a command to start the adequate refrigerant amount automatic charging operation to the control unit 8 directly or by using a remote controller (not shown) or the like, the control unit 8 starts the process from step S11 to step S17 shown in FIG. 6. Here, FIG. 6 is a flow chart of the adequate refrigerant amount automatic charging operation. Below, each step is described in the order.

In step S11, the control unit 8 fully opens the charging electromagnetic valve 17 when the connection of the refrigerant cylinder 15 to the charging electromagnetic valve 17 is finished.

In step S12, the control unit 8 performs the same operation as the cooling operation in the above described normal operation mode. Specifically, a state is reached where the four-way switching valve 22 of the outdoor unit 2 is as indicated by the solid lines in FIG. 1 and the indoor expansion valves 41 and 51 of the indoor units 4 and 5 and the outdoor expansion valve 38 are opened, and in that state, the compressor 21, the outdoor fan 28, and the indoor fans 43 and 53 are started, and the cooling operation is forcibly performed in both of the indoor units 4 and 5. Thereby, the refrigerant contained in the refrigerant cylinder 15 is progressively charged into the refrigerant circuit 10 via the charging electromagnetic valve 17 and the charging pipe 16.

In addition, in step S12, the control unit 8 simultaneously performs the above described cooling operation and a liquid temperature constant control. In the liquid temperature constant control, a condensation pressure control and a liquid pipe temperature control are performed.

In the condensation pressure control, the flow rate of the outdoor air supplied by the outdoor fan 28 to the outdoor heat exchanger 23 is controlled such that the condensation pressure of the refrigerant in the outdoor heat exchanger 23 becomes constant. Because the condensation pressure of the refrigerant in the condenser changes greatly due to the effect of the outdoor temperature, the flow rate of the indoor air supplied from the outdoor fan 28 to the outdoor heat exchanger 23 is controlled by the motor 28*m*. Consequently, the condensation pressure of the refrigerant in the outdoor heat exchanger 23 becomes constant, and the state of the refrigerant flowing through the condenser will be stabilized. Accordingly, a state is achieved where a high pressure liquid refrigerant flows in the flow path from the outdoor heat exchanger 23 to the indoor expansion valves 41 and 51 including the outdoor expansion valve 38, the main refrigerant circuit side of the subcooler 25, and the liquid refrigerant communication pipe 6 and the flow path from the outdoor heat exchanger 23 to the bypass expansion valve 62 of the bypass refrigerant circuit 61. Thus, the pressure of the refrigerant in a portion from the outdoor heat exchanger 23 to the indoor expansion valves 41 and 51 and to the bypass expansion valve 62 also becomes stabilized, and the portion is sealed by the liquid refrigerant, thereby becoming a stable state. Note that, in the condensation pressure control, the discharge pressure of the compressor 21 which is detected by the discharge pressure sensor 30 or the temperature of the refrigerant flowing through the outdoor heat exchanger 23 which is detected by a heat exchange temperature sensor 33 is used.

In the liquid pipe temperature control, the performance of the subcooler 25 is controlled such that the temperature of the refrigerant sent from the subcooler 25 to the indoor expansion valves 41 and 51 becomes constant. Accordingly, the density of the refrigerant in the refrigerant pipes from the subcooler 25 to the indoor expansion valves 41 and 51 including the liquid refrigerant communication pipe 6 can be stabilized. Here, the performance of the subcooler 25 is controlled so as to increase or decrease the flow rate of the refrigerant flowing in the bypass refrigerant circuit 61 such that the refrigerant temperature detected by the liquid pipe temperature sensor 35 becomes constant. Accordingly, the amount of heat exchange between the refrigerant flowing on the main refrigerant circuit side of the subcooler 25 and the refrigerant flowing on the bypass refrigerant circuit side is adjusted. Note that, the flow rate of the refrigerant flowing in the bypass refrigerant circuit 61 is increased or decreased as the control unit 8 adjusts the opening degree of the bypass expansion valve 62.

In step S13, the control unit 8 judges whether or not the liquid temperature has become constant by the liquid temperature constant control in step S12 above. Here, if it is judged that the liquid temperature is constant, the process proceeds to step S14. On the other hand, if it is judged that the liquid temperature has not become constant, the process returns to step S12 to continue the liquid temperature constant control.

When the liquid temperature is controlled to be constant by the liquid temperature constant control, the liquid portion in the refrigerant circuit 10 which is indicated by the black area in FIG. 5 is stably sealed by the liquid refrigerant whose temperature is constant. The black area specifically includes: a portion from a downstream part of the outdoor heat exchanger 23 to the indoor expansion valves 41 and 51 via the outdoor expansion valve 38, the subcooler 25, and the liquid refrigerant communication pipe 6, and a portion from a branch portion downstream of the outdoor expansion valve 38 to the bypass expansion valve 62. Accordingly, a state is achieved where the cooling operation of the refrigerant circuit 10 is stably performed while the amount of refrigerant corresponding to a value of the liquid pipe determined refrigerant amount Y stored in the memory 19 is always kept in the black area shown in FIG. 5.

Figure 7:
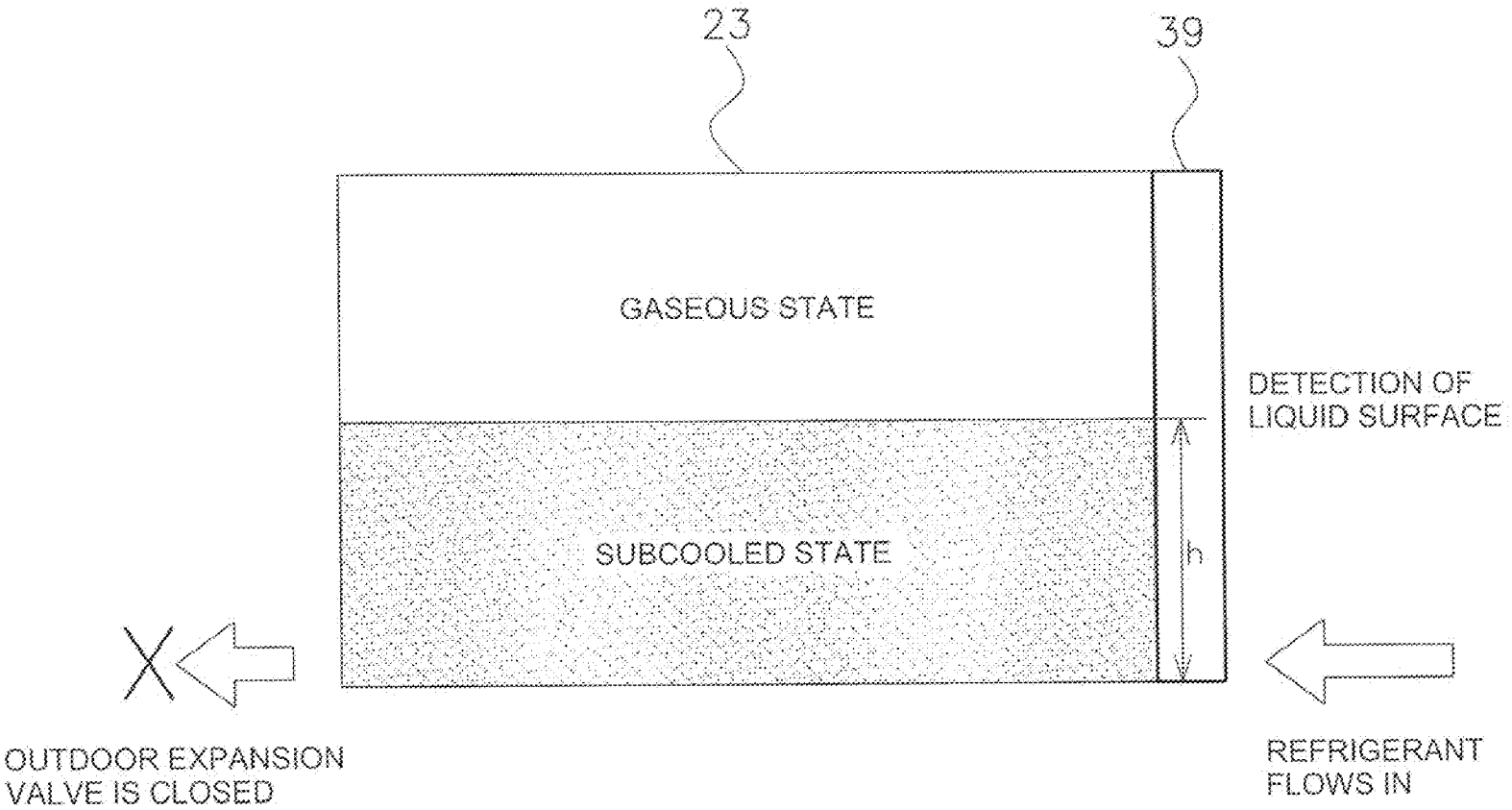
FIG. 7 is a view showing how the refrigerant accumulates in the outdoor heat exchanger by closing an outdoor expansion valve.
Figure 8:
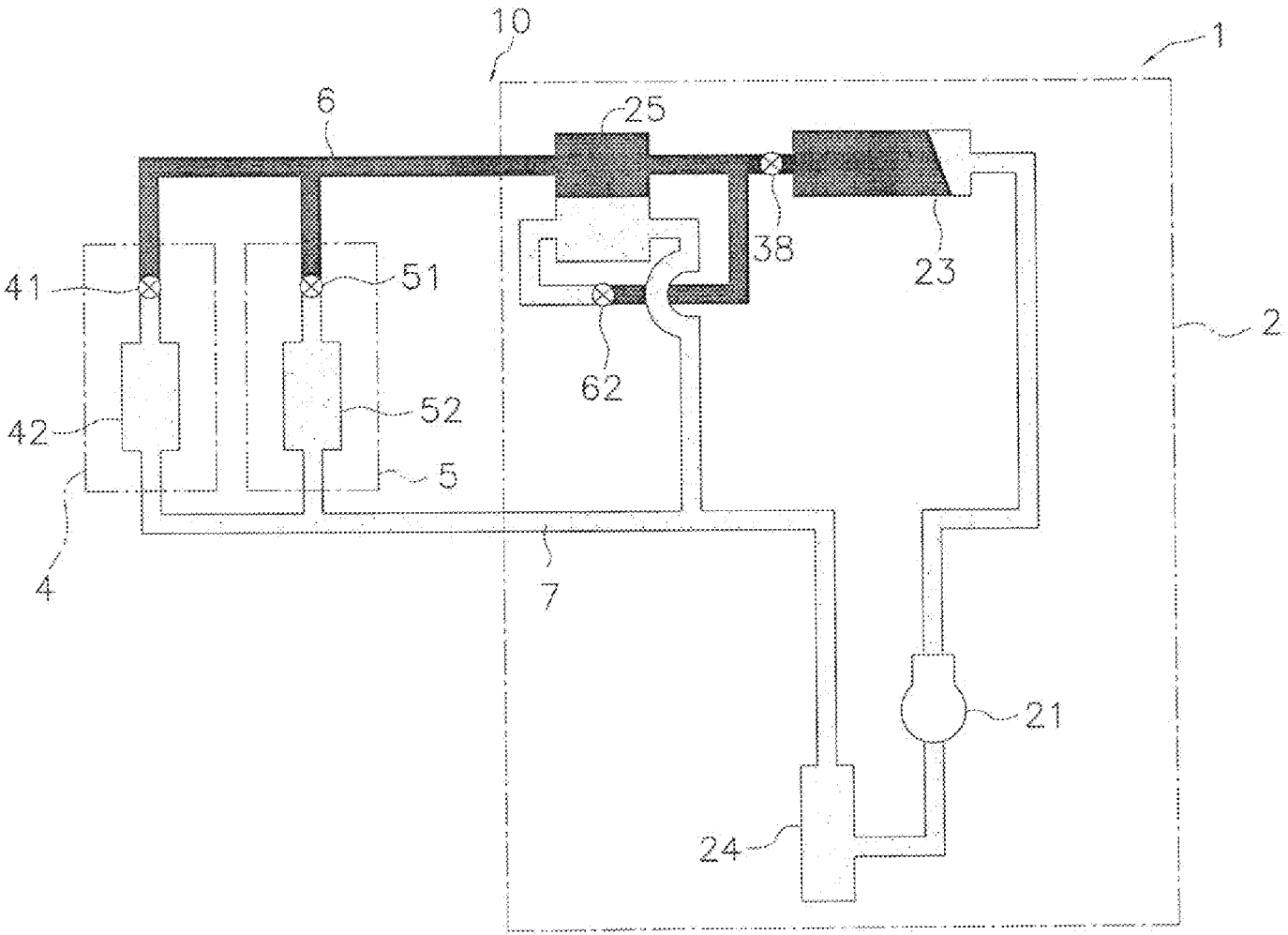
FIG. 8 is a schematic view showing a state of the refrigerant when the refrigerant is collected in the outdoor heat exchanger.

In step S14, because it has been determined that the liquid temperature is constant, the control unit 8 closes the indoor expansion valves 41 and 51, the bypass expansion valve, and the outdoor expansion valve 38 in that order. Accordingly, it is possible to stop the refrigerant circulation while keeping the amount of refrigerant corresponding to the liquid pipe determined refrigerant amount Y, and to accumulate the refrigerant whose amount is exactly equal to the liquid pipe determined refrigerant amount Y in the above described portion. Note that the compressor 21 and the outdoor fan 28 are continued to be operated even after each expansion valve is closed. Accordingly, as shown in FIG. 8, the portion from the indoor expansion valves 41 and 51 to the suction side of the compressor 21 is depressurized, and consequently there will be hardly any refrigerant in the indoor heat exchangers 42 and 52, the gaseous refrigerant communication pipe 7, and the accumulator 24. In addition, as shown in FIG. 8, the refrigerant discharged from the discharge side of the compressor 21 exchanges heal in the outdoor heat exchanger 23 with the outdoor air sent from the outdoor fan 28; the gaseous state refrigerant is liquefied; and the liquid refrigerant accumulates from upstream of the outdoor expansion valve 38 to the outdoor heat exchanger 23 (see FIG. 7).

Here, as the outdoor fan 28 continues to rotate, the outdoor heat exchanger 23 continuously exchanges heat with the outdoor air sent from the outdoor fan 28. Consequently, first, in the outdoor heat exchanger 23, a high temperature gaseous refrigerant that flows thereinto from the compressor 21 exchanges heat with the outdoor air and consequently the high temperature gaseous refrigerant is cooled to about the outside air temperature while maintaining its gaseous state (sensible heat transfer). Then, the gaseous refrigerant exchanges more heat with the outdoor air and consequently the gaseous refrigerant is condensed, while maintaining its temperature constant, into a liquid refrigerant after passing through a gas-liquid two-phase state (latent heat transfer). In addition, because the refrigerant circulation is stopped, actually, as shown in FIG. 7, the liquid state refrigerant accumulates in the portion from upstream of the outdoor expansion valve 38 to the lower portion of the outdoor heat exchanger 23.

In step S15, the control unit 8 detects the liquid surface of the refrigerant accumulated in the outdoor heat exchanger 23 by the liquid surface detection sensor 39. Here, the liquid surface detection sensor 39 detects the liquid surface of the liquid refrigerant, taking a boundary between the area where the temperature does not change due to the above described latent heat transfer and the area where the temperature changes due to the above described sensible heat transfer as the liquid surface of the liquid refrigerant. Accordingly, the control unit 8 substitutes a liquid surface height h obtained by the liquid surface detection sensor 39 (see FIG. 7) into an expression stored in the memory 19 and thereby calculates the amount of refrigerant accumulated in the portion from the outdoor expansion valve 38 to the outdoor heat exchanger 23.

In step S16, the control unit 8 judges whether or not the amount of refrigerant calculated in step S15 above has reached a value of the outdoor heat exchange collected refrigerant amount X according to the data stored in the memory 19. Here, when the amount of refrigerant has not reached the outdoor heat exchange collected refrigerant amount X, the process returns to step S14 to continue refrigerant charging to the refrigerant circuit 10. On the other hand, when it is judged that the amount of refrigerant has reached the outdoor heat exchange collected refrigerant amount X, the process proceeds to step S17.

In step S17, the control unit 8 judges that an adequate amount of refrigerant has been charged to the refrigerant circuit 10, and closes the charging electromagnetic valve 17 in order to stop refrigerant charging from the refrigerant cylinder 15 to the refrigerant circuit 10. Accordingly, the adequate refrigerant amount Z which is the sum of the liquid pipe determined refrigerant amount Y and the outdoor heat exchange collected refrigerant amount X is charged in the refrigerant circuit 10. Then, the charging electromagnetic valve 17 is closed, the refrigerant cylinder 15 is removed, and the adequate refrigerant amount automatic charging operation is finished.

<Refrigerant Leak Detection Operation Mode>

Next, the refrigerant leak detection operation mode is described.

The refrigerant leak detection operation mode is substantially the same as the adequate refrigerant amount automatic charging operation, so that only differences are described.

In the present embodiment, the refrigerant leak detection operation mode is an operation that is performed, for example, periodically (during a period of time such as on a holiday or in the middle of the night when air conditioning is not needed or the like), to detect whether or not the refrigerant in the refrigerant circuit 10 is leaking to the outside due to an unforeseen factor.

In the refrigerant leak detection operation, the process of the above described flow chart for the described adequate refrigerant amount automatic charging operation is performed except for step S11 and step S17.

Specifically, the control unit 8 performs the cooling operation and the liquid temperature constant control in the refrigerant circuit 10, and closes the indoor expansion valves 41 and 51, the bypass expansion valve 62, and the outdoor expansion valve 38 when the liquid temperature becomes constant to determine the liquid pipe determined refrigerant amount Y. Then, the control unit 8 accumulates the liquid refrigerant in the outdoor heat exchanger 23 by continuing the cooling operation.

Here, when the liquid surface height h-detected by the liquid surface detection sensor 39 remains the same for a predetermined period of time, the control unit 8 substitutes the liquid surface height h at that time into an expression stored in the memory 19 and thereby calculates a judged liquid refrigerant amount X' accumulated in the portion from the outdoor expansion valve 38 to the outdoor heat exchanger 23. Here, the presence of a refrigerant leak from the refrigerant circuit 10 is judged by adding the liquid pipe determined refrigerant amount Y to the judged liquid refrigerant amount X' that is calculated and determining whether or not the sum reaches the adequate refrigerant amount Z.

Note that the operation of the compressor 21 is quickly stopped after the liquid surface height h remains the same for a predetermined period of time and the data on the liquid surface height h is obtained. Thereby, the refrigerant leak detection operation is finished.

In addition, a method to judge the refrigerant leak detection here is not limited to the above described method in which the judged liquid refrigerant amount X' is calculated. The refrigerant leak detection may be performed by, for example, calculating a standard liquid surface height H in advance which corresponds to the optimal amount of refrigerant and storing the value in the memory 19 and thus directly comparing the detected liquid height h with the standard liquid surface height H which serves as an index, without the need to calculate the judged liquid refrigerant amount X' as described above.

(3) Characteristics of the Air Conditioner

The air conditioner 1 in this embodiment has the following characteristics.

(A)

In the air conditioner 1 in this embodiment, the refrigerant flow is shut off by the outdoor expansion valve 38 when the cooling operation is performed, and consequently the liquid refrigerant accumulates in the outdoor heat exchanger 23 that functions as a condenser of the refrigerant. Then, the amount of refrigerant can be kept at the liquid pipe determined refrigerant amount Y by sealing the portion from the outdoor expansion valve 38 to the indoor expansion valves 41 and 51 and to the bypass expansion valve 62 by the liquid refrigerant having a predetermined temperature by performing the liquid temperature constant control. On the other hand, as the compressor 21 is driven in the refrigeration operation, the density of the refrigerant in other portions in the refrigerant circuit 10 will be extremely low and there will be hardly any refrigerant.

Accordingly, simply by performing the liquid temperature constant control, it is possible to charge an adequate amount of refrigerant to the refrigerant circuit 10 and determine a surplus or shortage of the amount of refrigerant for detecting a refrigerant leak while simplifying conditions for making a judgment as to the amount of refrigerant.

For example, the need to perform conventional types of control, such as controlling the pressure on the suction side of the compressor 21 in the refrigerant circuit 10 to be constant, is eliminated. Consequently, it is possible to expand the conditions for performing the adequate refrigerant amount automatic charging operation and the refrigerant leak detection operation, compared to the conventional conditions. In addition, because the indoor heat exchangers 42 and 52 are not operated but only depressurized, there is no risk of the indoor units 4 and 5 being frozen when performing the adequate refrigerant amount automatic charging operation and the refrigerant leak detection operation.

(B)

In the air conditioner 1 in this embodiment, there will be no refrigerant not only in the indoor heat exchangers 42 and 52 and the liquid refrigerant communication pipe 7 but also in the accumulator 24 by closing the indoor expansion valves 41 and 52 and the bypass expansion valve 62 while continuing the operation of the compressor 21.

Consequently, hardly any refrigerant will accumulate in the accumulator 24 regardless of the outside air temperature. Therefore, it is possible to effectively reduce error in detection of the amount of refrigerant.

(4) Second Embodiment

The refrigerant circuit formed by the interconnection of the indoor side refrigerant circuits 10*a* and 10*b*, the outdoor side refrigerant circuit 10*c*, and the refrigerant communication pipes 6 and 7 and including one outdoor unit is taken as an example of the refrigerant circuit 10 of the air conditioner 1 in the above described first embodiment.

However, the present invention is not limited thereto. For example, the refrigerant circuit may have a configuration in which a plurality of outdoor units are arranged in parallel, as in an air conditioner of a second embodiment described below.

Figure 10:
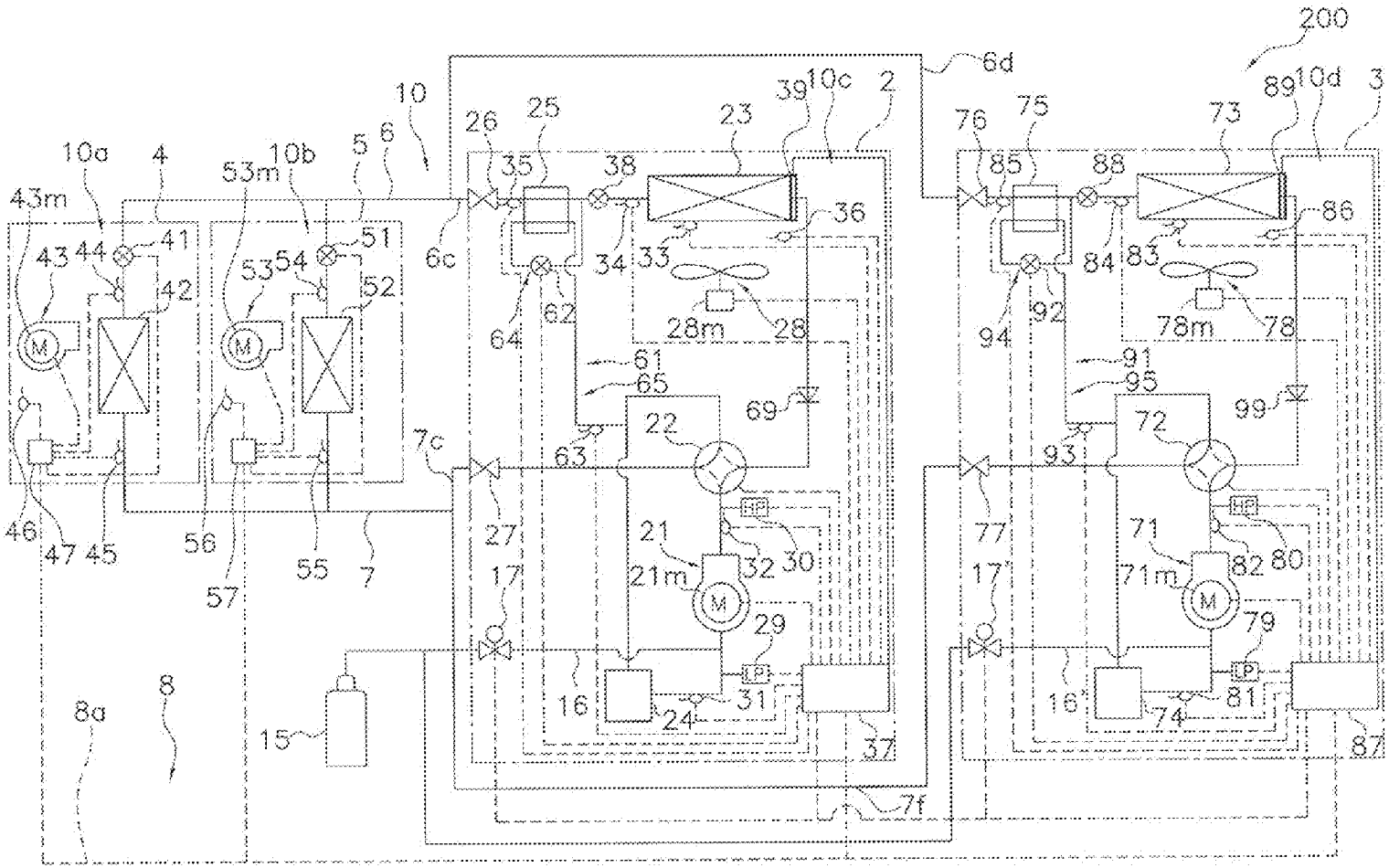
FIG. 10 is a schematic configuration diagram of an air conditioner according to a second embodiment in which a plurality of outdoor heat exchangers are installed.

Specifically, for example, as shown in FIG. 10, an air conditioner 200 having two heat source units, i.e., the outdoor unit 2 and an outdoor unit 3, is described as an example.

<Indoor Unit>

The indoor units 4 and 5 have the same configurations as those in the above described first embodiment, and thus the descriptions thereof are omitted.

<Outdoor Unit>

The outdoor units 2 and 3 are installed outside of a building and the like, and connected in parallel to the indoor units 4 and 5 via the liquid refrigerant communication pipe 6 and the gaseous refrigerant communication pipe 7, forming the refrigerant circuit 10 with the indoor units 4 and 5.

Note that the configuration of the outdoor unit 2 is the same as that in the above described first embodiment, and thus the description thereof is omitted.

Next, the configuration of the outdoor unit 3 is described. The outdoor unit 3 mainly includes an outdoor side refrigerant circuit 10*d* that forms a part of the refrigerant circuit 10. This outdoor side refrigerant circuit 10*d* mainly includes a compressor 71, a four-way switching valve 72, an outdoor heat exchanger 73 as a heat source side heat exchanger, an outdoor expansion valve 88 as an expansion mechanism, an accumulator 74, a subcooler 75 as a temperature adjustment mechanism, a liquid side shut-off valve 76, and a gas side shut-off valve 77.

The compressor 71 is a compressor whose operation capacity can be varied, and in the present embodiment, is a positive displacement-type compressor driven by a motor 71*m* whose rotation speed is controlled by an inverter.

The four-way switching valve 72 is a valve for switching the direction of the refrigerant flow such that, during the cooling operation, the four-way switching valve 72 is capable of connecting the discharge side of the compressor 71 to the gas side of the outdoor heat exchanger 73 while connecting the suction side of the compressor 71 (specifically, the accumulator 74) to the gaseous refrigerant communication pipe 7 (see the solid lines of the four-way switching valve 22 in FIG. 10) to cause the outdoor heat exchanger 73 to function as a condenser of the refrigerant compressed in the compressor 71 and to cause the indoor heat exchangers 42 and 52 to function as evaporators of the refrigerant condensed in the outdoor heat exchanger 73; and such that, during the heating operation, the four-way switching valve 72 is capable of connecting the discharge side of the compressor 71 to the gaseous refrigerant communication pipe 7 while connecting the suction side of the compressor 71 to the gas side of the outdoor heat exchanger 73 (see the dotted lines of the four-way switching valve 72 in FIG. 10) to cause the indoor heat exchangers 42 and 52 to function as condensers of the refrigerant compressed in the compressor 71 and to cause the outdoor heat exchanger 73 to function as an evaporator of the refrigerant condensed in the indoor heat exchangers 42 and 52.

Note that, like the outdoor heat exchanger 23 shown in FIG. 2, the outdoor heat exchanger 73 in the second embodiment is a so-called fin and tube type heat exchanger having a header, branching capillaries, and flat pipes. Note that, as the heat exchanger in the refrigerant circuit of the second embodiment to which the present invention is applied, it is not limited to such a fin and tube type heat exchanger. For example, it can be a plate type heat exchanger, or the like (for example, see FIG. 9). In addition, a liquid surface detection sensor 89 that detects the amount of condensed liquid refrigerant is provided also to a lateral side of the outdoor heat exchanger 73. The liquid surface detection sensor 89 is a sensor for detecting the amount of liquid refrigerant accumulated in the outdoor heat exchanger 73, and is formed by a tubular detection member. As in the case of the first embodiment, the liquid surface detection sensor 89 detects a boundary between the area where the refrigerant exists in a gaseous state and the area where the refrigerant exists in a liquid state as the liquid surface. Note that, here, the liquid surface detection sensor 89 may be, for example, a sensor that detects the amount of liquid refrigerant accumulated in the outdoor heat exchanger 73 in which the sensor includes thermistors disposed at a plurality of locations along the height direction of the outdoor heat exchanger 73 and detects a boundary between a superheated portion of the gaseous refrigerant whose temperature is higher than the outside air temperature and a portion of the liquid refrigerant whose temperature is substantially equal to the outside air temperature as the liquid surface.

In the present embodiment, the outdoor expansion valve 88 is an electric expansion valve connected to the liquid side of the outdoor heat exchanger 73 in order to adjust the pressure, flow rate, or the like of the refrigerant flowing in the outdoor side refrigerant circuit 10*d*, and the outdoor expansion valve 88 can be brought to a completely closed state.

In the present embodiment, the outdoor unit 3 includes an outdoor fan 78 as a ventilation fan for taking in the outdoor air into the unit and discharging the air to the outside after heat exchange with the refrigerant in the outdoor heat exchanger 73. The outdoor fan 78 is a fan capable of varying the flow rate of the air supplying to the outdoor heat exchanger 73, and in the present embodiment, is a propeller fan or the like driven by a motor 78*m* comprising a DC fan motor.

The accumulator 74 is connected between the four-way switching valve 72 and the compressor 71, and is a container capable of accumulating excess refrigerant generated in the refrigerant circuit 10 in accordance with the change in the operation load of the indoor units 4 and 5 and the like.

In the present embodiment, the subcooler 75 is a double tube heat exchanger, and is disposed to cool the refrigerant to be sent to the indoor expansion valves 41 and 51 after the refrigerant is condensed in the outdoor heat exchanger 73. In the present embodiment, the subcooler 75 is connected between the outdoor expansion valve 88 and the liquid side shut-off valve 76.

In the present embodiment, a bypass refrigerant circuit 91 as a cooling source of the subcooler 75 is disposed. Note that, in the description below, a portion corresponding to the refrigerant circuit 10 excluding the bypass refrigerant circuit 91 is referred to as a main refrigerant circuit for convenience sake.

The bypass refrigerant circuit 91 is connected to the main refrigerant circuit so as to so as to branch a portion of the refrigerant sent from the outdoor heat exchanger 73 to the indoor expansion valves 41 and 51 from the main refrigerant circuit and to return the branched refrigerant to the suction side of the compressor 71. Specifically, the bypass refrigerant circuit 71 includes a branch circuit 94 connected so as to branch a portion of the refrigerant sent from the outdoor expansion valve 88 to the indoor expansion valves 41 and 51 at a position between the outdoor heat exchanger 73 and the subcooler 75, and a merge circuit 95 connected to the suction side of the compressor 71 so as to return a portion of the refrigerant from the outlet on the bypass refrigerant circuit side of the subcooler 75 to the suction side of the compressor 71. Further, the branch circuit 94 is disposed with a bypass expansion valve 92 for adjusting the flow rate of the refrigerant flowing in the bypass refrigerant circuit 91. Here, the bypass expansion valve 92 comprises an electrically operated expansion valve. Accordingly, the refrigerant sent from the outdoor heat exchanger 73 to the indoor expansion valves 41 and 51 is cooled in the subcooler 75 by the refrigerant flowing in the bypass refrigerant circuit 91 which has been depressurized by the bypass expansion valve 92. In other words, the performance of the subcooler 75 is controlled by adjusting the opening degree of the bypass expansion valve 92.

The liquid side shut-off valve 76 and the gas side shut-off valve 77 are valves disposed at connection ports to the external equipment and pipes (specifically, a liquid refrigerant communication pipe 6*d* and a gaseous refrigerant communication pipe 7*f*). The liquid side shut-off valve 76 is connected to the outdoor heat exchanger 73. The gas side shut-off valve 77 is connected to the four-way switching valve 72.

In addition, various sensors other than the above described the liquid surface detection sensor 89 are provided to the outdoor unit 3. Specifically, disposed in the outdoor unit 3 are an suction pressure sensor 79 that detects the suction pressure of the compressor 71, a discharge pressure sensor 80 that detects the discharge pressure of the compressor 71, a suction temperature sensor 81 that detects the suction temperature of the compressor 71, and a discharge temperature sensor 82 that detects the discharge temperature of the compressor 71. The suction temperature sensor 81 is disposed at a position between the accumulator 74 and the compressor 71. A heat exchanger temperature sensor 83 that detects the temperature of the refrigerant flowing through the outdoor heat exchanger 73 (i.e., the refrigerant temperature corresponding to the condensation temperature during the cooling operation or the evaporation temperature during the heating operation) is disposed in the outdoor heat exchanger 73. A liquid side temperature sensor 84 that detects a refrigerant temperature is disposed at the liquid side of the outdoor heat exchanger 73. A liquid pipe temperature sensor 85 that detects the temperature of the refrigerant (i.e., liquid pipe temperature) is disposed at the outlet on the main refrigerant circuit side of the subcooler 75. The merge circuit 95 of the bypass refrigerant circuit 91 is disposed with a bypass temperature sensor 93 for detecting the temperature of the refrigerant flowing from the outlet on the bypass refrigerant circuit side of the subcooler 75. An outdoor temperature sensor 86 that detects the temperature of the outdoor air that flows into the unit (i.e., outdoor temperature) is disposed at the outdoor air intake side of the outdoor unit 3. In the present embodiment, the suction temperature sensor 81, the discharge temperature sensor 82, the heat exchanger temperature sensor 83, the liquid side temperature sensor 84, the liquid pipe temperature sensor 85, the outdoor temperature sensor 86, and the bypass temperature sensor 93 comprise thermistors. In addition, the outdoor unit 3 includes an outdoor side control unit 87 that controls the operation of each portion forming the outdoor unit 3. Additionally, the outdoor side control unit 87 includes a microcomputer for controlling the outdoor unit 3, a memory, and an inverter circuit that controls the motor 71*m*. Like the outdoor side control unit 37, the outdoor side control unit 87 is configured such that it can exchange control signals and the like with the indoor side control units 47 and 57 of the indoor units 4 and 5 via the transmission line 8*a*. In other words, the control unit 8 that performs the operation control of the entire air conditioner 1 is formed by the indoor side control units 47 and 57, the outdoor side control unit 37, the outdoor side control unit 87, and the transmission line 8*a* that interconnects the control units 37, 47, and 57.

Note that the control unit 8 has the memory 19 connected thereto, and reads out data stored in the memory 19 when performing various controls. Here, the data stored in the memory 19 includes, for example, data on the adequate amount of refrigerant in the refrigerant circuit 10 of the air conditioner 1 in each building, which is determined by taking into account the pipe length and the like after the air conditioner 1 is installed in the building. As described below, the control unit 8 reads out these date when performing the refrigerant automatic charging operation and the refrigerant leak detection operation to charge only an adequate amount of refrigerant to the refrigerant circuit 10. In addition, the memory 19 stores data on the liquid pipe determined refrigerant amount Y, a first outdoor heat exchange collected refrigerant amount X1, and a second outdoor heat exchange collected refrigerant amount X2 besides the data on the adequate refrigerant amount Z, and the following relationship is satisfied: Z=X1+X2+Y. Here, the liquid pipe determined refrigerant amount Y is the data on the amount of refrigerant when the following portions are sealed by the liquid refrigerant whose temperature is constant in the below described cooling operation: a at once a downstream part of the outdoor heat exchanger 23 and the first liquid refrigerant communication pipe 6*c*; a portion corresponding to a downstream part of the outdoor heat exchanger 73 and the second liquid refrigerant communication pipe 6*d*; a portion from a merging portion where the first liquid refrigerant communication pipe 6*c* the second liquid refrigerant communication pipe 6*d* merge together to the indoor expansion valves 41 and 51 via the first liquid refrigerant communication pipe 6*c*; and a portion from a branch portion downstream of the outdoor expansion valve 38 to the bypass expansion valve 62; and a portion from a branch portion downstream of the outdoor expansion valve 88 to the bypass expansion valve 92 (note that the portion from the outdoor expansion valve 38 to the subcooler 25 is designed to be small in capacity, thus having little influence on judgment error). In addition, the first outdoor heat exchange collected refrigerant amount X1 and the second outdoor heat exchange collected refrigerant amount X2 are the amounts proportionally divided according to the capacity of each of the outdoor units 2 and 3 from the amount of refrigerant obtained by subtracting the liquid pipe determined refrigerant amount Y from the adequate refrigerant amount Z. Further, the memory 19 stores an expression between the liquid surface of the outdoor heat exchanger 23 and the amount of refrigerant accumulated in the portion from the outdoor expansion valve 38 to the outdoor heat exchanger 23 in the below described operation. In addition, the memory 19 stores an expression between the liquid surface of the outdoor heat exchanger 73 and the amount of refrigerant accumulated in the portion from the outdoor expansion valve 88 to the outdoor heat exchanger 73 in the below described operation.

In addition, the control unit 8 has the warning display 9 connected thereto, which is formed by LEDs and the like and which indicates that a refrigerant leak is detected in the refrigerant leak detection operation (described below).

<Refrigerant Communication Pipe>

The refrigerant communication pipes 6 and 7 are refrigerant pipes that are arranged on site when installing the air conditioner 1 at an installation site such as a building. As the refrigerant communication pipes 6 and 7, pipes having various lengths and diameters are used according to the installation conditions such as an installation site, combination of an outdoor unit and an indoor unit, and the like. Consequently, for example, when newly installing an air conditioner, it is necessary to charge an adequate amount of refrigerant to the air conditioner 1 according to the installation conditions such as the lengths, diameters, and the like of the refrigerant communication pipes 6 and 7.

As described above, the refrigerant circuit 10 of the air conditioner 1 is formed by the interconnection of the indoor side refrigerant circuits 10*a* and 10*b*, the outdoor side refrigerant circuits 10*c* and 10*d*, and the refrigerant communication pipes 6 and 7. Here, the outdoor side refrigerant circuit 10*c* and the outdoor side refrigerant circuit 10*d* are connected in parallel to the refrigerant communication pipes 6 and 7. The outdoor side refrigerant circuit 10*c* is connected via the first liquid refrigerant communication pipe 6*c* and a first gaseous refrigerant communication pipe 7*c*, and the indoor side refrigerant circuit 10*d* is connected via the second liquid refrigerant communication pipe 6*d* and the second gaseous refrigerant communication pipe 7*f*. Additionally, the control unit 8 formed by the indoor side control units 47 and 57 and the outdoor side control units 37 and 87 allows the air conditioner 1 in the present embodiment to switch and operate the cooling operation and the heating operation by the four-way switching valves 22 and 72 and to control each equipment of the outdoor units 2 and 3 and the indoor units 4 and 5 according to the operation load of each of the indoor units 4 and 5.

<Operation of the Air Conditioner>

Note that, the operation modes of the air conditioner 200 in the second embodiment include: the normal operation mode where control of constituent equipment of the outdoor units 2 and 3 and the indoor units 4 and 5 is performed according to the operation load of each of the indoor units 4 and 5; the adequate refrigerant amount automatic charging operation mode where an adequate amount or refrigerant is charged to the refrigerant circuit 10 when performing a test operation after installation or the like of constituent equipment of the air conditioner 200; and the refrigerant leak detection operation mode where the presence of a refrigerant leak from the refrigerant circuit 10 is judged after such a test operation is finished and the normal operation has started.

Here, the normal operation mode is the same as that in the above described first embodiment, and thus the description thereof is omitted.

<Adequate Refrigerant Amount Automatic Charging Operation Mode>

The adequate refrigerant amount automatic charging operation in the second embodiment is the same as that in the first embodiment from the step of performing the liquid temperature constant control to closing the indoor expansion valves 41 and 51, the bypass expansion valves 62 and 92, and the outdoor expansion valves 38 and 88 in that order. Note that, here, the refrigerant cylinder 15 is connected to each of the charging electromagnetic valves 17 and 17' and set to a state communicating with the suction side of each of the compressors 21 and 71 via the charging pipes 16 and 16', and consequently a state is reached where the refrigerant can be charged to the refrigerant circuits 10*c* and 10*d*.

Unlike the first embodiment, in the second embodiment, subsequently to the above described step, the cooling operation is further continued in each of the outdoor units 2 and 3 so as to accumulate an amount of liquid refrigerant (X1) that corresponds to the capacity of the outdoor unit 2 and an amount of liquid refrigerant (X2) that corresponds to the capacity of the outdoor unit 3 in the outdoor heat exchanger 23 and the outdoor heat exchanger 73, respectively. At this time, the control unit 8 judges, using the liquid surface detection sensor 39, whether or not the required amount of refrigerant (first outdoor heat exchange collected refrigerant amount X1) has accumulated in the outdoor heat exchanger 23 and also separately judges, using the liquid surface detection sensor 89, whether or not the required amount of refrigerant (second outdoor heat exchange collected refrigerant amount X2) has accumulated in the outdoor heat exchanger 73. Then, the control unit 8 stops one of the compressors 21 and 71 respectively provided to the outdoor units 2 and 3 in whichever the accumulation of the required amount of refrigerant in their respective outdoor heat exchangers 23 and 73 is detected first. Here, as shown in FIG. 10, a check valve 69 to prevent the refrigerant from flowing back to the compressor 21 is provided between the compressor 21 and the outdoor heat exchanger 23, and a check valve 99 to prevent the refrigerant from flowing back to the compressor 21 is provided between the compressor 71 and the outdoor heat exchanger 73. Thus, even when either one of the outdoor heat exchangers 23 and 73 is filled with the required amount of refrigerant which is kept therein and one of the corresponding compressors 21 and 71 is stopped, the other one of the operating compressors 21 and 71 will not cause the refrigerant kept therein to flow back. When it is judged that the required amount of refrigerant has accumulated in the other outdoor heat exchanger, the control unit 8 closes the charging electromagnetic valve 17, stops the operation of the compressor corresponding to the other outdoor heat exchanger, removes the refrigerant cylinder 15, and finishes the adequate refrigerant amount automatic charging operation in order to stop charging refrigerant from the refrigerant cylinder 15 to the refrigerant circuit 10.

<Refrigerant Leak Detection Operation Mode>

Next, the refrigerant leak detection operation mode is described.

The refrigerant leak detection operation mode is substantially the same as the adequate refrigerant amount automatic charging operation, so that only differences are described.

In the refrigerant leak detection operation in the second embodiment, the process of the above described adequate refrigerant amount automatic charging operation is performed except for the process of attaching the refrigerant cylinder 15 and the like.

Specifically, the control unit 8 performs the cooling operation and the liquid temperature constant control in the refrigerant circuit 10, closes the indoor expansion valves 41 and 51, the bypass expansion valves 62 and 92, and the outdoor expansion valves 38 and 88 when the liquid temperature becomes constant, and determines the liquid pipe determined refrigerant amount Y. Then, by continuing the cooling operation, the control unit 8 accumulates the liquid refrigerant in each of the outdoor heat exchanger 23 and the outdoor heat exchanger 73.

Here, as for the first outdoor heat exchange collected refrigerant amount X1, when the liquid surface height h detected by the liquid surface detection sensor 39 remains the same for a predetermined period of time, the control unit 8 substitutes the liquid surface height h at that time into an expression stored in the memory 19 and thereby calculates a first judged liquid refrigerant amount X1' accumulated in the portion from the outdoor expansion valve 38 to the outdoor heat exchanger 23. In addition, as for the second outdoor heat exchange collected refrigerant amount X2, when the liquid surface height h detected by the liquid surface detection sensor 89 remains the same for a predetermined period of time, the control unit 8 substitutes the liquid surface height h at that time into an expression stored in the memory 19 and thereby calculates a second judged liquid refrigerant amount X2' accumulated in the portion from the outdoor expansion valve 88 to the outdoor heat exchanger 73.

Here, the presence of a refrigerant leak from the refrigerant circuit 10 is judged by adding the liquid pipe determined refrigerant amount Y to the first judged liquid refrigerant amount X1' and the second judged liquid refrigerant amount X2' that are calculated and determining whether or not the sum is equal to the adequate refrigerant amount Z.

Note that the operation of the compressors 21 and 71 is quickly stopped after the liquid surface height h remains the same for a predetermined period of time and the data on the liquid surface height h is obtained. Thereby, the refrigerant leak detection operation is finished.

(5) Characteristics of the Second Embodiment

Also in the air conditioner 200 having a plurality of outdoor units 2 and 3, it is possible to collect the first outdoor heat exchange collected refrigerant amount X1 in the outdoor heat exchanger 23 and the second outdoor heat exchange collected refrigerant amount X2 in the outdoor heat exchanger 73, and perform operation to separately collect an adequate amount of refrigerant in each of them.

(6) Third Embodiment

<Configuration of the Air Conditioner in the Third Embodiment>

Figure 12:
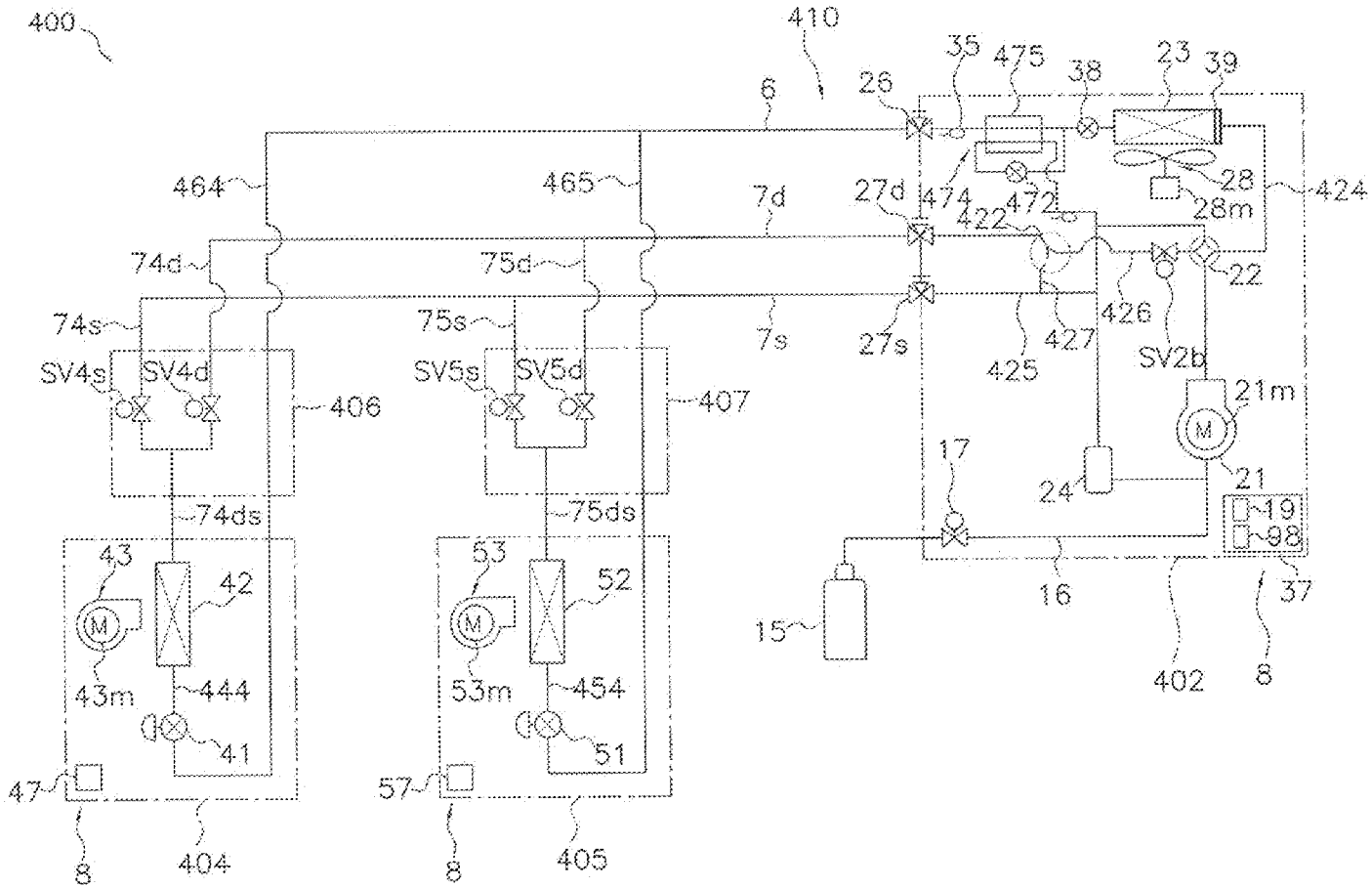
FIG. 12 is a schematic configuration diagram of an air conditioner according to a third embodiment.

FIG. 12 shows a schematic refrigerant circuit 410 of an air conditioner 400 according to another embodiment of the present invention.

The air conditioner 400 is a device that is used to cool and heat the air in a building and the like by performing a vapor compression-type refrigeration cycle operation.

The air conditioner 400 mainly includes one outdoor unit 402, a plurality (two in the present embodiment) of indoor units 404 and 405, connection units 406 and 407, the outdoor unit 402, the liquid refrigerant communication pipe 6, a discharged gaseous refrigerant communication pipe 7*d*, and a sucked gaseous refrigerant communication pipe 7*s*. The air conditioner 400 is configured so as to be able to perform the simultaneous cooling and heating operation according to the need of each air conditioned space in the building where the indoor units 404 and 405 are installed, for example, as in the case of performing the cooling operation in an air conditioned space while performing the heating operation in a different air conditioned space and the like.

In the refrigerant circuit 410 of the air conditioner 400 in this embodiment, the indoor expansion valve 41 of the indoor unit 404 is connected to the outdoor heat exchanger 23 of the outdoor unit 402 via the liquid refrigerant communication pipes 6 and 464. In addition, the indoor expansion valve 51 of the indoor unit 405 is connected to the outdoor heat exchanger 23 of the outdoor unit 402 via the liquid refrigerant communication pipes 6 and 465. The indoor expansion valve 41 of the indoor unit 404 and the indoor expansion valve 51 of the indoor unit 405 are connected to the outdoor heat exchanger 23. In addition, the indoor heat exchanger 42 of the indoor unit 404 is connected to the connection unit 406 via a gaseous refrigerant connection pipe 74*ds*, and the indoor heat exchanger 52 of the indoor unit 405 is connected to the connection unit 407 via a gaseous refrigerant connection pipe 75*ds*. Further, the connection unit 406 is connected to the compressor 21 of the outdoor unit 402 via the discharged gaseous refrigerant communication pipes 7*d* and 74*d*; the connection unit 407 is connected to the compressor 21 of the outdoor unit 402 via the discharged gaseous refrigerant communication pipes 7*d* and 75*d*; the connection unit 406 is connected to the compressor 21 of the outdoor unit 402 via the sucked gaseous refrigerant communication pipes 7*s* and 74*s*; and the connection unit 407 is connected to the compressor 21 of the outdoor unit 402 via the sucked gaseous refrigerant communication pipes 7*s* and 75*s*. Note that the compressor 21 and the outdoor heat exchanger 23 are connected to each other via an outdoor pipe 424. The refrigerant circuit 410 of the air conditioner 400 is configured in the above described manner.

<Indoor Unit>

The indoor units 404 and 405 are installed by being embedded in or hung from a ceiling in a building and the like or by being mounted or the like on a wall surface in a building. The indoor units 404 and 405 are connected to the outdoor unit 402 via the refrigerant communication pipes 6, 7*d*, and 7*s* and the connection units 406 and 407, and form a part of the refrigerant circuit 10.

Next, the configurations of the indoor units 404 and 405 are described. Note that, because the indoor units 404 and 405 have the same configuration, only the configuration of the indoor unit 404 is described here, and descriptions of respective portions in the configuration of the indoor unit 405 are omitted.

The indoor unit 404 mainly includes the indoor expansion valve 41, the indoor heat exchanger 42, and the indoor tube 444 that connects the indoor expansion valve 41 to the indoor heat exchanger 42. In the present embodiment, the indoor expansion valve 41 is an electric expansion valve connected to an indoor tube 444 side of the indoor heat exchanger 42 in order to adjust the flow rate or the like of the refrigerant. In the present embodiment, the indoor heat exchanger 42 is a cross fin-type fin-and-tube type heat exchanger formed by a heat transfer tube and numerous fins, and performs heat exchange between the refrigerant and the indoor air. The indoor unit 404 includes the indoor fan 43 and the indoor fan motor 43*m* and can suck the indoor air into the unit, cause heat exchange between the indoor air and the refrigerant flowing through the indoor heat exchanger 42, and then supply the air as the supply air to the indoor space.

In addition, various sensors are provided to the outdoor unit 404. A liquid side temperature sensor (not shown) that detects the temperature of the liquid refrigerant is disposed at the liquid side of the indoor heat exchanger 42, and a gas side temperature sensor (not shown) that detects the temperature of the gaseous refrigerant is disposed at the gas side of the indoor heat exchanger 42. Further, the indoor unit 404 has an RA suction temperature sensor (not shown) that detects the temperature of the indoor air sucked into the unit.

In addition, the indoor unit 404 includes the indoor side control unit 47 that controls the opening degree of the indoor expansion valve 41, the rotation speed of the indoor fan motor 43*m*, and other operations. Although the illustration is omitted, the indoor side control unit 47 is connected to each sensor, the indoor expansion valve 41, the indoor fan motor 43*m*, and the like via a communication line, and can control each of them. The indoor side control unit 47 forms a part of the control unit 8 of the air conditioner 400, and includes a microcomputer for controlling the indoor unit 404 and a memory. The indoor side control unit 47 is configured such that it can exchange control signals and the like with a remote controller (not shown) and can exchange control signals and the like with the outdoor unit 402. As mentioned above, the configurations of the components which form the indoor unit 405 such as the indoor expansion valve 51, the indoor heat exchanger 52, an indoor pipe 454, the indoor fan 53, the indoor fan motor 53*m*, and the indoor side control unit 57 are the same as those of the respective components described above which form the indoor unit 404.

<Outdoor Unit>

The outdoor unit 402 is installed roof of a building and the like, and is connected to each of the indoor units 404 and 405 via the connection units 406 and 407 and the refrigerant communication pipes 6, 7*d*, and 7*s*.

Next, the configuration of the outdoor unit 402 is described.

The outdoor unit 402 mainly includes: the compressor 21, the motor 21*m*, the outdoor heat exchanger 23, the outdoor fan 28, the outdoor fan motor 28*m*, the subcooler 25, a subcooling circuit 474, a subcooling expansion valve 472, the outdoor pipe 424, an outdoor low pressure pipe 425, an outdoor high pressure pipe 426, a bypass pipe 427, the four-way switching valve 22, a three-way valve 422, the outdoor expansion valve 38, an outdoor high pressure valve SV2*b*, the accumulator 24, the liquid surface detection sensor 39, the charging electromagnetic valve 17 for refrigerant charging by the refrigerant cylinder 15 (described below), the charging pipe 16, the liquid side shut-off valve 26, a high pressure the gas side-shut-off valve 27*d*, and sensors such as a low pressure gas side shut-off valve 27*s*, the liquid pipe temperature sensor 35, and the like.

Note that the structure in the vicinity of the outdoor heat exchanger 23 and the liquid surface detection sensor 39 is the same as that in the first embodiment, and the positional relationship is as shown in FIG. 2.

The compressor 21 is a positive displacement-type compressor whose operation capacity can be varied by the outdoor side control unit 37 through inverter control, and the operation capacity can be varied by controlling the rotation frequency of the motor 21.

The outdoor heat exchanger 23 is a heat exchanger capable of functioning as an evaporator and a condenser of the refrigerant, and is a cross fin-type fin-and-tube type heat exchanger that exchanges heat with the refrigerant using air as a heat source. The outdoor pipe 424 side (gas side) of the outdoor heat exchanger 23 is connected to the four-way switching valve 22 and the liquid side thereof is connected to the liquid side shut-off valve 26.

The subcooler 25 is a triple tube heat exchanger, and is disposed to cool the refrigerant to be sent to the indoor expansion valves 41 and 51 after the refrigerant is condensed in the outdoor heat exchanger 23. The subcooler 25 is connected between the outdoor expansion valve 38 and the liquid side shut-off valve 26.

In this embodiment, the subcooling circuit 474 is disposed as a cooling source of the subcooler 25. Note that, in the description below, a portion corresponding to the refrigerant circuit 10 excluding the subcooling circuit 474 is referred to as a main refrigerant circuit for convenience sake.

The subcooling circuit 474 is connected to the main refrigerant circuit so as to cause a portion of the refrigerant sent from the outdoor heat exchanger 23 to the indoor expansion valves 41 and 51 to branch from the main refrigerant circuit and return to the suction side of the compressor 21. Specifically, the subcooling circuit 474 includes a branch portion connected so as to branch a portion of the refrigerant sent from the outdoor expansion valve 38 to the indoor expansion valves 41 and 51 at a position between the outdoor heat exchanger 23 and the subcooler 25, and a merging portion connected to the suction side of the compressor 21 so as to return a portion of the refrigerant from the outlet on the bypass refrigerant circuit side of the subcooler 25 to the suction side of the compressor 21. Further, the branch portion is disposed with the subcooling expansion valve 472 for adjusting the flow rate of the refrigerant flowing in the subcooling circuit 474. Here, the subcooling expansion valve 472 comprises an electrically operated expansion valve. Accordingly, the refrigerant sent from the outdoor heat exchanger 23 to the indoor expansion valves 41 and 51 is cooled in the subcooler 25 by the refrigerant flowing in the subcooling circuit 474 which has been depressurized by the subcooling expansion valve 472. In other words, the performance of the subcooler 25 is controlled by adjusting the opening degree of the subcooling expansion valve 472.

The outdoor unit 402 includes the outdoor fan 28 and the outdoor fan motor 28*m* and can suck the outdoor air into the unit, cause heat exchange between the outdoor air and the refrigerant flowing through the outdoor heat exchanger 23, and then blow out the air to the outdoor space again.

The liquid side shut-off valve 26, the high pressure gas side shut-off valve 27*d*, and the low pressure gas side shut-off valve 27*s* are valves disposed at connection ports to the external equipment and pipes (specifically, the refrigerant communication pipes 6, 7*d*, and 7*s*). The liquid side shut-off valve 26 is connected to the outdoor heat exchanger 23 via the subcooler 25 and the outdoor expansion valve 38. The high pressure gas side shut-off valve 27*d* is connected to the discharge side of the compressor 21 via the outdoor high pressure pipe 426. The low pressure gas side shut-off valve 27*s* is connected to the suction side of the compressor 21 via the outdoor low pressure pipe 425 and the accumulator 24. The compressor 21 and the outdoor heat exchanger 23 are interconnected via the outdoor pipe 424.

The four-way switching valve 22 switches between the state where the discharge side of the compressor 21 is connected to the outdoor heat exchanger 23 and the suction side thereof is connected to the outdoor low pressure pipe 425 and the state where the suction side of the compressor 21 is connected to the outdoor heat exchanger 23 and the discharge side thereof is connected to the outdoor high pressure pipe 426.

The bypass pipe 427 is capable of connecting the outdoor high pressure pipe 426 to the outdoor low pressure pipe 425. Specifically, depending on the switching state of the three-way valve 422, the outdoor high pressure pipe 426 and the outdoor low pressure pipe 425 are interconnected via the bypass pipe 427, and if this is the case, the refrigerant in the outdoor high pressure pipe 426 cannot pass through the three-way valve 422. On the other hand, in the switching state where the three-way valve 422 does not connect the outdoor high pressure pipe 426 to the outdoor low pressure pipe 425, the refrigerant of the outdoor high pressure pipe 426 passes through the three-way valve 422 and flows into the discharged gaseous refrigerant communication pipe 7*d* via the high pressure gas side shut-off valve 27*d*, and the refrigerant in the bypass pipe 427 cannot pass through the three-way valve 422. As a result, the communication between the outdoor high pressure pipe 426 and the outdoor low pressure pipe 425 will be stopped.

The outdoor high pressure valve SV2*b* is disposed midway of the outdoor high pressure pipe 426. The opening and closing of the outdoor high pressure valve SV2*b* allows and shuts off the refrigerant now. Specifically, the outdoor high pressure valve SV2*b* is provided between the four-way switching valve 22 and the three-way valve 422 in the outdoor high pressure pipe 426.

The outdoor expansion valve 38 is provided between the outdoor heat exchanger 23 and the liquid side shut-off valve 26, and adjusts the amount of refrigerant passing therethrough by adjusting its opening degree.

The liquid surface detection sensor 39 detects the amount of liquid refrigerant located upstream of the outdoor expansion valve 38 when the refrigerant is flowing in a state in which the outdoor expansion valve 38 is shut off and the outdoor heat exchanger 23 is functioning as a condenser. Specifically, the liquid surface detection sensor 39 is disposed to the outdoor heat exchanger 23, and obtains data regarding the amount of liquid refrigerant by detecting the liquid surface height.

In addition, various sensors are provided to the outdoor unit 402. Specifically, the outdoor unit 402 includes a suction pressure sensor (not shown) that detects the suction pressure of the compressor 21, a discharge pressure sensor (not shown) that detects the discharge pressure of the compressor 21 and a discharge temperature sensor (not shown) that detects the discharge temperature of the refrigerant on the discharge side of the compressor 21. Further, the outdoor unit 402 includes the liquid pipe temperature sensor 35 that detects the temperature of the liquid refrigerant that flows out from the subcooler 25. In addition, the outdoor unit 402 is equipped with the outdoor side control unit 37 that controls the operation of components such as the frequency of the compressor 21, the connection state of the four-way switching valve 22, the rotation speed of the outdoor fan motor 28*m*, and the like. Although the illustration is omitted, the outdoor side control unit 37 is connected to each sensor such as the liquid surface detection sensor 39, the motor 21*m*, the outdoor fan motor 28*m*, the four-way switching valve 22, the three-way valve 422, the outdoor expansion valve 38, the subcooling expansion valve 472, the outdoor high pressure valve SV2*b*, and the like via a communication line, and can control each of them. The outdoor side control unit 37 forms a part of the control unit 8 of the air conditioner 400, and includes a microcomputer for controlling the outdoor unit 402, the memory 19, a receiving unit 98 that receives a signal from a remote controller, and the like. The outdoor side control unit 37 is configured such that it can exchange control signals and the like with the indoor side control units 47 and 57 of the indoor units 404 and 405.

Here, the data stored in the memory 19 includes, for example, data on the adequate amount of refrigerant in the refrigerant circuit 410 of the air conditioner 400 in each building, which is determined by taking into account the pipe length and the like after the air conditioner 400 is installed in the building. As described below, the control unit 8 reads out the date when performing the refrigerant automatic charging operation and the refrigerant leak detection operation in order to charge only an adequate amount of refrigerant to the refrigerant circuit 410. In addition, the memory 19 stores data on the liquid pipe determined refrigerant amount Y and the first outdoor heat exchange collected refrigerant amount X1 besides the adequate refrigerant amount Z, and the following relationship is satisfied: Z=X1+Y. Here, the liquid pipe determined refrigerant amount Y is the data on the amount of refrigerant when the following portions are sealed by the liquid refrigerant whose temperature is constant in the below described cooling operation: from a portion at once a downstream part of the outdoor heat exchanger 23 and the liquid refrigerant communication pipe 6, a portion throughout the liquid refrigerant communication pipe 6 up to the indoor expansion valves 41 and 51, and a portion from a branch portion downstream of the outdoor expansion valve 38 to the subcooling expansion valve 472 (note that the portion from the outdoor expansion valve 38 to the subcooler 475 is designed to be small in capacity, thus having little influence on judgment error). In addition, the outdoor heat exchange collected refrigerant amount X1 is the amount of refrigerant that is obtained by subtracting the liquid pipe determined refrigerant amount Y from the adequate refrigerant amount Z. Further, the memory 19 stores an expression between the liquid surface of the outdoor heat exchanger 23 and the amount of refrigerant accumulated in the portion from the outdoor expansion valve 38 to the outdoor heat exchanger 23 in the below described operation.

Note that the outdoor unit is disposed with the charging pipe 16 that extends to the suction side of the compressor 21 and the charging electromagnetic valve 17 that allows and shuts off the refrigerant flow in the charging pipe 16. The refrigerant cylinder 15 is to be connected to the charging electromagnetic valve 17.

<Connection Unit>

The connection unit 406 is installed as a set with the indoor unit 404, and the connection unit 407 is installed as a set with the indoor unit 405. Together with the liquid refrigerant communication pipe 6, the discharged gaseous refrigerant communication pipe 7*d*, and the sucked gaseous refrigerant communication pipe 7*s*, the connection units 406 and 407 are disposed between the indoor units 404 and 405 and the outdoor unit 402, and they form a part of the refrigerant circuit 410.

Next, the configurations of the connection units 406 and 407 are described. Note that, because the connection unit 406 and the connection unit 407 have the same configuration, only the configuration of the connection unit 406 is described here, and in regard to the configuration of the connection unit 407, descriptions of those respective portions are omitted.

The connection unit 406 is configured so as to be able to switch pipes to be connected to its corresponding indoor unit 404. The connection unit 406 mainly includes the liquid refrigerant communication pipe 464, the gaseous refrigerant connection pipe 74*ds*, the discharged gaseous refrigerant communication pipe 74*d*, and the sucked gaseous refrigerant communication pipe 74*s*. Of these pipes, the discharged gaseous refrigerant communication pipe 74*d* has a discharge gas opening/closing valve SV4*d* disposed midway thereof, and the sucked gaseous refrigerant communication pipe 74*s* has a suction gas opening/closing valve SV4*s* disposed midway thereof.

The liquid refrigerant communication pipe 464 corresponds to a branch portion of the liquid refrigerant communication pipe 6, and is connected to the indoor expansion valve 41 of the indoor unit 404.

The discharged gaseous refrigerant communication pipe 74*d* corresponds to a branch portion of the discharged gaseous refrigerant communication pipe 7*d*, and the sucked gaseous refrigerant communication pipe 74*s* corresponds to a branch portion of the sucked gaseous refrigerant communication pipe 7*s*, and both of them are provided to branch out and extend toward the indoor unit 404. The discharged gaseous refrigerant communication pipe 74*d* and the sucked gaseous refrigerant communication pipe 74*s* merge together via the gaseous refrigerant connection pipe 74*ds* and connected to the indoor heat exchanger 42.

The discharge gas opening/closing valve SV4*d* and the suction gas opening/closing valve SV4*s*, which are described above, are respectively provided to the discharged gaseous refrigerant communication pipe 74*d* and the sucked gaseous refrigerant communication pipe 74*s* at positions a little upstream from the merging portion where these pipes merge together. The discharge gas opening/closing valve SV4*d* and the suction gas opening/closing valve SV4*s* are electromagnetic valves capable of switching between a state that allows the refrigerant flow and a state that shuts off the refrigerant flow.

In addition, the connection unit 406 is equipped with a connection side control unit (not shown) that controls the operation of each portion forming the connection unit 406. Additionally, the connection side control unit includes a microcomputer for controlling the connection unit 406 and a memory, and is configured such that it can exchange control signals and the like with the indoor side control unit 47 of the indoor unit 404.

As mentioned above, the configurations of the components which form the connection unit 407, such as the liquid refrigerant communication pipe 465, the gaseous refrigerant connection pipe 75*ds*, the discharged gaseous refrigerant communication pipe 75*d*, the sucked gaseous refrigerant communication pipe 75*s*, a discharge gas opening/closing valve SV5*d*, a suction gas opening/closing valve SV5*s*, and the connection side control unit, are the same as those of the respective components described above which form the connection unit 406. The connection unit 407 is configured to be able to switch pipes to be connected to its corresponding indoor unit 405.

<Operation of the Air Conditioner>

Note that, the operation modes of the air conditioner 400 in the third embodiment include: the normal operation mode such as a simultaneous cooling and heating operation where control of constituent equipment of the outdoor units 402 and 403 is performed according to the operation load of each of the indoor units 404 and 405; the adequate refrigerant amount automatic charging operation mode where an adequate amount of refrigerant is charged to the refrigerant circuit 410 when performing a test operation after installation or the like of constituent equipment of the air conditioner 400; and the refrigerant leak detection operation mode where the presence of a refrigerant leak from the refrigerant circuit 410 is judged after such a test operation is finished and the normal operation has started.

<Normal Operation Mode>

In the normal operation mode, the indoor units 404 and 405 perform the cooling operation, the heating operation, the simultaneous cooling and heating operation, and the like. Switching between the cooling operation and the heating operation is achieved by changing a combination of the opening/closing states of the discharge gas opening/closing valve SV4*d* and SV5*d* and the suction gas opening/closing valves SV4*s* and SV5*s*, which are electromagnetic valves provided to the connection unit 406.

For example, when the indoor unit 404 performs the cooling operation, the discharge gas opening/closing valve SV4*d* is closed and the suction gas opening/closing valve SV4*s* is opened. Accordingly, the liquid refrigerant that passed through the liquid refrigerant communication pipe 464 and was depressurized in the indoor expansion valve 41 evaporates in the indoor heat exchanger 42 that functions as an evaporator, and then passes through the sucked gaseous refrigerant communication pipe 74*s* instead of the discharged gaseous refrigerant communication pipe 74*d* via the gaseous refrigerant connection pipe 74*ds*. Then, the gaseous refrigerant flows into the sucked gaseous refrigerant communication pipe 7*s*, is sucked into the compressor 21, and is condensed in the outdoor heat exchanger 23. The cooling operation is performed in this manner.

In addition, for example, when the indoor unit 404 performs the heating operation, the suction gas opening/closing valve SV4*s* is closed and the discharge gas opening/closing valve SV4*d* is opened, which is opposite to the case of the above described cooling operation. Accordingly, the gaseous refrigerant that passes through the discharged gaseous refrigerant communication pipe 74*d* and flows into the gaseous refrigerant connection pipe 74*ds* is condensed in the indoor heat exchanger 42 that functions as a condenser. Subsequently, after being depressurized by the indoor expansion valve 41, the liquid refrigerant passes through the liquid refrigerant communication pipe 464, flows into the liquid refrigerant communication pipe 6, and evaporates in the outdoor heat exchanger 23. Further, the evaporated gaseous refrigerant is pressurized by the compressor 21. The heating operation is performed in this manner.

As described above, the air conditioner 400 can perform the so-called simultaneous cooling and heating operation by the indoor units 404 and 405, the connection units 406 and 407, and the outdoor unit 402, where, for example, the indoor units 404 and 405 perform the cooling operation while the indoor unit performs the heating operation and the like.

Figure 13:
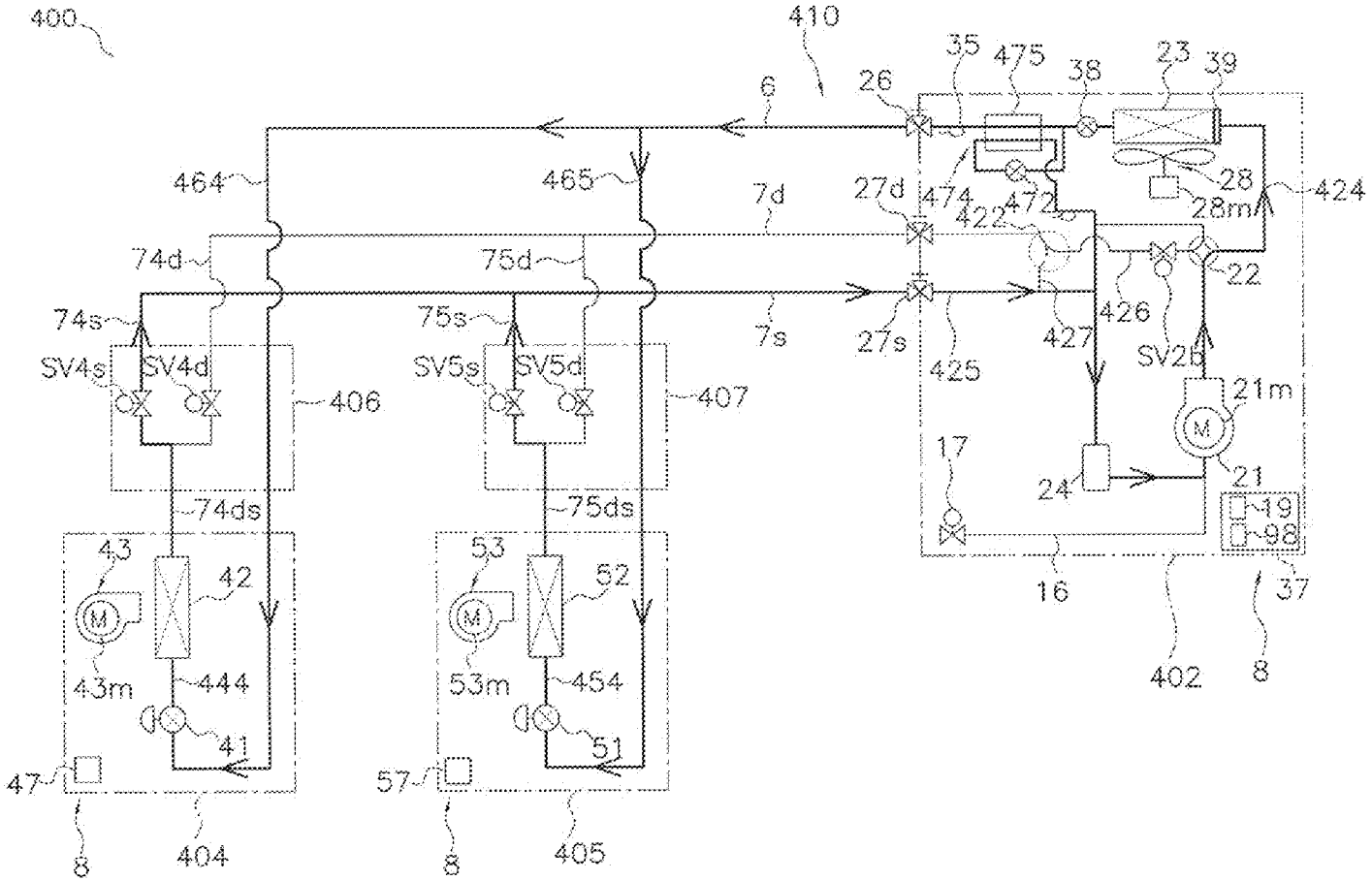
FIG. 13 is a schematic view of the air conditioner according to the third embodiment when indoor units are performing a cooling-cooling operation.

Here, the refrigerant flow of when both of the indoor units 404 and 405 perform the cooling operation is indicated by the bold lines in the refrigerant circuit shown in FIG. 13. In this case, the outdoor side control unit 37 of the outdoor unit 402 performs the following control: rotate the motor 21*m* and the outdoor fan motor 28*m*; switch the four-way switching valve 22 such that the discharged gas communicates with the outdoor heat exchanger 23; switch the three-way valve 422 such that the outdoor high pressure pipe 426 and the outdoor low pressure pipe 425 do not communicate with each other; open the outdoor expansion valve 38; adjust the opening degree of the subcooling expansion valve 472; and close the outdoor high pressure valve SV2*b*.

Figure 14:
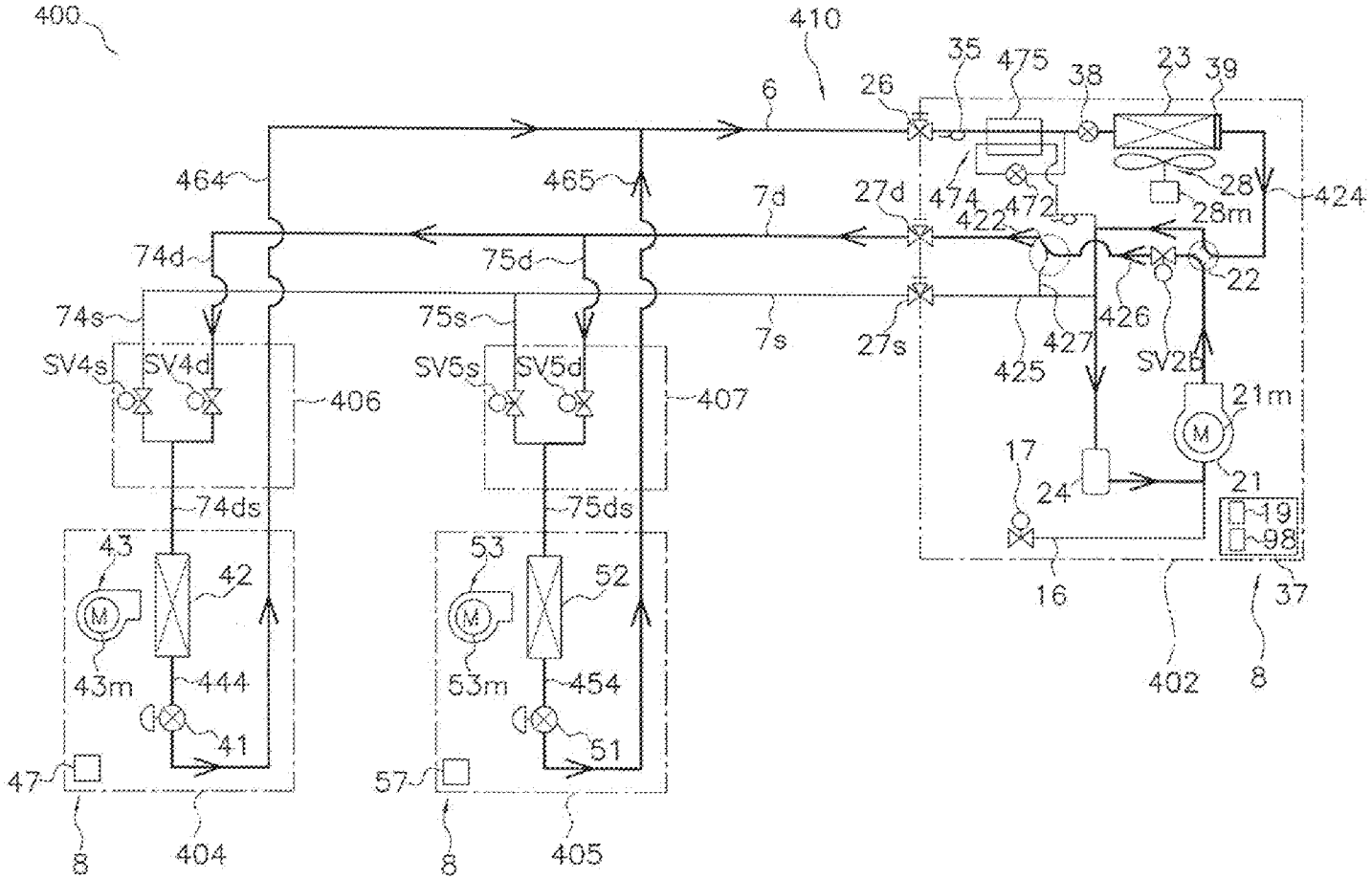
FIG. 14 is a schematic view of the air conditioner according to the third embodiment when the indoor units are performing a heating-heating operation.

The refrigerant flow of when both of the indoor units 404 and 405 perform the heating operation is indicated by the bold lines in the refrigerant circuit shown in FIG. 14. In this case, the outdoor side control unit 37 of the outdoor unit 402 performs the following control: rotate the motor 21*m* and the outdoor fan motor 28*m*; open the outdoor high pressure valve SV2*b*; switch the four-way switching valve 22 such that the discharged gas communicates with the outdoor high pressure pipe 426; switch the three-way valve 422 such that the outdoor high pressure pipe 426 and the outdoor low pressure pipe 425 do not communicate with each other; open the outdoor expansion valve 38; and close the subcooling expansion valve 472.

Figure 15:
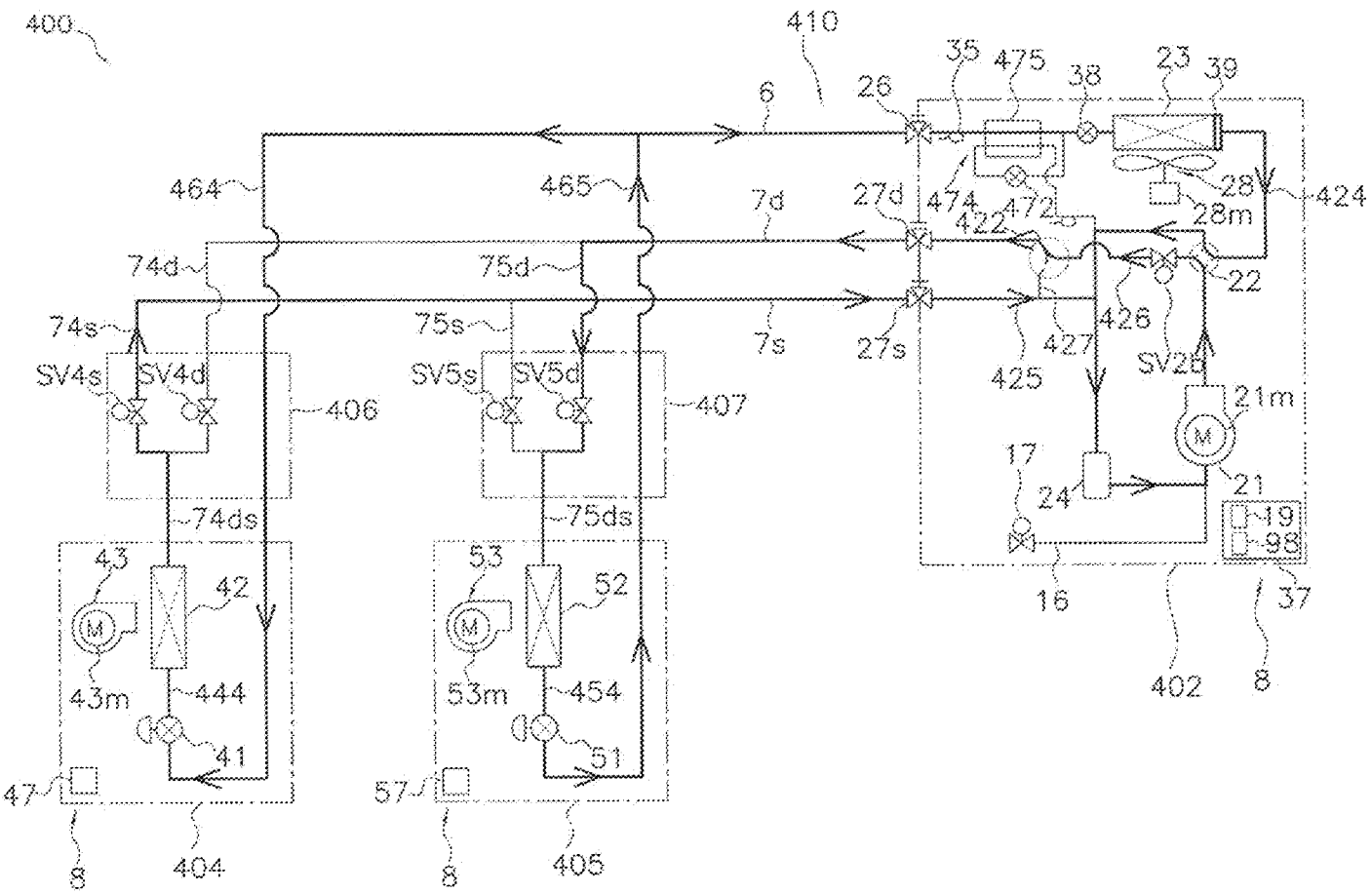
FIG. 15 is a schematic view of the air conditioner according to the third embodiment when the indoor units are performing a cooling-heating operation.

The refrigerant flow of when the indoor unit 404 performs the cooling operation and simultaneously the indoor unit 405 performs the heating operation is indicated by the bold lines in the refrigerant circuit shown in FIG. 15. In this case, likewise, the outdoor side control unit 37 of the outdoor unit 402 performs the following control: rotate the motor 21*m* and the outdoor fan motor 28*m*; open the outdoor high pressure valve SV2*b*; switch the four-way switching valve 22 such that the discharged gas communicates with the outdoor high pressure pipe 426; switch the three-way valve 422 such that the outdoor high pressure pipe 426 and the outdoor low pressure pipe 425 do not communicate with each other; open the outdoor expansion valve 38; and close the subcooling expansion valve 472.

Figure 16:
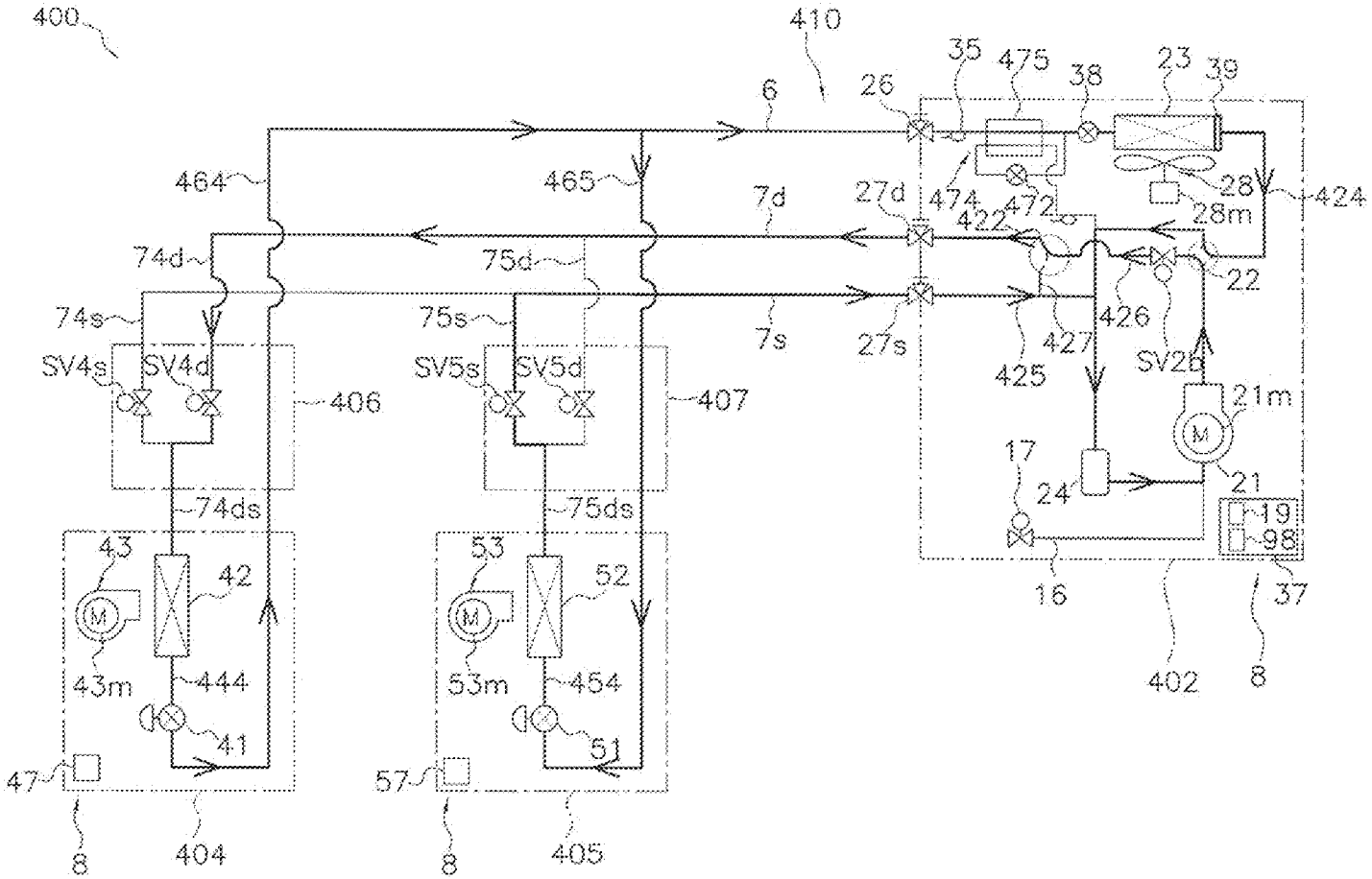
FIG. 16 is a schematic view of the air conditioner according to the third embodiment when the indoor units are performing a heating-cooling operation.

The refrigerant flow of when the indoor unit 404 performs the heating operation and simultaneously the indoor unit 405 performs the cooling operation is indicated by the bold lines in the refrigerant circuit shown in FIG. 16. In this case, likewise, the outdoor side control unit 37 of the outdoor unit 402 performs the following control: rotate the motor 21*m* and the outdoor fan motor 28*m*; open the outdoor high pressure valve SV2*b*; switch the four-way switching valve 22 such that the discharged gas communicates with the outdoor high pressure pipe 426; switch the three-way valve 422 such that the outdoor high pressure pipe 426 and the outdoor low pressure pipe 425 do not communicate with each other; open the outdoor expansion valve 38; and close the subcooling expansion valve 472.

<Adequate Refrigerant Amount Automatic Charging Operation Mode>

Figure 17:
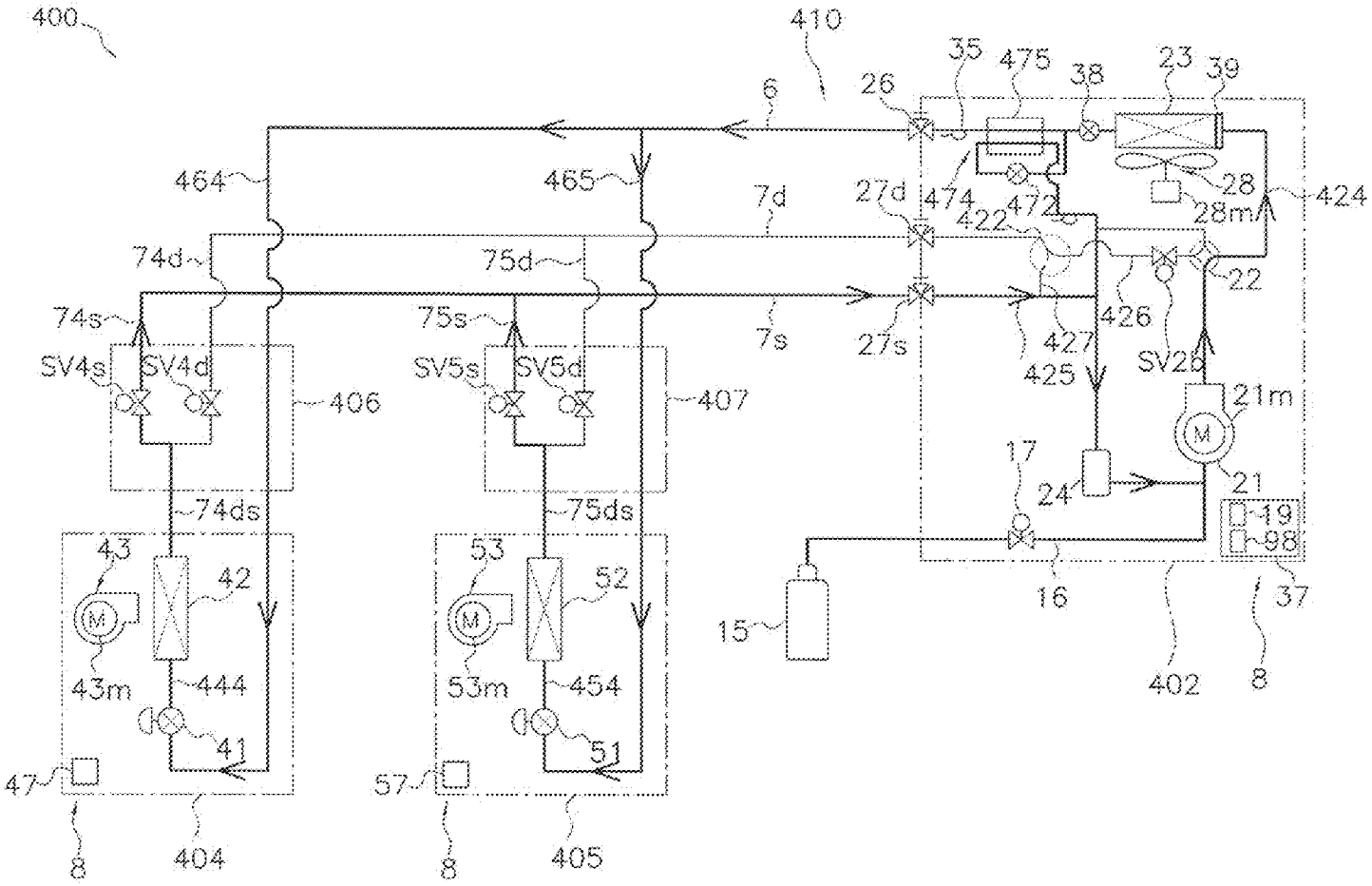
FIG. 17 is a schematic view of the air conditioner according to the third embodiment when a liquid temperature constant control is performed in a refrigerant automatic charging operation and a refrigerant amount judging operation.

In the adequate refrigerant amount automatic charging operation according to the third embodiment, as shown in FIG. 17, when the receiving unit 98 receives a predetermined signal from a remote controller or the like which indicates automatic charging, the refrigerant cylinder 15 is connected to the charging electromagnetic valve 17 and set to a state communicating with the suction side of the compressor 21 via the charging pipe 16, and consequently a state is achieved where the refrigerant can be charged to the refrigerant circuit 410, as in the case of the first embodiment.

Then, the control unit 8 performs the following control such that both of the indoor units 404 and 405 perform the cooling operation: rotate the motor 21*m* and the outdoor fan motor 28*m*; switch the four-way switching valve 22 such that the discharged gas communicates with the outdoor heat exchanger 23; switch the three-way valve 422 such that the outdoor high pressure pipe 426 and the outdoor low pressure pipe 425 do not communicate with each other; open the outdoor expansion valve 38; adjust the opening degree of the subcooling expansion valve 472; and close the outdoor high pressure valve SV2*b*. While performing such control, the control unit 8 starts charging refrigerant from the refrigerant cylinder 15. Additionally, the control unit 8 performs the liquid temperature constant control while performing the refrigerant automatic charging operation.

In this liquid temperature constant control, the condensation pressure control and the liquid pipe temperature control are performed, as in the case of the first embodiment.

In the condensation pressure control, the flow rate of the outdoor air supplied by the outdoor fan 28 to the outdoor heat exchanger 23 is controlled such that the condensation pressure of the refrigerant in the outdoor heat exchanger 23 becomes constant. Because the condensation pressure or the refrigerant in the condenser changes greatly due to the effect of the outdoor temperature, the flow rate of the indoor air supplied from the outdoor fan 28 to the outdoor heat exchanger 23 is controlled by the motor 28*m*. Consequently, the condensation pressure of the refrigerant in the outdoor heat exchanger 23 becomes constant, and the state of the refrigerant flowing through the condenser will be stabilized. Accordingly, a state is achieved where a high pressure liquid refrigerant flows in the flow path from the outdoor heat exchanger 23 to the indoor expansion valves 41 and 51 including the outdoor expansion valve 38, the main refrigerant circuit side of the subcooler 25, and the liquid refrigerant communication pipe 6 and the flow path from the outdoor heat exchanger 23 to the subcooling expansion valve 472 of the subcooling circuit 474. Thus, the pressure of the refrigerant in a portion from the outdoor heat exchanger 23 to the indoor expansion valves 41 and 51 and to the subcooling expansion valve 472 also becomes stabilized, and the portion is sealed by the liquid refrigerant, thereby becoming a stable state. Note that, in the condensation pressure control, the discharge pressure of the compressor 21 which is detected by a discharge pressure sensor (not shown) or the temperature of the refrigerant flowing through the outdoor heat exchanger 23 which is detected by a heat exchange temperature sensor (not shown) is used.

In the liquid pipe temperature control, the performance of the subcooler 25 is controlled such that the temperature of the refrigerant sent from the subcooler 25 to the indoor expansion valves 41 and 51 becomes constant. Accordingly, the density of the refrigerant in the refrigerant pipes from the subcooler 25 to the indoor expansion valves 41 and 51 including the liquid refrigerant communication pipe 6 can be stabilized. Here, the performance of the subcooler 25 is controlled so as to increase or decrease the flow rate of the refrigerant flowing in the subcooling circuit 474 such that the refrigerant temperature detected by the liquid pipe temperature sensor 35 becomes constant. Accordingly, the amount of heat exchange between the refrigerant flowing on the main refrigerant circuit side of the subcooler 25 and the refrigerant flowing on the subcooling circuit 474 side is adjusted. Note that, the flow rate of the refrigerant flowing in the subcooling circuit 474 is increased or decreased as the control unit 8 adjusts the opening degree of the subcooling expansion valve 472.

Here, the control unit 8 judges whether or not the liquid temperatures has satisfied certain conditions based on a value detected by the liquid pipe temperature sensor 35.

In the third embodiment, when it is judged by the control unit 8 that the certain conditions are satisfied, the control unit 8 closes the indoor expansion valves 41 and 51, the subcooling expansion valve 472, and the outdoor expansion valves 38 and 88 in that order.

Accordingly, in the refrigerant circuit 410 during the cooling operation, a portion from a downstream part of the outdoor expansion valve 38 to the indoor expansion valves 41 and 51 via the liquid refrigerant communication pipe 6 and also a portion from the branch portion downstream of the outdoor expansion valve 38 to the subcooling expansion valve 472 are sealed by the liquid refrigerant (liquid pipe determined refrigerant amount Y) whose temperature is constant. Then, the gaseous refrigerant is sucked into the compressor 21 from scattered portions where the gaseous refrigerant is present such as the indoor tube 444, the indoor heat exchanger 42, the gaseous refrigerant connection pipe 74*ds*, an indoor pipe 545, the indoor heat exchanger 52, the gaseous refrigerant connection pipe 75*ds*, the discharged gaseous refrigerant communication pipes 7*d*, 74*d*, and 75*d*, the sucked gaseous refrigerant communication pipes 7*s*, 74*s*, and 75*s*, the three-way valve 422, the bypass pipe 427, and the outdoor low pressure pipe 425. Consequently, a substantially vacuum state is created in these portions with no refrigerant, and the refrigerant will accumulate as the liquid refrigerant (X1) in the outdoor heat exchanger 23.

Figure 18:
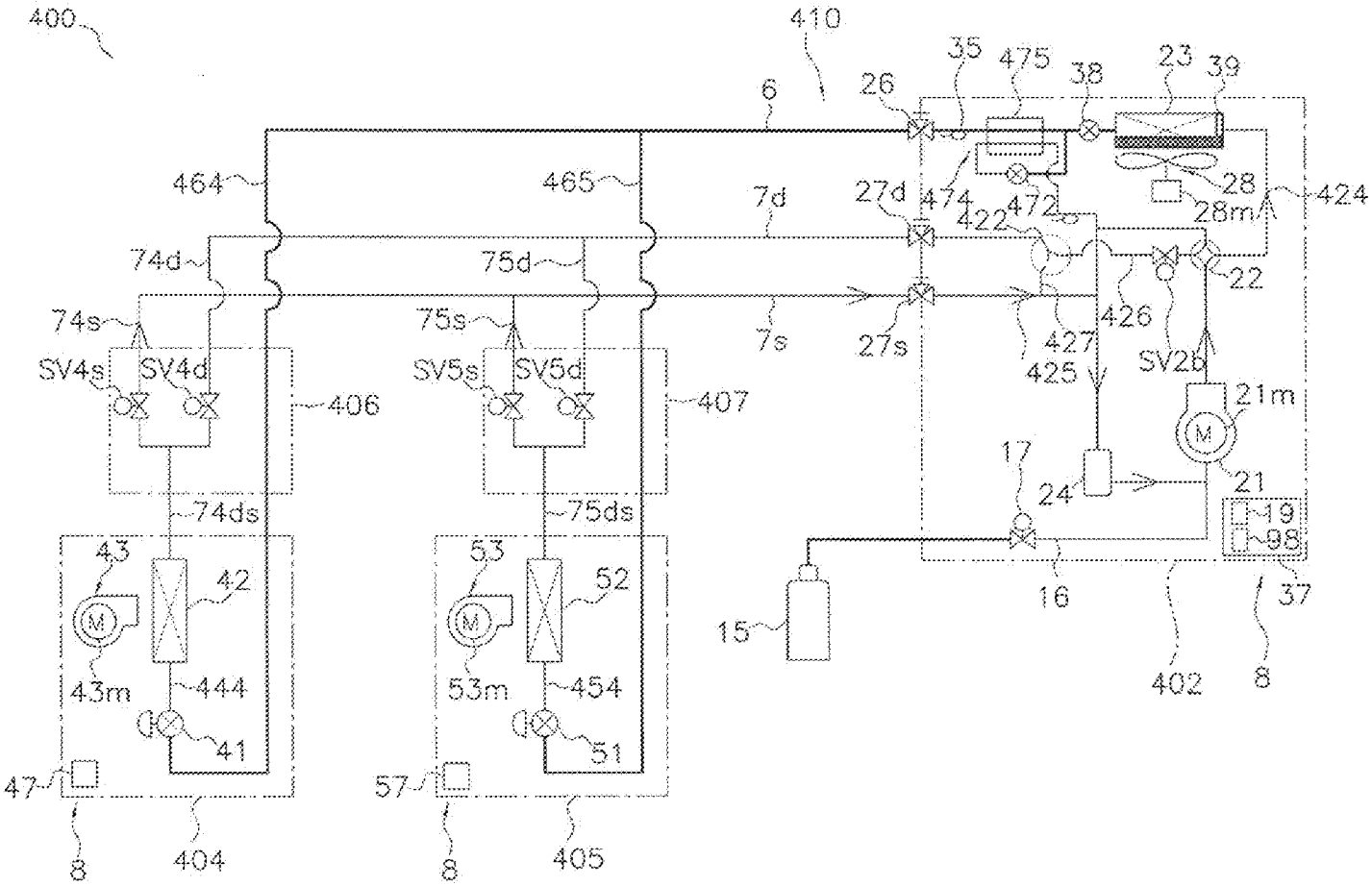
FIG. 18 is a schematic view of the air conditioner according to the third embodiment when the liquid refrigerant is caused to accumulate in the outdoor heat exchanger in the refrigerant automatic charging operation and the refrigerant amount judging operation.

Subsequently, as shown in FIG. 18, the control unit 8 further continues the cooling operation in each of the indoor units 404 and 405, and condenses and accumulates the refrigerant in the outdoor heat exchanger 23 of the outdoor unit 402. At this time, the control unit 8 judges whether or not the required amount of refrigerant (outdoor heat exchange collected refrigerant amount X1) has accumulated in the outdoor heat exchanger 23, using the liquid surface detection sensor 39. When it is judged that the required amount of refrigerant has accumulated in the outdoor heat exchanger, the control unit 8 closes the charging electromagnetic valve 17, stops the operation of the compressor 21, removes the refrigerant cylinder 15, and finishes the adequate refrigerant amount automatic charging operation in order to stop charging refrigerant from the refrigerant cylinder 15 to the refrigerant circuit 410.

<Refrigerant Leak Detection Operation Mode>

Next, the refrigerant leak detection operation mode is described.

The refrigerant leak detection operation mode is substantially the same as the adequate refrigerant amount automatic charging operation, so that only differences are described.

In the refrigerant leak detection operation in the third embodiment, the process of the above described adequate refrigerant amount automatic charging operation is performed except for the process of attaching the refrigerant cylinder 15 and the like, when the receiving unit 98 receives a predetermined signal from a remote controller or the like which indicates the refrigerant leak detection operation.

Specifically, the control unit 8 performs the cooling operation and the liquid temperature constant control in the refrigerant circuit 410, and closes the indoor expansion valves 41 and 51, the subcooling expansion valve 472, and the outdoor expansion valve 38 when the liquid temperature becomes constant to determine the amount of liquid refrigerant (liquid pipe determined refrigerant amount Y) that fills a portion from a downstream part of the outdoor expansion valve 38 to the indoor expansion valves 41 and 51 via the liquid refrigerant communication pipe 6 and also a portion from the branch portion downstream of the outdoor expansion valve 38 to the subcooling expansion valve 472. Then, by continuing the cooling operation, the gaseous refrigerant is sucked into the compressor 21 from scattered portions where the gaseous refrigerant is present such as the indoor tube 444, the indoor heat exchanger 42, the gaseous refrigerant connection pipe 74*ds*, the indoor pipe 545, the indoor heat exchanger 52, the gaseous refrigerant connection pipe 75*ds*, the discharged gaseous refrigerant communication pipes 7*d*, 74*d*, and 75*d*, the sucked gaseous refrigerant communication pipes 7*s*, 74*s*, and 75*s*, the three-way valve 422, the bypass pipe 427, and the outdoor low pressure pipe 425. Consequently, the gaseous refrigerant is condensed in the outdoor heat exchanger 23 upstream of the outdoor expansion valve 38, resulting in the accumulation of the liquid refrigerant therein.

Here, when the liquid surface height h detected by the liquid surface detection sensor 39 remains the same for a predetermined period of time, the control unit 8 substitutes the liquid surface height h at that time into an expression stored in the memory 19 and thereby calculates the first judged liquid refrigerant amount X1' accumulated in a portion from the outdoor expansion valve 38 to the outdoor heat exchanger 23.

Here, the presence of a refrigerant leak from the refrigerant circuit 10 is judged based on whether or not the sum of the first judged liquid refrigerant amount X1' that is calculated and the liquid pipe determined refrigerant amount Y is lower than a value of the adequate refrigerant amount Z stored in the memory 19. When it is lower, the control unit 8 judges that there is a refrigerant leak.

Note that the operation of the compressor 21 is quickly stopped after the liquid surface height h remains the same for a predetermined period of time and the data on the liquid surface height h is obtained. Accordingly, the refrigerant leak detection operation is finished.

(7) Characteristics of the Third Embodiment

In the air conditioner 400 in the third embodiment, the refrigerant circuit 410 has a complicated configuration capable of performing the simultaneous cooling and heating operation. Still, it is possible to stop the refrigerant circulation by closing the outdoor expansion valve 38 and suck in the gaseous refrigerant that is present in scattered portions such as the gaseous refrigerant connection pipes 74*ds* and 75*ds*, the discharged gaseous refrigerant communication pipes 74*d* and 75*d*, the sucked gaseous refrigerant communication pipes 74*s* and 75*s*, the discharged gaseous refrigerant communication pipe 7*d*, the sucked gaseous refrigerant communication pipe 7*s*, the outdoor high pressure pipe 426, and the outdoor low pressure pipe 425, thereby creating a substantially vacuum state in these portions. Additionally, the refrigerant that is present in the refrigerant circuit 410 can be accumulated in the liquid state in the following portions: the liquid refrigerant communication pipes 464, 465, and 6, a portion between the outdoor expansion valve 38 and the liquid side shut-off valve 26, a portion between the outdoor expansion valve 38 and the subcooling expansion valve 472, and the outdoor heat exchanger 23.

Accordingly, in the refrigerant circuit 410, there will be hardly any refrigerant in portions other than the following portions: the liquid refrigerant communication pipes 464, 465, and 6, a portion between the outdoor expansion valve 38 and the liquid side shut-off valve 26, a portion between the outdoor expansion valve 38 and the subcooling expansion valve 472, and the outdoor heat exchanger 23. Consequently, it is possible to judge the amount of refrigerant with high accuracy tinder simple operational conditions that only require the detection of the height h by the liquid surface detection sensor 39 during the cooling operation.

(8) Alternative Embodiment of the Third Embodiment (A)

The air conditioner 400 in the above described third embodiment is described taking an example where only one compressor 21 is provided to the outdoor unit 402.

However, the present invention is not limited thereto. Two compressors may be provided so as to be connected in parallel to the outdoor unit 402.

Figure 19:
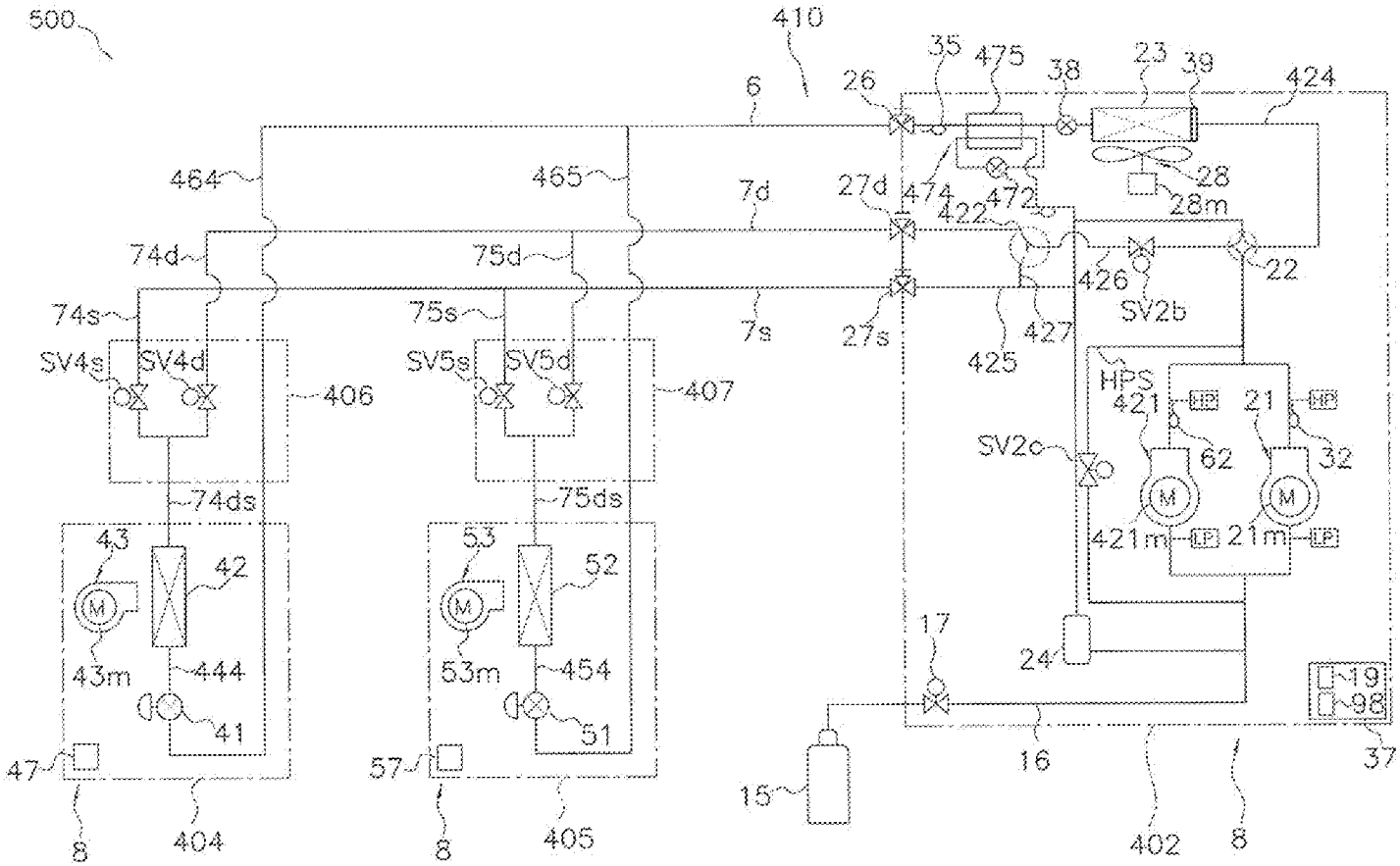
FIG. 19 is a schematic view of an air conditioner according to an alternative embodiment (A) of the third embodiment when the liquid refrigerant is caused to accumulate in the outdoor heat exchanger in the refrigerant automatic charging operation and the refrigerant amount judging operation.

In this case, for example, as shown in FIG. 19, there may be provided an air conditioner 500 having a configuration in which a first compressor 21 and a second compressor 421 connected in parallel to the first compressor 21 are provided to the outdoor unit 402, and interconnections are made between the discharge side of the first compressor 21 and the discharge side of the second compressor 421 and between the suction side of the first compressor 21 and the suction side of the second compressor 421 by a hot gas bypass circuit HPS. Note that the motor 21*m* is provided to the first compressor 21 and a motor 421*m* is provided to the second compressor 421. In addition, the discharge temperature sensors 32 and 62 that detect the discharge refrigerant temperature are provided to the discharge sides of the compressors 21 and 421, respectively.

Here, the hot gas bypass circuit HPS is provided with an opening/closing valve SV2*c* and thereby it is possible to adjust the amount of refrigerant that is bypassed from the discharge side to the suction side.

Additionally, the control unit 8 controls the frequencies of the motor 21 in of the first compressor 21 and the motor 421*m* of the second compressor 421 or stops the operation of one of them such that the first compressor 21 and the second compressor 421 will provide the capacities required for the refrigerant circuit 410 based on the values detected by the discharge temperature sensors 32, 62, and the like.

In the air conditioner 500 in the alternative embodiment (A) of the third embodiment, even if the amount of gaseous refrigerant is too much to be completely condensed in the outdoor heat exchanger 23 when accumulating the liquid refrigerant in the outdoor heat exchanger 23, it is possible to adjust the balance between the speed of condensation and the speed of supply of the high pressure gaseous refrigerant by opening the opening/closing valve SV2*c* of the hot gas bypass circuit HPS so as to circulate the gaseous refrigerant to the suction side again.

Further, the discharge side and the suction side of the first compressor 21 and the discharge side and the suction side of the second compressor 421 all communicate with the hot gas bypass circuit HPS. Thus, a change in the capacities of the first compressor 21 and the second compressor 421 can be handled, such as in the case where failure on the high pressure side of the refrigerant circuit 410 can be avoided even if the circulation flow rate in the refrigerant circuit 410 is increased. Consequently, it is possible to judge the amount of refrigerant while maintaining the working conditions of both the first compressor 21 and the second compressor 421 as they are. Therefore, even when a plurality of compressors are used, by making sure that there is no non-operating compressor during judgment of the amount of refrigerant, it is possible to reduce a judgment error caused by the difference between the solubility of the refrigerant in high-temperature and high-pressure refrigerant oil in the operating compressor and the solubility of the refrigerant in low-temperature and low-pressure refrigerant oil in the non-operating compressor. Accordingly, it is possible to control a change in the amount of refrigerant dissolved in the refrigerant oil and to improve the judgment accuracy for the amount of refrigerant.

(B)

The air conditioner 400 in the above described third embodiment is described taking an example where only one outdoor heat exchanger 23 is provided to the outdoor unit 402.

However, the present invention is not limited thereto. For example, as shown in FIG. 20, there may be provided an air conditioner 600 having a configuration in which the two outdoor heat exchangers 23 and 73 are provided in the outdoor unit 402.

Here, in the air conditioner 600 according to the alternative embodiment (B), the indoor units 404 and 405 and the refrigerant communication pipes 6, 7*d*, and 7*s* have the same configurations as those in the above described third embodiment.

Figure 20:
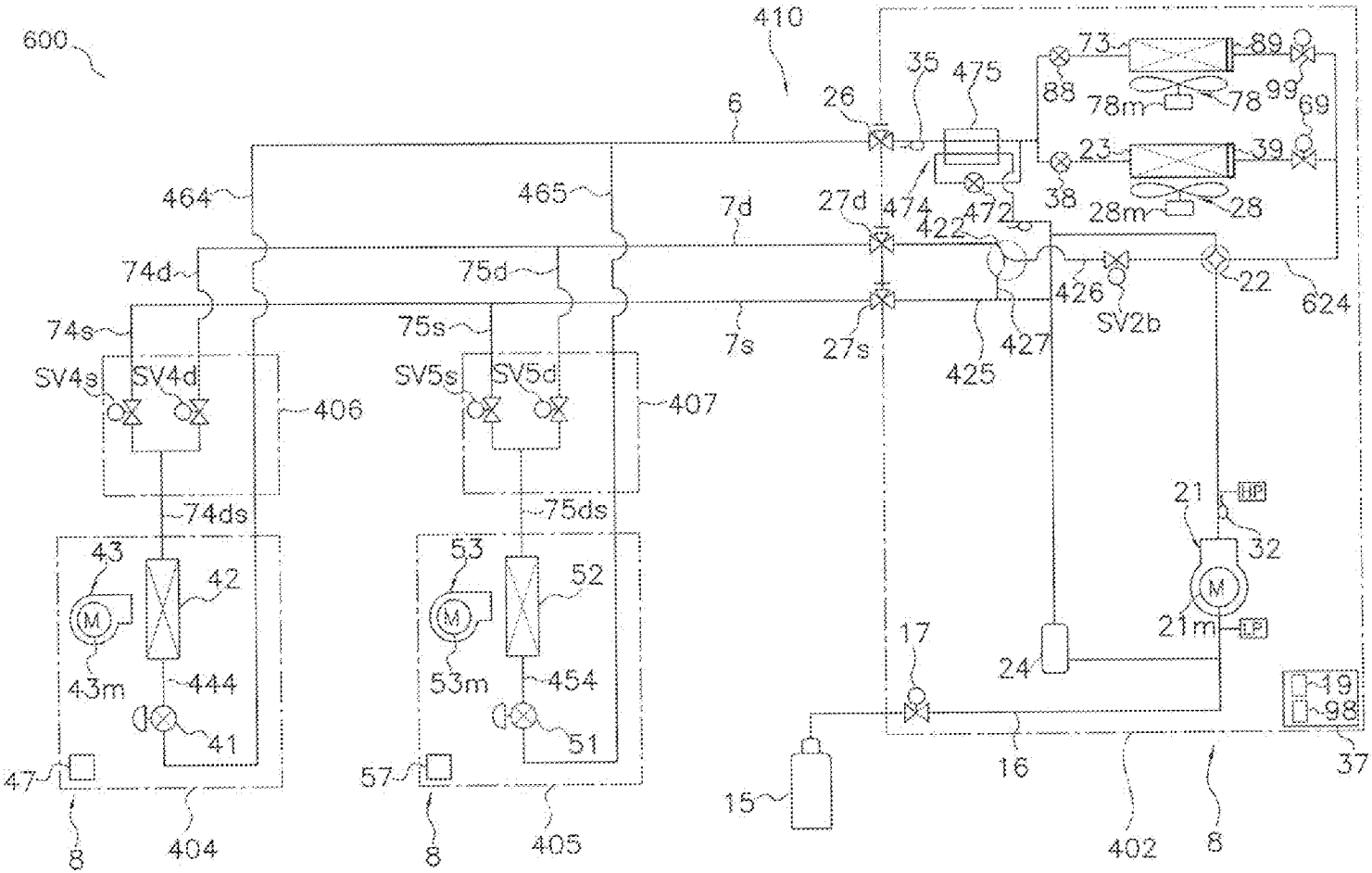
FIG. 20 is a schematic view of an air conditioner according to an alternative embodiment (B) of the third embodiment when the liquid refrigerant accumulates in the outdoor heat exchanger in the refrigerant automatic charging operation and the refrigerant amount judging operation.

As shown in FIG. 20, besides the configuration of the above described third embodiment, the outdoor unit 402 of the air conditioner 600 according to the alternative embodiment (B) has a configuration in which an outdoor pipe 624 is branched off between the compressor 21 and the subcooler 475 in the refrigerant circuit 410, and the outdoor heat exchanger 73, the outdoor expansion valve 88 and the liquid surface detection sensor 89 are provided which are connected in parallel to the outdoor heat exchanger 23, the outdoor expansion valve 38, and the liquid surface detection sensor 39. Further, the outdoor fan 78 and the fan motor 78*m* for blowing the outdoor air to the outdoor heat exchanger 73 are disposed.

In addition, besides the data in the air conditioner 400 in the above described third embodiment, the memory 19 further stores data on the required amount of liquid refrigerant to be accumulated in a portion from the outdoor expansion valve 88 to the outdoor heat exchanger 73 corresponding to the data on the required amount of liquid refrigerant to be accumulated in the portion from the outdoor expansion valve 38 to the outdoor heat exchanger 23.

Additionally, there are provided the opening/closing valves 69 and 99 that shut off the refrigerant flow at portions respectively between the branch portion of the outdoor pipe 624 and the outdoor heat exchangers 23 and 73 arranged in a juxtaposed manner. When the required amount of liquid refrigerant has accumulated first in one of the outdoor heat exchangers 23 and 73, one of the opening/closing valves 69 and 99 whichever belongs to the outdoor heat exchanger 23 or 73 in which the required amount of liquid refrigerant has accumulated first is closed. Consequently, it is possible to introduce the liquid refrigerant only to one of the outdoor heat exchangers 23 and 73 that is not yet filled with the required amount of liquid refrigerant.

In the above described configuration, in the adequate refrigerant amount automatic charging operation mode and the refrigerant leak detection operation mode, the control unit 8 first closes the outdoor expansion valves 38 and 88 simultaneously. Then, as the liquid refrigerant accumulates, the control unit 8 determines the level of accumulation of liquid refrigerant based on each of the liquid surface detection sensors 39 and 89, and performs control to close the opening/closing valves 69 and 99 according to the data stored in the memory 19 on the required amount of liquid refrigerant in each of the outdoor heat exchangers 23 and 73. In other words, the control unit 8 closes one of the opening/closing valves 69 and 99 whichever belongs to the outdoor heat exchanger 23 or 73 in which the required amount of liquid refrigerant has accumulated first, and keeps opening the other one of the opening/closing valves 69 and 99 that belongs to the outdoor heat exchanger 23 or 73 in which the required amount of liquid refrigerant has not accumulated yet. In this state, the control unit 8 performs control to maintain the operation.

Accordingly, the focus is placed only on the outdoor heat exchangers 23 or 73 in which the required amount of liquid refrigerant has not accumulated yet, and the operation is continued until the accumulation of the required amount of liquid refrigerant therein is completed. Note that, at this time, the liquid refrigerant cannot flow back from the outdoor heat exchanger 23 or 73 in which the required amount of liquid refrigerant has accumulated and the corresponding opening/closing valve 69 or 99 is closed, and thereby the amount of refrigerant is kept therein.

Note that the control unit 8 may control the opening and closing of the opening/closing valves 69 and 99 so as to introduce the liquid refrigerant according to the ratio of the required amount of liquid refrigerant such that each of the outdoor heat exchangers 23 and 73 is simultaneously filled with the required amount of liquid refrigerant, instead of performing control to close one of the opening/closing valves 69 and 99 whichever belongs to the outdoor heat exchanger 23 or 73 in which the required amount of liquid refrigerant has accumulated first. Specifically, the control unit 8 adjusts the opening/closing valve 99 to a semi-closed position when introducing more liquid refrigerant to the outdoor heat exchanger 23, and adjusts the opening/closing valve 69 to a semi-closed position when introducing more liquid refrigerant to the outdoor heat exchanger 73, according to the ratio based on the data stored in the memory 19 on the required amount of liquid refrigerant in the outdoor heat exchangers 23 and 73.

(9) Other Embodiment

While embodiments of the present invention have been described based on the figures, the scope of the invention is not limited to the above-described embodiments, and various changes and modifications can be made herein without departing from the scope of the invention.

Figure 11:
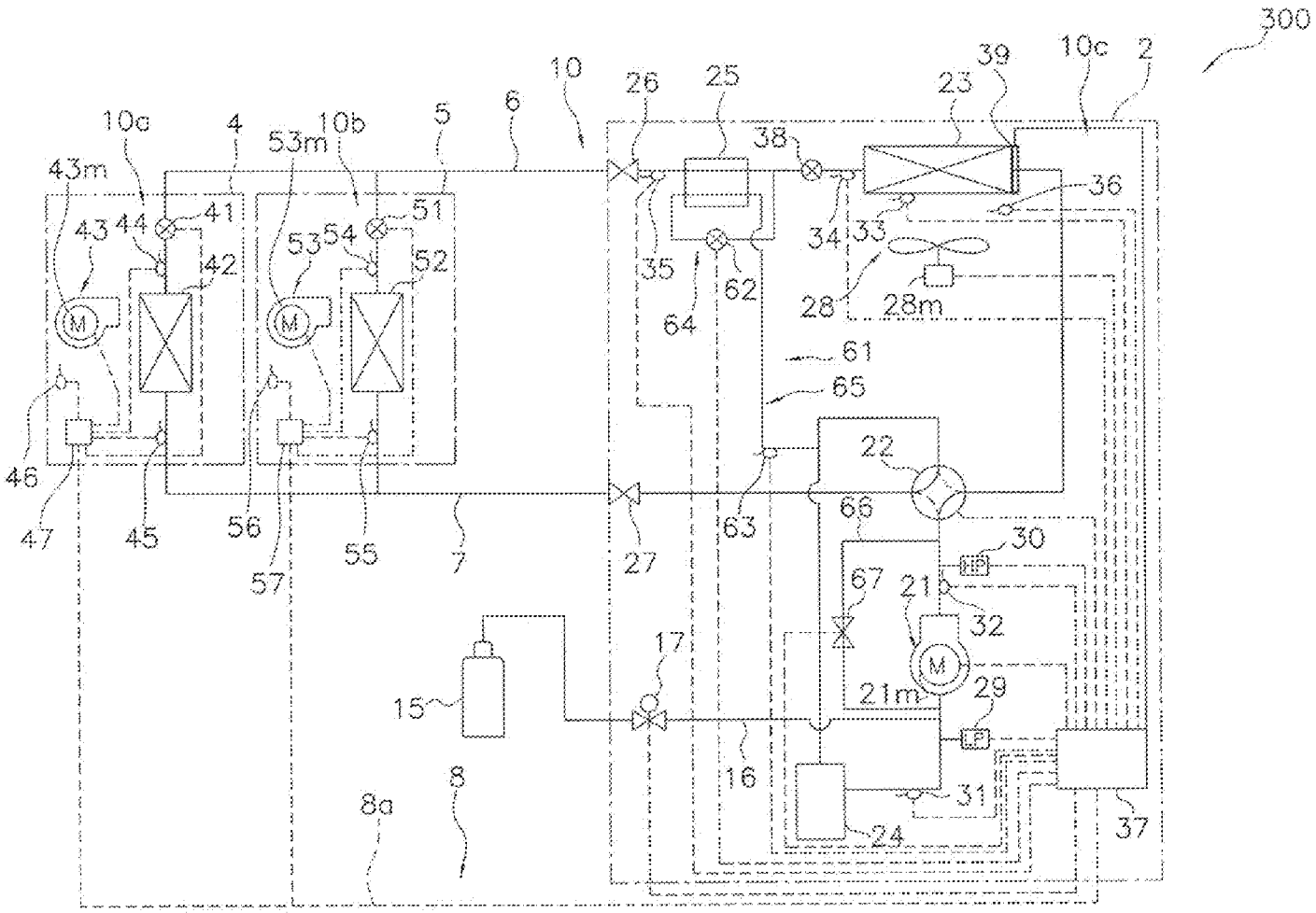
FIG. 11 is a schematic configuration diagram of an air conditioner according to another embodiment.

For example, as in an air conditioner 300 shown in FIG. 11, the configuration may include a hot gas bypass 66 and a bypass valve 67 for connecting the discharge side to the suction side of the compressor 21. Here, the bypass valve 67 is connected to the outdoor control unit 37 and is controlled to be intermittently opened and closed. Consequently, it is possible to introduce the refrigerant to the Suction side of the compressor 21 through the hot gas bypass 66, and it is possible to secure at least a certain amount of the refrigerant discharged from the compressor 21.

Accordingly, when the adequate refrigerant amount automatic charging operation and the refrigerant leak detection operation are performed in each embodiment described above, a problem of excessive superheating on the discharge side of the compressor 21 due to a sudden pressure drop on the suction side thereof can be avoided.

Industrial Applicability

By utilizing the present invention, conditions required for judging whether or not the amount of refrigerant is adequate can be simplified, and thus it is particularly applicable to an air conditioner that judges the amount of refrigerant charged in a refrigerant circuit.

What is claimed is:

1. An air conditioner comprising:

a refrigerant circuit including a heat source unit having a compressor and a heat source side heat exchanger exchanging heat between refrigerant and air, a utilization unit having a utilization side expansion mechanism and a utilization side heat exchanger, and a liquid refrigerant communication pipe and a gaseous refrigerant communication pipe connecting the heat source unit to the utilization unit, the refrigerant circuit being configured to perform at least a cooling operation in which the heat source side heat exchanger functions as a condenser of the refrigerant compressed in the compressor and the utilization side heat exchanger functions as an evaporator of the refrigerant condensed in the heat source side heat exchanger;

a shutoff valve being disposed at a position downstream of the heat source side heat exchanger and upstream of the liquid refrigerant communication pipe in a refrigerant flow direction in the refrigerant circuit in the cooling operation, and configured to shut off the refrigerant flow; and a refrigerant detection unit being disposed upstream of the shutoff valve in the refrigerant flow direction in the refrigerant circuit in the cooling operation, and configured to detect the amount or the amount-related value of refrigerant that exists upstream of the shutoff valve by detecting the liquid surface height of the refrigerant in the heat source side heat exchanger.

2. The air conditioner according to claim 1, further comprising a memory configured to store, in advance, data on the required amount of refrigerant that is required to perform appropriately an air conditioning operation using the refrigerant circuit, and a control unit configured to perform the cooling operation with the shutoff valve closed based on a detection result of the refrigerant detection unit and the required amount of refrigerant.

3. The air conditioner according to claim 2, wherein the shutoff valve is located at one end of the liquid refrigerant communication pipe and the utilization side expansion mechanism is located at the other end of the liquid refrigerant communication pipe, and the control unit is configured to perform a control such that the temperature of the refrigerant flowing through the liquid refrigerant communication pipe reaches a constant value in the cooling operation and then to close the utilization side expansion mechanism and the shutoff valve in that order.

4. The air conditioner according to claim 3, wherein the heat source unit includes a first heat source unit having a first compressor and a first heat source heat exchanger, and a second heat source unit having a second compressor and a second heat source heat exchanger, the shutoff valve includes a first shutoff valve disposed downstream of the first heat source side heat exchanger in a refrigerant flow direction and configured to shut off the refrigerant flow, and a second shutoff valve disposed downstream of the second heat source side heat exchanger in a refrigerant flow direction and configured to shut off the refrigerant flow, the refrigerant detection unit includes a first refrigerant detection unit disposed upstream of the first shutoff valve in a refrigerant flow direction and configured to detect the amount of refrigerant existing upstream of the first shutoff valve in the refrigerant flow direction, and a second refrigerant detection unit disposed upstream of the second shutoff valve in a refrigerant flow direction and configured to detect the amount of refrigerant existing upstream of the second shutoff valve in the refrigerant flow direction, the memory is configured to store, in advance, data on a first required amount of refrigerant for the first heat source unit, and data on second required amount of refrigerant for the second heat source unit, and the control unit is configured to control the operation of the first compressor based on the first required amount of refrigerant and to control the operation of the second compressor based on the second required amount of refrigerant.

5. The air conditioner according to claim 4, wherein the first heat source unit includes a first check valve disposed between the first compressor and the first heat source heat exchanger and configured to stop the refrigerant flow toward the first compressor, and the second heat source unit includes a second check valve disposed between the second compressor and the second heat source heat exchanger and configured to stop the refrigerant flow toward the second compressor.

6. The air conditioner according to claim 2, wherein the heat source unit includes a first heat source unit having a first compressor and a first heat source heat exchanger, and a second heat source unit having a second compressor and a second heat source heat exchanger, the shutoff valve includes a first shutoff valve disposed downstream of the first heat source side heat exchanger in a refrigerant flow direction and configured to shut off the refrigerant flow, and a second shutoff valve disposed downstream of the second heat source side heat exchanger in a refrigerant flow direction and configured to shut off the refrigerant flow, the refrigerant detection unit includes a first refrigerant detection unit disposed upstream of the first shutoff valve in a refrigerant flow direction and configured to detect the amount of refrigerant existing upstream of the first shutoff valve in the refrigerant flow direction, and a second refrigerant detection unit disposed upstream of the second shutoff valve in a refrigerant flow direction and configured to detect the amount of refrigerant existing upstream of the second shutoff valve in the refrigerant flow direction, the memory is configured to store, in advance, data on a first required amount of refrigerant for the first heat source unit, and data on second required amount of refrigerant the second heat source unit, and the control unit is configured to control the operation of the first compressor based on the first required amount of refrigerant and to control the operation of the second compressor based on the second required amount of refrigerant.

7. The air conditioner according to claim 6, wherein the first heat source unit includes a first check valve disposed between the first compressor and the first heat source heat exchanger and configured to stop the refrigerant flow toward the first compressor, and the second heat source unit includes a second check valve disposed between the second compressor and the second heat source heat exchanger and configured to stop the refrigerant flow toward the second compressor.

8. The air conditioner according to claim 1 further comprising a control unit configured to perform both a normal cooling operation and a refrigerant amount detection cooling operation, the heat source side heat exchanger having not only liquid phase and gas phase but also gas-liquid two-phase during the normal cooling operation, and the heat source side heat exchanger having the liquid surface during the refrigerant amount detection cooling operation.

9. An air conditioner comprising:

a refrigerant circuit including a heat source unit having a compressor and a heat source side heat exchanger, a utilization unit having a utilization side expansion mechanism and a utilization side heat exchanger, a liquid refrigerant communication pipe and a gaseous refrigerant communication pipe connecting the heat source unit to the utilization unit, a bypass refrigerant circuit branching from the liquid refrigerant communication pipe to the gaseous refrigerant communication pipe, a bypass expansion valve disposed in the bypass refrigerant circuit, and a subcooler configured to exchange heat between the refrigerant flowing in the bypass refrigerant circuit downstream of the bypass expansion valve and the refrigerant flowing through the liquid refrigerant communication pipe, the refrigerant circuit being configured to perform at least a cooling operation in which the heat source side heat exchanger functions as a condenser of the refrigerant compressed in the compressor and the utilization side heat exchanger functions as an evaporator of the refrigerant condensed in the heat source side heat exchanger;

a shutoff valve being disposed at a position downstream of the heat source side heat exchanger and upstream of the liquid refrigerant communication pipe in a refrigerant flow direction in the refrigerant circuit in the cooling operation, and configured to shut off the refrigerant flow;

a refrigerant detection unit being disposed upstream of the shutoff valve in the refrigerant flow direction in the refrigerant circuit in the cooling operation, and configured to detect the amount e amount-related value of refrigerant that exists upstream of the shutoff valve a memory configured to store, in advance, data on the required amount of refrigerant that is required to perform appropriately an air conditioning operation using the refrigerant circuit; and a control unit configured to perform the cooling operation with the shutoff valve closed based on a detection result of the refrigerant detection unit and the required amount of refrigerant, the shutoff valve being located at one end of the liquid refrigerant communication pipe and the utilization side expansion mechanism being located at the other end of the liquid refrigerant communication pipe, the control unit being configured to perform a temperature control such that the temperature of the refrigerant flowing through the liquid refrigerant communication pipe reaches a constant value in the cooling operation by adjusting the opening degree of the bypass expansion valve and then to close the utilization side expansion mechanism and the shutoff valve in that order, the control unit being further configured to perform a refrigerant detection operation using the refrigerant detection unit to detect the amount or the amount-related value of refrigerant that exists upstream of the shutoff valve, the control unit performing the refrigerant detection operation after he temperature control such that the refrigerant detection unit detects the amount or the amount-related value of refrigerant while the cooling operation is performed with the shutoff valve closed.

10. An air conditioner comprising:

a refrigerant circuit including a heat source unit having a compressor and a heat source side heat exchanger, a utilization unit having a utilization side expansion mechanism and a utilization side heat exchanger, and a liquid refrigerant communication pipe and a gaseous refrigerant communication pipe connecting the heat source unit to the utilization unit, the refrigerant circuit being configured to perform at least a cooling operation in which the heat source side heat exchanger functions as a condenser of the refrigerant compressed in the compressor and the utilization side heat exchanger functions as an evaporator of the refrigerant condensed in the heat source side heat exchanger;

a shutoff valve being disposed at a position downstream of the heat source side heat exchanger and upstream of the liquid refrigerant communication pipe in a refrigerant flow direction in the refrigerant circuit in the cooling operation, and configured to shut off the refrigerant flow;

a refrigerant detection unit being disposed upstream of the shutoff valve in the refrigerant flow direction in the refrigerant circuit in the cooling operation, and configured to detect the amount or the amount-related value of refrigerant that exists upstream of the shutoff valve;

a memory configured to store, in advance, data on the required amount of refrigerant that is required to perform appropriately an air conditioning operation using the refrigerant circuit; and a control unit configured to perform the cooling operation with the shutoff valve closed based on a detection result of the refrigerant detection unit and the required amount of refrigerant, the heat source unit including a first heat source unit having a first compressor and a first heat source heat exchanger, and a second heat source unit having a second compressor and a second heat source heat exchanger, the shutoff valve including a first shutoff valve disposed downstream of the first heat source side heat exchanger in a refrigerant flow direction and configured to shut off the refrigerant flow, and a second shutoff valve disposed downstream of the second heat source side heat exchanger in a refrigerant flow direction and configured to shut off the refrigerant flow, the refrigerant detection unit including first refrigerant detection unit disposed upstream of the first shutoff valve in a refrigerant flow direction and configured to detect the amount of refrigerant existing upstream of the first shutoff valve in the refrigerant flow direction, and a second refrigerant detection unit disposed upstream of the second shutoff valve in a refrigerant flow direction and configured to detect the amount of refrigerant existing upstream of the second shutoff valve in the refrigerant flow direction, the memory being configured to store, in advance, data on a first required amount of refrigerant for the first heat source unit, and data on a second required amount of refrigerant for the second heat source unit, the control unit being configured to perform a refrigerant charging operation, the first and second refrigerant detection units being configured to detect, respectively, the amounts of refrigerant existing upstream of the first and second shutoff valves during the refrigerant charging operation, the control unit being further configured to stop driving the first compressor in response to the detection unit detecting that the first required amount of refrigerant has accumulated in the first heat source unit during the refrigerant charging operation, and to stop driving the second compressor in response to the detection unit detecting that the second required amount of refrigerant has accumulated in the second heat source unit during the refrigerant charging operation.

* * * * *